US007014183B2

(12) United States Patent
Tamura et al.

(10) Patent No.: US 7,014,183 B2
(45) Date of Patent: Mar. 21, 2006

(54) SHEET-SHAPED MEDIUM TREATMENT APPARATUS

(75) Inventors: Masahiro Tamura, Tokyo (JP); Akihito Andoh, Tokyo (JP); Shuuya Nagasako, Tokyo (JP); Kazuya Tsutsui, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/172,910

(22) Filed: Jun. 18, 2002

(65) Prior Publication Data

US 2003/0006543 A1 Jan. 9, 2003

(30) Foreign Application Priority Data

Jun. 18, 2001 (JP) ..... 2001-183013
Jun. 19, 2001 (JP) ..... 2001-184799
Jun. 21, 2001 (JP) ..... 2001-187932

(51) Int. Cl.
*B65H 37/04* (2006.01)

(52) U.S. Cl. ..... 270/58.09; 270/58.08; 270/58.12; 399/410; 271/220

(58) Field of Classification Search ..... 270/58.08, 270/58.09, 58.12, 58.11, 58.17; 414/791.2; 399/410; 271/220, 221, 222, 234, 236, 241, 271/251

See application file for complete search history.

(56) References Cited

U.S. PATENT DOCUMENTS 3,735,978 A 5/1973 Turner et al.
5,020,785 A * 6/1991 Kosaka et al. ..... 270/58.11
5,120,047 A * 6/1992 Mandel et al. ..... 271/220

(Continued)

FOREIGN PATENT DOCUMENTS

EP 1 225 146 7/2002

(Continued)

OTHER PUBLICATIONS

Patent Abstracts of Japan, JP 2000-143073, May, 23, 2000.

(Continued)

*Primary Examiner*—Patrick Mackey
(74) *Attorney, Agent, or Firm*—Oblon, Spivak, McClelland, Maier & Neustadt, P.C.

(57) ABSTRACT

A sheet-shaped medium treatment apparatus is disclosed. The sheet-shaped medium treatment apparatus has returning means 121. The sheet-shaped medium treatment apparatus is movable between a home position (I) and a press/return position (II).

In addition, before leading end of discharged sheet-shaped medium S1 gets contact with top surface of sheet-shaped medium S2 already piled on said piling means, the returning means 121 is situated at said press/return position (II) and acts upon said already piled sheet-shaped medium S2 to retain it in proper position, and after said discharged sheet-shaped medium S1 falls on said piling means 12, said fallen sheet-shaped medium is aligned by being collided against said vertical wall 131 by said returning action of said returning means 121, thereafter, sheet-shaped medium is arranged by said arranging action of said arranging means in the direction of piercing the paper plane.

Also, sheet-shaped medium treatment apparatus includes after-treatment apparatus, and the after-treatment apparatus has stapling means for aligning and stapling a plurality of sheet-shaped media, if sheet-shaped medium is sheet-shaped medium bundle stapled by the stapling means, returning means is controlled so that it is remote from top of the sheet-shaped medium bundle.

40 Claims, 53 Drawing Sheets

U.S. PATENT DOCUMENTS 5,320,336 A * 6/1994 Asami ..... 270/58.08
5,508,798 A 4/1996 Yamada
5,692,411 A 12/1997 Tamura
5,762,328 A 6/1998 Yamada
6,120,020 A 9/2000 Asao
6,142,466 A * 11/2000 Dickhoff ..... 271/220
6,145,825 A 11/2000 Kunihiro et al.
6,199,853 B1 3/2001 Andoh et al.
6,231,045 B1 5/2001 Yamada et al.
6,264,191 B1 7/2001 Suzuki et al.
6,296,247 B1 10/2001 Tamura et al.
6,311,971 B1 * 11/2001 Greer et al. ..... 271/220
6,322,070 B1 11/2001 Yamada et al.
6,343,785 B1 2/2002 Yamada et al.
6,394,448 B1 5/2002 Suzuki et al.
6,412,774 B1 * 7/2002 Saito et al. ..... 271/220
6,416,052 B1 7/2002 Yamada et al.
6,494,449 B1 12/2002 Tamura et al.
6,494,453 B1 12/2002 Yamada et al.
6,527,269 B1 3/2003 Yamada et al.
6,550,758 B1 * 4/2003 Ardery et al. ..... 270/58.12
6,561,504 B1 * 5/2003 Mlejnek et al. ..... 270/58.12

FOREIGN PATENT DOCUMENTS

JP 62046862 A * 2/1987
JP 5-139610 6/1993
JP 5-185767 7/1993
JP 05185767 A * 7/1993
JP 5-278928 10/1993

OTHER PUBLICATIONS

Patent Abstracts of Japan, JP 62-46863, Feb. 28, 1987.
Patent Abstracts of Japan, JP 63-143167, Jun. 15, 1988.
Patent Abstracts of Japan, JP 63-267662, Nov. 4, 1988.
Patent Abstracts of Japan, JP 2000-86064, Mar. 28, 2000.
Patent Abstracts of Japan, JP 6-100229, Apr. 12, 1994.

* cited by examiner

| FIG. 51 | FIG. 51A |
|---|---|
| | FIG. 51B |

SHEET-SHAPED MEDIUM TREATMENT APPARATUS

BACKGROUND OF THE INVENTION

1. Field of the Invention

The present invention relates to a sheet-shaped medium treatment apparatus capable of effectively carrying out sheet-shaped medium treatments such as collating sheet-shaped mediums, sorting the sheet-shaped mediums, forming image thereon, after-treating the sheet-shaped mediums and the like.

2. Description of the Prior Art

As a means for carrying out collating in a piling state on a tray of piling means and sorting sheet-shaped mediums on which image is formed and which are conveyed successively at a constant interval, a unknown sheet-shaped medium treatment apparatus has been suggested.

As shown in FIG. 44 and FIG. 45, this sheet-shaped medium treatment apparatus generally comprises a discharging means having a paper-discharging roller 3 consisting of a pair of lower roller 3*a* and upper roller 3*b* for discharging the sheet-shaped mediums to be conveyed, a piling means (hereinafter, referred to as a tray 12) for piling the sheet-shaped mediums discharged from the discharging means, an arranging means (not shown in FIG. 44 and FIG. 45 and described later) for arranging the sheet-shaped mediums piled on the tray 12 by contacting with end portions parallel to their discharge direction a from the discharging means, so as to sandwich them, a sorting means (tray shifting means or arranging member driving means) for sorting the sheet-shaped mediums by shifting the tray 12 or the arranging means by a predetermined amount in a shift direction d perpendicular to the discharge direction a and a return means comprised of a rotational body capable of contacting with and separating from the sheet-shaped mediums for carrying out return operations of moving the sheet-shaped mediums by means of rotation in contact with the sheet-shaped mediums to bring them into contact with a vertical wall (hereinafter, referred to as an end fence), which is provided at the upstream end of the tray 12 in the discharge direction a, to thereby collate the sheet-shaped mediums, In FIG. 44 and FIG. 45, return rollers 121*a* and 121*b* constructing the part of the return means are shown.

This sheet-shaped medium treatment apparatus is constructed as a part of an image forming apparatus or to include a sheet-shaped medium after-treatment apparatus, for carrying out a longitudinal arrangement of collating the sheet-shaped mediums to be conveyed successively in the discharge direction and a transverse arrangement of collating the sheet-shaped mediums in a direction perpendicular to the discharge direction and, if necessary, for carrying out a sorting process.

For collating the sheet-shaped mediums, arranging operation by the arranging means or return operation by the return means is carried out and for sorting the sheet-shaped mediums, sorting operation by the sorting means is carried out. In this case, each operation for collating or sorting the sheet-shaped mediums is carried out by a constant time interval at which the sheet-shaped mediums are conveyed successively.

For example, In a period after a sheet-shaped medium is discharged onto the tray before a next sheet is discharged, (1) return operation for arranging the sheet-shaped medium in the discharge direction by returning the sheet-shaped medium till coming into contact with the end fence by means of the return means, in order to arrange the sheet-shaped medium right after discharging in the same line as end edges of the discharging-completed sheet-shaped mediums in the discharge direction, (2) arranging operation for sandwiching ends of the sheet-shaped mediums together with the discharging-completed sheet-shaped mediums in the shift direction d by use of the arranging means, in order to arrange end edges of the sheet-shaped mediums in the shift direction d and (3) after the last sheet-shaped mediums of a part are discharged and before the first sheet-shaped medium of next part is discharged, sorting operation for shifting the tray 12 (or shifting the arranging members) by a predetermined amount, are carried out.

In such unknown paper after-treatment apparatus, when the sheet-shaped mediums received from the image forming apparatus are conveyed and are discharged and piled on the tray 12 sheet by sheet via a paper-discharging roller 3, the sheet-shaped mediums were collated and piled much depending on the self-weight dropping of the sheet-shaped mediums. That is, the tray 12 is mounted such that a side close to the discharging outlet (downstream side in the discharge direction a) becomes lower than a side distant from the discharging outlet (upstream side in the discharge direction a), by a constant angle, for example, an angle $\alpha$.

By this, the sheet-shaped mediums dropped on the tray 12 slide toward the upstream side in the discharge direction along the slope. In sliding, the sheet-shaped mediums get in contact with return rollers 121*a* and 121*b* that are fired under the paper-discharging roller 3 to contact with and separate from the piled papers, and rear ends of the sheet-shaped mediums get in contact with the end fence 131 to be arranged by means of rotating force of these return rollers.

The rear ends of sheet-shaped mediums discharged from the discharging roller 3 are picked out from the discharging roller 3 and then the sheet-shaped mediums are dropped on the tray 12 along the outer circumference surface of the return rollers 121*a* and 121*b* placed under the discharging roller 3. However, right after the drop, the rear ends of the sheet-shaped mediums are not in contact with the return rollers 121*a* and 121*b* and when the sheet-shaped mediums slide toward the end fence along slope of the tray 12, the rear ends first get in contact. If the sheet-shaped mediums get in contact with the return rollers, they are drawn by means of the rotating force of return rollers 121*a* and 121*b*.

However, for example when the sheet-shaped mediums having back curls (downward curls) with middle height are piled in large quantities on the tray 12, slope angle of the piling surface becomes gentle to $\theta$ smaller than $\alpha$ and it is more difficult for the sheet-shaped mediums dropped on the tray to return, because of slope of the piling surface. If the sheet-shaped mediums do not return, they can not be in contact with the return rollers 121*a* and 121*b*, so that the sheet-shaped mediums might not return till they get in contact with the end fence 131 not to be uniform.

Also, regardless of curling direction, as shown in FIG. 45, when paper S1 as the sheet-shaped medium is discharged, the rear end thereof may not be caught by the return rollers 121*a* and 121*b*. So, when the front end of the discharged paper S1 gets in contact with papers S2 already piled on the tray 12, the piled paper S2 is extruded in the discharge direction a by the discharged paper S1 and as a result, not-uniformity takes place as shown in FIG. 45.

SUMMARY OF THE INVENTION

An object of the present invention is to provide a sheet-shaped medium treatment apparatus capable of arranging and sorting sheet-shaped mediums well, forming image thereon, and after-treating the sheet-shaped mediums, regardless of curling or piling state of the sheet-shaped mediums.

In order to accomplish the object, a sheet-shaped medium treatment apparatus according to the present invention comprises a discharging means for discharging a sheet-shaped medium to be conveyed; a piling means for piling the sheet-shaped medium discharged from the discharging means; an arranging means for carrying out an arranging operation that arranges the sheet-shaped medium piled on the piling means by contacting with end portions thereof parallel to a discharge direction from the discharging means and sandwiching them; and a return means comprised of a rotational body capable of getting in contact with and being separated from the sheet-shaped medium, for carrying out a return operation of returning the sheet-shaped medium by means of rotation in contact with the sheet-shaped medium until the sheet-shaped medium gets in contact with a vertical wall provided at upstream end of the piling means in the discharge direction.

The return means is capable of being displaced between any home position and a pressing/returning position at which rear end of the discharged paper in the discharge direction is held. Also, before a sheet-shaped medium to be discharged from the discharging means is dropped on the piling means, the return means can carry out a pressing operation of getting in contact with and pressing the sheet-shaped medium on the piling means, and before front end of the sheet-shaped medium to be discharged gets in contact with the upper surface of the piled sheet-shaped medium already piled on the piling means, the return means is positioned at the pressing/returning position and the piled sheet-shaped medium is kept at a predetermined position by means of the pressing operation. Then, after the sheet-shaped medium to be discharged is dropped on the piling means, the dropped sheet-shaped medium is collated to be in contact with the vertical wall by means of return operation of the return means and the sheet-shaped medium is arranged by means of arranging operation of the arranging means.

Also, in such sheet-shaped medium treatment apparatus, when the sheet-shaped medium under the arranging operation by the arranging means is the last sheet-shaped medium, the last sheet-shaped medium is subject to get in contact with the vertical wall and be collated by means of return operation of the return means after arranging operation by the arranging means.

When the sheet-shaped medium discharged on the piling means is not the last sheet-shaped medium, the return means is positioned at the pressing/returning position and the sheet-shaped medium in contact with the arranging means is pressed by means of the pressing operation while the arranging means is in contact with the sheet-shaped medium to sandwich the ends thereof parallel to the discharge direction.

The return means makes rotation-stopping control possible, separately from driving the discharging means.

An image forming apparatus having an image forming means for forming image on the sheet-shaped medium and a crying means for carrying the image-formed sheet-shaped medium may be constructed to include the sheet-shaped medium treatment apparatus.

A sheet-shaped medium after-treatment apparatus having an after-treating means for after-treating sheet-shaped medium and a carrying means for carrying the after-treated sheet-shaped medium may be constructed to include the sheet-shaped medium treatment apparatus.

Moreover, the sheet-shaped medium after-treatment apparatus may include a staple means for collating and stapling a plurality of sheet-shaped mediums and when the sheet-shaped mediums are a bundle of sheet-shaped mediums stapled by the staple means, the return means is controlled to be kept separated from the upper ice of the bundle.

DETAILED DESCRIPTION OF THE PREFERRED EMBODIMENTS

First, sheet-shaped medium in this specification includes copying paper, transfer paper, recording paper, covering paper, paper board, paper for computer, special purpose paper, and ORP sheet, etc., however, hereinafter, the word "paper" is used for all the names above.

In sheet-shaped medium after-treatment apparatus which performs after-treatment such as stamping, punching unit for punching for filing, staple means, or image forming apparatus, for copiers, paper discharged from discharging means is required to be piled in a preferable precise sorting state so that a bundle of papers sorted and piled can be sent to the next process, for example, to punching machine.

If the degree of precision about arrangement for the bundle of papers is bad, since the bundle of papers discharged out from tray need to be arranged by hands one more time, the efficiency of process is very low. On this reason, upper segment, for example, so-called copier wants high degree of arranging precision for piled papers, therefore, there is need for improving the degree of arranging precision, and such need can be satisfied by employing ranging means, returning means or sorting means described below.

<First Embodiment>

According to sheet-shaped medium treatment apparatus according to first embodiment of the present invention, it is possible to make (1) the apparatus as an integrated unit, and (2) the apparatus can be used as integrally with or combined by other apparatuses having means for discharging sheet-shaped medium, for example, image forming apparatus without arranging function and sorting function, or sheet-shaped medium after-treatment apparatus without arranging function and sorting function so that sheet-shaped medium is arranged and sorted on tray by arranging function and sorting function.

At first, by using, as an example, sheet-shaped medium after-treatment apparatus, discharging means for discharging sheet-shaped medium, tray as a piling means for piling sheet-shaped medium discharged from discharging means, arranging means, sorting means will be described below. Also, mechanical construction and operation of return means, structure and order for arranging sheet-shaped medium through timing chart and flowchart, and at last, as an example, image forming apparatus will be described below.

<General Outline of Sheet-Shaped Medium After-Treatment Apparatus>

In the present embodiment, the apparatus will be described by using, as examples, independent sheet-shaped medium after-treatment apparatus connected to image forming apparatus and integrally formed sheet-shaped medium treatment apparatus.

Figure 3:
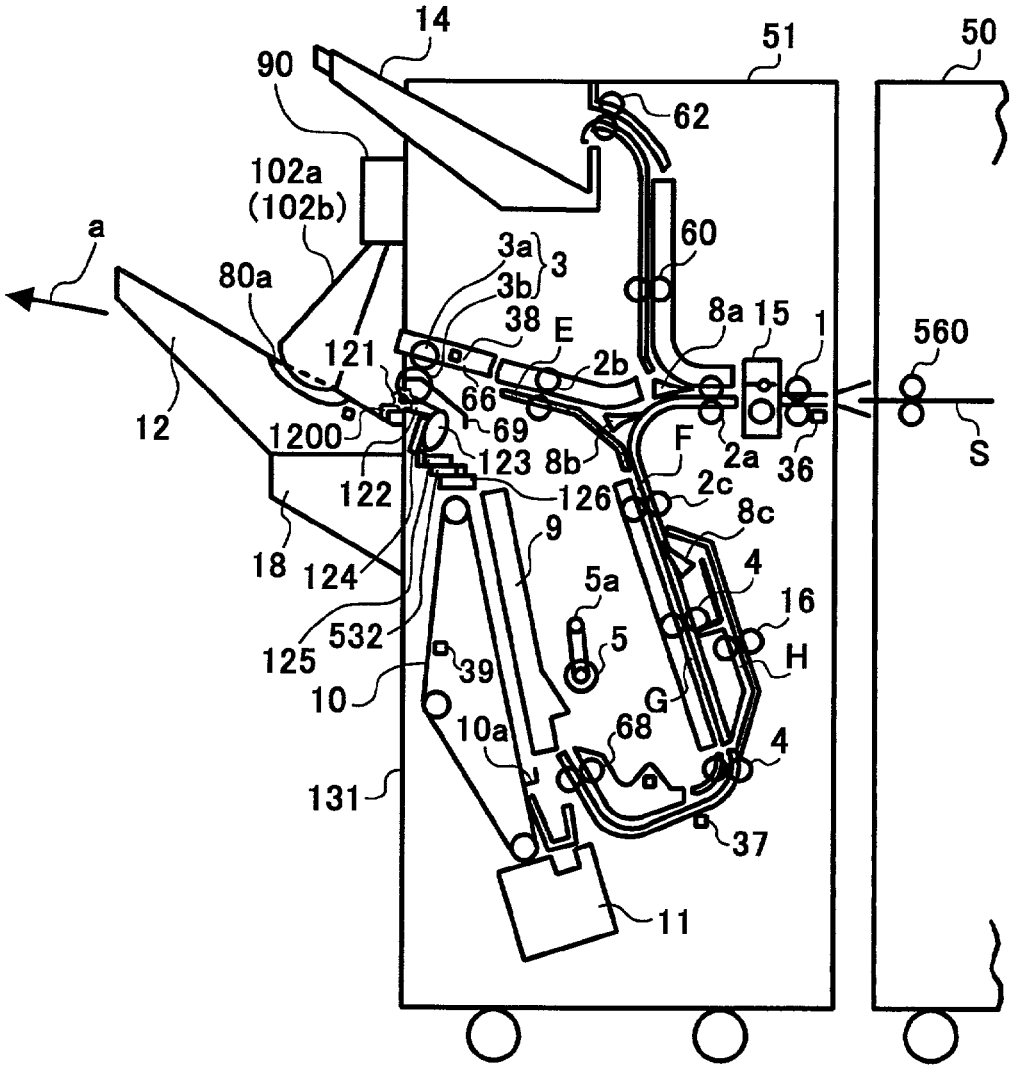
FIG. 3 schematically shows structures of a sheet-shaped medium after-treatment apparatus and an image forming apparatus according to the first embodiment.

In FIG. 3, sheet-shaped medium after-treatment apparatus 51 as after-treatment means for performing after-treatment on paper is connected to image forming apparatus 50.

According to the contents of after-treatment instructed by operator, paper S on which image forming has been executed by image forming means in image forming apparatus 50 is conveyed to sheet-shaped medium after-treatment apparatus 51.

If image forming apparatus 50 is a copying machine, the contents of after-treatment in sheet-shaped medium after-treatment apparatus 51 may be as follows.

(1) General mode for simply piling the papers in order of discharge. In this mode, the processes are implemented by instructing the size of paper and the number of copying.

(2) Staple mode for executing staple treatment. In this mode, the processes are implemented by handling the size of paper and the number of copying through the instruction about the number of papers to be filed and position of filing.

(3) Mode for executing sorting treatment. In this mode, the processes are implemented by instructing size of paper and the number of papers to be sorted.

(4) Punch mode. In this mode, punching is done. Additionally, other treatment can be done as necessary.

When command relating to after-treatment is transferred from control panel of copying machine to control means having CPU by manipulating keys, after-treatment is implemented by signal communications regarding the after-treatment operation which is executed between the image forming apparatus 50 and the sheet-shaped medium after-treatment apparatus 51, and the control means. Also, this sheet-shaped medium after-treatment apparatus is integrated with a sheet-shaped medium arranging apparatus having arranging means which will be described below.

With the sheet-shaped medium after-treatment apparatus, the after-treatment can be selected to be executed or not, and after-treated papers in case of after-treatment execution, or non-after-treated papers in case of no execution of the after-treatment can be arranged in sorted manner using sorting function and arranging function of the sheet-shaped medium treatment apparatus.

FIG. 3 illustrates an example of whole configuration of sheet-shaped medium after-treatment apparatus 51. A sheet-shaped medium after-treatment apparatus of the present embodiment can be used as being connected to other apparatus having sheet-discharging means, for example, image forming apparatus 50 without arranging function, and can arrange the papers on tray 12 with arranging function.

Papers that are image-formed in the image forming apparatus 50 are transferred to the sheet-shaped medium after-treatment apparatus 51. The after-treatment can be selected to be executed or not, and after-treated papers in case of after-treatment execution, or non-after-treated papers in case of non-execution of the after-treatment are arranged on the tray in the discharge direction a by arranging operation of the sheet-shaped medium treatment apparatus connected to the sheet-shaped medium after-treatment apparatus 51, and, if necessary are piled in sorted manner spaced apart by certain numbers of openings in the shift direction d perpendicular to the discharge direction a (direction orthogonal to the plane of FIG. 3). This sorting function is fulfilled by tray moving means 98 which move the tray 12 in the shift direction d (which will be described below).

As shown in FIG. 3, the sheet-shaped medium after-treatment apparatus 51 has liftable tray 12 as sheet piling means, while it has proof tray 14 as a position holding tray at the upper portion thereof.

In the vicinity of sheet-transporting position of image forming apparatus 50, inlet sensor 36 and a pair of inlet rollers 1 are disposed, and paper inserted by the inlet rollers 1 is conveyed along respective conveyance path according to after-treatment mode.

Downstream of a pair of inlet rollers 1, punch unit 15 which performs punching is arranged, and a pair of conveyance rollers 2*a* are arranged downstream of the punch unit 15. Downstream of a pair of conveyance roller 2*a*, a branch claw 8*a* is arranged, and papers are guided along conveyance path toward proof tray 14 by the branch claw 8*a*, or along substantially horizontally extended conveyance path, selectively. When conveyed toward proof tray 14, papers are conveyed through a pair of conveyance rollers 60, and then discharged to proof tray 14 through a pair of discharging rollers 62.

A branch claw 8*b* is arranged downstream the branch claw 8*a*, and papers are guided by the branch claw 8*b* to non-staple route E, or staple route F, selectively. Branch claws 8*a*, 8*b* are configured to change their positions by On/Off control of solenoid which is not shown.

Paper guided to non-staple route E are conveyed by a pair of conveyance rollers 2*b* and discharged to tray 12 by discharging roller 3 which is discharging means. Return roller 121 as returning means to be described below is disposed to be overlapped with the lower portion of a pair of discharging rollers 3 or in lower position thereof The return roller 121 consists of two return rollers 121*a* and 121*b* as described below, and is able to be displaced from any home position to press/return position where rear end of discharged paper is held, in discharge direction a. Left of the apparatus body in the figure shows end fence 131 for arranging rear end of paper with respect to tray 12.

Discharging roller 3 has upper roller 3*a* and lower roller 3*b* with the lower roller 3*b* rotatably connected to free end of supporting means 66 which are pivotally fixed and movable upward and downward with its upstream side of sheet discharge direction supported. Lower roller 3*b* is in contact with upper roller 3*a* by its weight or energized force, and papers are discharged through the interfacial faces of the two rollers. When a bundle of papers on which filing treatment has been done are discharged, supporting mans 66 are moved upward pivotally and returned in a predetermined timing. This timing is determined based on detection signal of discharging sensor 38. Discharging sensor 38 is arranged proximate to the upstream of the discharging roller 3.

Paper guided to staple route F is conveyed by a pair of conveyance rollers 2*c*. Branch claw 8*c* is arranged downstream of conveyance roller 2*c* and paper is selectively guided to original staple route G or evacuation route H by branch claw 8*c*. Branch claw 8*c* is also adapted to change its position through On/Off control of solenoid which is not shown.

Paper guided to original staple route G is conveyed through a pair of conveyance rollers 4, detected by discharging sensor 37, and piled in staple tray (not shown) by a pair of discharging rollers 68. During this process, each paper is and in longitudinal direction (sheet conveying direction) by beating roller 5, and aligned in transverse direction (sheet width direction perpendicular to discharge direction a) by jogger fence 9. Amid jobs, i.e., between the last paper of previous bundle and the first paper of next bundle, stapler 11 is operated by a staple signal from a control means not shown, and fling treatment is executed.

If the distance between papers discharged from image forming apparatus 50 is short and the next paper arrives before completion of filing treatment, the next paper is guided to evacuation route H, and evacuated temporarily. The paper which was guided to evacuation route H is returned by a pair of conveyance rollers 16.

A bundle of papers on which filing treatment has been finished are subsequently transported via guide 69 to discharging roller 3 by an ejecting belt 10 having ejecting claw 10*a*, and then discharged to tray 12. Ejecting claw 10*a* is adapted so that its position is detected by a sensor 39.

Beating roller 5 imparts pendulous movement about a supporting point 5*a* by solenoid (not shown), and acts upon the paper transported into said staple tray intermittently, so that the paper collides against end fence 131. Although not shown, a pair of discharging rollers 68 have brush roller which prevents rear end portion of paper from flowing reversely. In addition, beating roller 5 rotates counterclockwise. Described above is the outline of structure and operation of intrinsic functional parts of the sheet-shaped medium after-treatment apparatus.

Sheet-shaped medium after-treatment apparatus 51 can arrange and sort papers piled on tray 12, as will be described below, as well as can implement after-treatment as an intrinsic function. The word, arrangement includes two meanings such as arrangement of ends of paper in discharge direction a, and arrangement of ends of paper in shift direction d, while the former is achieved by a function of return roller 121 as a return means which execute collision against end fence 131, and the latter is achieved by a pair of arranging member 102 as arranging means.

In FIG. 3, the sheet-shaped medium after-treatment apparatus includes discharging roller 3, tray 12 which receives paper S discharged from discharging roller 3, lifting means which lift/lower tray 12, positioning means which control the lifting direction of tray 12, tray moving means as sorting means which reciprocate tray 12 in shift direction d perpendicular to discharge direction a of FIG. 3, displacing means which displaces the return roller 121 in the discharge direction a and return roller 121 as return means for arranging papers piled on tray 12 by colliding end fence 131, arranging members 102*a*, 102*b* as arranging means, and driving means thereof.

Among these components said tray lifting means is designated by reference number 95 in FIG. 4(A), positioning means for lift direction are designated by reference number 96 in FIG. 4(B), and tray moving means are designated by 98 in FIGS. 5 and 6, details of which being described below.

<Tray and Tray Moving Means as Sorting Means>

Referring to FIG. 3, paper S is conveyed by a pair of conveyance rollers 2*b* as conveyance means from branch claw 8*b* to tray 12 via discharging sensor 38, and delivered in discharge direction a by discharging roller 3.

As shown in FIGS. 3 and 4, upper surface of tray 12 is inclined upwardly so that the height thereof is getting higher in discharge direction a. End fence 131 consisting of vertical plane is located at the bottom of the inclined plane of the tray 12.

In FIG. 3, discharged paper S from discharging roller 3 enters between arranging members 102*a* and 102*b* which are staying at receiving positions (See FIG. 10) to be described below, and is slipped onto the tray 12 along said inclination, and rear end of the paper is aligned by colliding against end fence 131. Paper S on tray 12 with its rear-end aligned is arranged in the shift direction d (width direction) due to arranging operation of arranging members 102*a* and 102*b*.

Figure 4A:
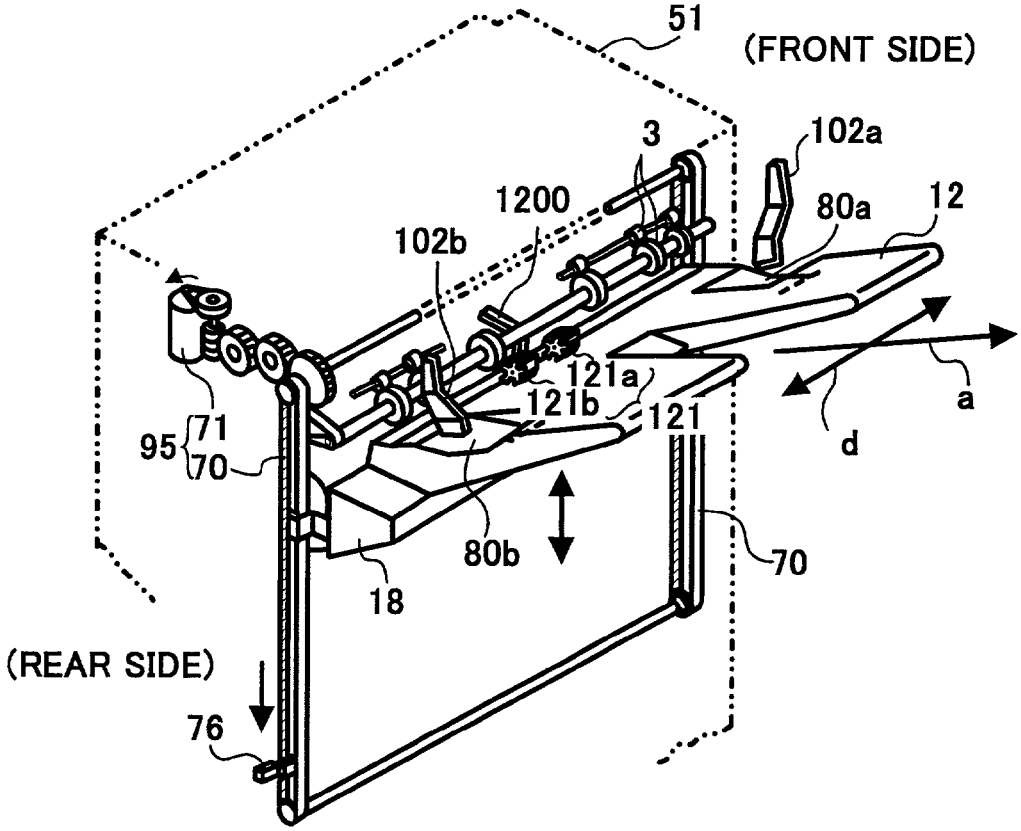
FIG.4(A) is a perspective view of important parts of the sheet-shaped medium after-treatment apparatus and FIG. 4(B) is a schematically perspective view of periphery parts of a sensor controlling height of the tray.
Figure 4B:
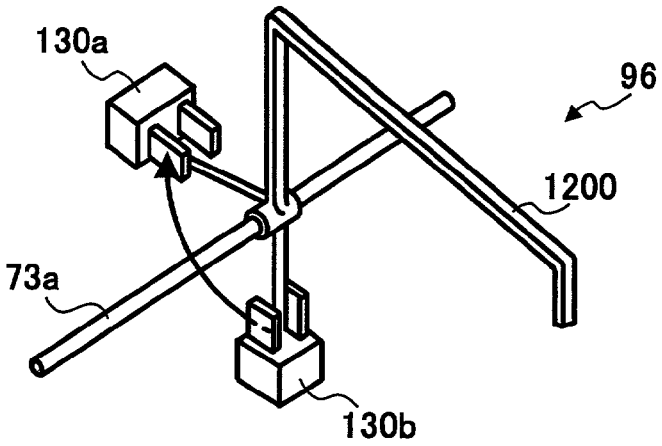

As shown in FIG. 4(A), on upper side of tray 12, since a recess 80*a* is defined at the portion corresponding to arranging member 102*a* and a recess 80*b* is defined at the portion corresponding to arranging member 102*b*, certain portions are configured to be partially lower than the upper side of tray 12. If there is no paper piled at least on the recesses 80*a* and 80*b*, arranging members 102*a*, 102*b* in their receiving position are oriented so that some portions of the members are located above the recesses 80*a*, 80*b* and maintained to be overlapped with tray 12. This ensures that the arranging members 102*a*, 102*b* would be made contact with end face of paper S during arranging operation.

Referring to FIG. 4(A), tray 12 is lifted/lowered by lifting means 95, while being controlled by position determining means 96 to be always in proper position for paper S to be landed.

Consequently, if tile height of piled surface is getting higher according to continuous discharge of papers from discharging roller 3, tray 12 is controlled to be lowered by appropriate amount by means of tray lifting means 95 and position determining means 96 regulating lifting direction of tray, so that the position of top surface of papers remain at a certain height from nip portion of arranging roller 3 and landing position remains in a certain level.

In FIGS. 3 and 4(*a*), discharging roller 3 is in a constant position. Thus, without lifting/lowering of the tray 12, since the height of the bundle of paper becomes higher as papers S are discharged onto tray 12 and piled, the bundle of papers impede any discharge of paper, therefore, discharge of paper S is made impossible consequently.

By preparing lifting means, it is possible to lift/lower the tray 12, and therefore, maintain the distance between nip portion of discharging roller 3 and top surface of tray 12, or the distance between nip portion of discharging roller 3 and top surface of papers S on the tray 12 at an appropriate distance by means of position determining means so that discharging is smoothly operated. In this way, it is possible to discharge papers S onto tray 12 with small deviation of landing position.

As shown in FIG. 4(A), tray 12 is suspended by lifting/lowering belt 70. Lifting/lowering belts 70 are driven by lifting/lowering motor 71 through gear train and timing belt, and lifted or lowered by forward rotation and reverse rotation of lifting/lowering motor 71. These lifting/lowering belt 70, lifting/lowering motor 71, gear train and timing belt are main components of lifting/lowering means 95 which lift/lower the tray.

In FIG. 4(A), return rollers 121*a* and 121*b* are provided in the vicinity of discharging roller 3. Paper S discharged onto tray 12 is slipped down along inclined surface of tray 12, and if its rear end is sandwiched by return roller 121*a* and 121*b*, returned by these return rollers 121*a* and 121*b* and aligned in discharge direction by its rear-end being collided with end fence 131.

Thus, subsequently, while papers S on which image forming has been done are plied in turn on tray 12, top surface of papers S is getting higher. In the proximity of the return rollers 121*a*, 121*b*, at the top surface of the piled papers, as shown in FIG. 4(B), there provide a paper surface lever 1200, one end of which is supported swingably on shaft 73*a* and is disposed to contact due to its own weight, and the other end of which is adapted to be detected by a paper surface sensor 130*a* or 130*b* comprising photo-interrupter.

Paper surface sensor 130*b* controls upward and downward positions of the tray 12 in a normal sheet piling mode, and paper surface sensor 130*a* performs the same kind of control in a staple mode, wherein paper discharging position is changed in accordance with the modes.

Paper surface lever 1200 is supported so that it is rotated about supporting shaft 73*a* by moment of its own weight. If position of top surface of papers piled on the tray 12 becomes higher, curved end of paper surface lever 1200 is pressed up from the top surface and rotated about the shaft 78*a*, and therefore, the paper surface sensor 130*b* is turned on upon detecting the fan-shaped plate part formed at the other end of paper surface lever 1200. At this time, the tray 12 is lowered by means of driving of the lifting/lowering motor 71. At the timing when the paper surface sensor 130*b* is turned off upon the paper surface lever 1200 being rotated by lowering the tray 12, descent of the tray 12 by the lifting/lowering motor 71 is stopped. By repeating such operation, the gap between tray 12 and nip portion of discharging roller 3 is controlled to be a certain distance. Control by the paper surface sensor 130*b* is performed in normal mode, while control by the paper surface sensor 130*a* is performed in staple mode.

At this time, since in a normal mode, top face of papers S is getting higher every time paper S is discharged, and every time free end of paper surface lever 1200 is overlapped with the paper surface sensor 130*b*, the tray 12 is controlled to be lowered until the paper surface sensor 130*b* is turned off by driving the lifting/lowering motor 71. Thereby, positional condition for landing on the tray 12 of paper S is determined by said proper control of the gap between discharging roller 3 and tray 12 (topmost surface of papers). The paper surface sensors 130*a*, 130*b* and the paper surface lever 1200 are main constituents of positioning means 96 for controlling the height of tray 12 at constant, and detect positioning information and send it to the control means.

The height of tray 12 with such suitable gap is referred to as a suitable discharging position, and is a position established as a suitable position for receiving papers in normal state rather than special state such as a curl.

Since the discharging conditions are of course different between when paper is discharged one by one in normal mode and when a stapled bundle of papers are discharged in staple mode, the suitable discharging positions for tray 12 are also different. It is also obvious from the fact that the positions of paper surface sensors 130*a* and 130*b* are differently established. Also, upon completing after-treatment, operation for lowering the tray 12 by approximately 30 mm is preformed so that it is prepared to pick up the papers.

In normal mode, staple mode, or other modes related to any after-treatment, at each proper reference height, the paper S from discharging roller 3 is discharged onto tray 12, the tray 12 is lowered every time paper S is piled, and finally, the lower limit position is detected by lower limit sensor 76. Also, when lifting the tray 12, the tray 12 is lifted by a reference height based on detected information about the paper surface by use of the positioning means such as paper surface sensors 130*a*, 130*b* and paper surface lever 1200, etc.

To perform the sorting operation, tray 12 is moved from one end to the other in the shift direction which is a direction penetrating the drawing plane of FIG. 3, i.e., the direction indicated by symbol "d" of FIG. 4(A), and is supported slidably on pedestal 18 to be moved from the other end to the one end.

Now, the tray moving means 98 will be described below.

In FIG. 4(A), the tray 12 is moved from one end to the other end in the shift direction d in order to perform sorting operation, and then, is moved from the other end to the one end. If a work unit, in which certain number of discharged papers consisting of a bundle of papers as one sorting unit are treated, is defined as 1 job, tray 12 is not moved in the shift direction d during one same job, however, the tray 12 is moved in the shift direction d when every 1 job (bundle) is finished so that papers S to be discharged in next job are received in one moving end thereof.

As described later, in discharging papers S, if the piled papers are previously pressed by means of return roller and the discharged paper is dropped onto the tray 12, returning operation of the dropped paper by the return roller 121 is performed and then, arranging operation by the arranging members 102*a*, 102*b* is performed. Also, in sorting mode, when piling of the last paper is completed, sorting operation is performed by movement of the tray 12 in the drift direction d.

Figure 5:
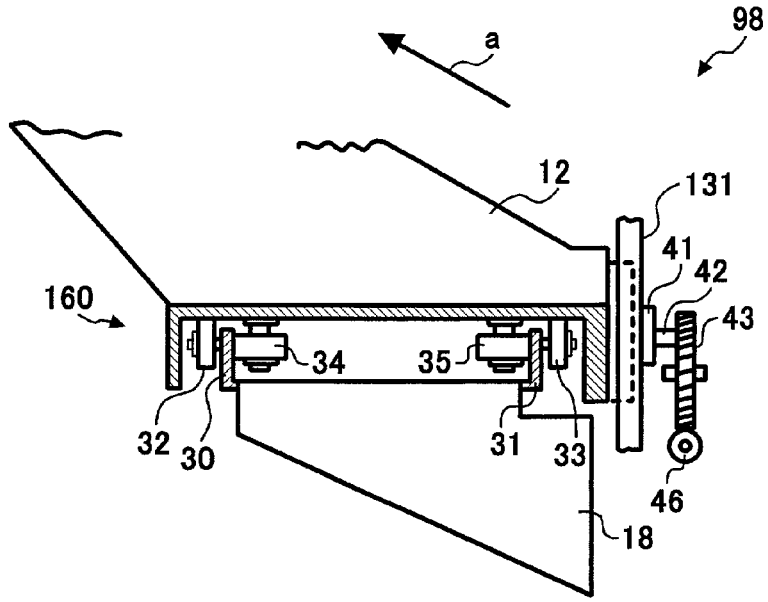
FIG. 5 is a partial cross-sectional view for illustrating structure of a tray shift means for shifting the tray in a shift diction.
Figure 6:
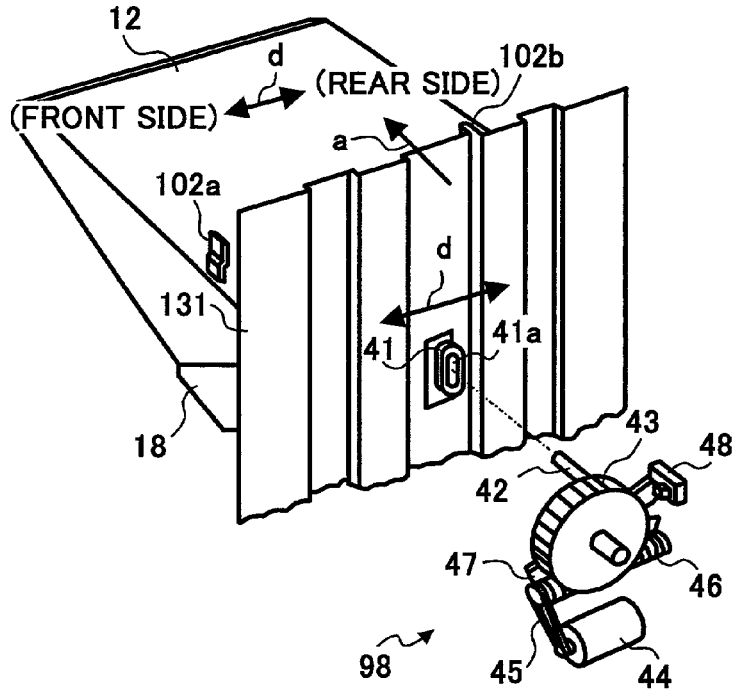
FIG. 6 is a perspective view illustrating a driving mechanism of the tray according to the present invention.

Referring to FIGS. 5 and 6, the tray moving means 98 which, in order to sort papers (including a bundle of papers) piled on the tray 12, perform the sorting operation by moving the tray 12 in the shift direction d will be described. Since the displacement amount d of tray 12 is an amount necessary for sorting, it may be determined depending on paper size or kind of paper, and operator's preference, etc., and for example, about 20 mm will be good.

Tray moving means 98 includes tray supporting structure for slidably supporting the tray 12 on pedestal 18, as shown in FIG. 5 and tray reciprocating mechanism for reciprocating the tray 12 as shown in FIGS. 5 and 6.

Tray supporting structure 160 is described in reference to FIG. 5. In FIG. 5, two guide plates 30, 31 aced widthwise are integrally arranged on pedestal 18, and they have their lengths in the shift direction d. Outside each of these guide plates 30, 31, shaft is protruded and rollers 32, 33 are supported on these axes.

On the other hand, beneath the tray 12, flat portion comprising flat surface having its inner length which is bigger than the gap between rollers 32, 33 widthwise and which is long enough to cover the shift amount tray in the shift direction d is arranged. The flat portion is mounted on rollers 32, 33. In addition, in said flat portion of tray 12, two shaft are disposed at positions corresponding to inside of guide plates 30, 31 so that each roller 34, 35 is rotatably supported on the two shafts. These rollers 34, 35 are in contact with inside of each guide plate 30, 31.

Rollers 32, 33, 34, 35 and guide plates 30, 31 constitute the tray supporting structure 160 which supports the tray 12 in the shift direction d. In the tray supporting structure 160, weight of tray 12 is supported by rollers 32, 33 and the tray 12 is guided to guide plates 30, 31 to be moved in the shift direction d.

Driving force for reciprocating movement are applied to the tray 12 by combining the tray reciprocating mechanism with the tray 12 supported by the tray supporting structure 160, so that reciprocating movement in the shift direction d is possible. Various tray reciprocating mechanisms can be considered. For example, though not shown, a driving mechanism in which a rack is provided along the shift direction d and a pinion engaging with the rack is driven by means of a motor capable of being rotated forwardly and reverse, a crank mechanism and the like can be considered.

By means of tray moving means composed like this, the tray 12 can be reciprocated in the shift direction d by certain amount necessary for sorting papers.

Now, exemplary embodiment of the tray reciprocating mechanism will be explained together with a tray position determining means. In FIG. 6, the tray 12 is moved in the same direction as the shift direction d where the end fence 131 is moved since the tray 12 is inserted in convexo-concave part of the end fence 131. Bracket 41 having long hole 41*a* is mounted at the center in the s direction d of end fence 131, and pin 42 is inserted in said long hole 41*a*.

Pin 42 is securely inserted in worm wheel 48 axially supported on the main body not shown. The secure insertion position is located eccentrically from rotational center of the worm wheel 43. The amount of eccentricity is a half of displacement amount d of tray 12 in the shift direction d.

Worm wheel 43 is configured to rotate by means of worm 46 rotating via timing belt 45 from motor 44. Pin 42 rotates by means of rotation of the worm wheel 43, and the tray 12 is changed in its direction of movement to reciprocate straightly in the shift direction d according to the amount of eccentricity. The structure of pin 42 rotating eccentrically, long hole 41*a* and the peripherals thereof constitute main part of the tray reciprocating mechanism.

Figure 7:
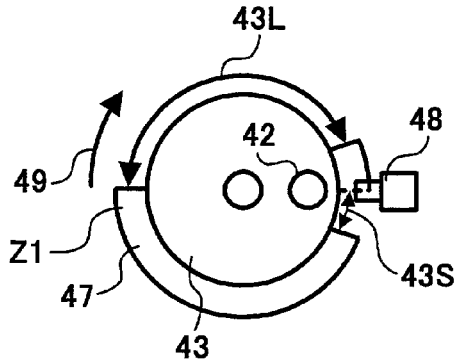
FIG. 7 is a front view illustrating a worm wheel and a home sensor.
Figure 8:
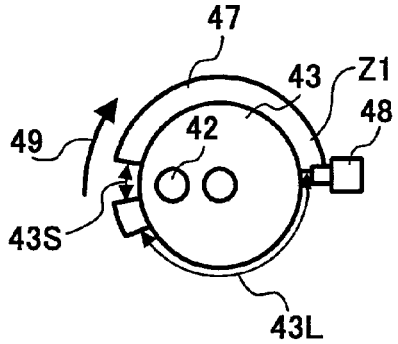
FIG. 8 is a front view illustrating the worm wheel and the home sensor.

As shown in FIGS. 7 and 8, disk-shaped encoder 47 having two big different cutouts 43L, 43S, a semi-circular long convex portion and a short convex portion adjacent therewith which were formed relatively by the two cutouts 43L, 43S are provided in the worm wheel 43.

Cutout 43L is a long cutout, and cutout 43S is a short cutout. Upon every half-rotation of the encoder 47, home sensor 48 detects cut-out length of the encoder 47 through the gap between two said convex portions, so that signal for stopping or driving the motor 44 is emitted from the control means.

In FIG. 7, when cutout 43S, which is a short one, of the encoder 47 being rotated in a direction of the arrow 49 is passed through the home sensor 48 and overlapped with short convex portion, the motor 44 stops. In this state, the pin 42 is in rear side, and the tray 12 is also moved to rear side with the end fence 131 of FIG. 6 being moved to rear side.

Figure 9:
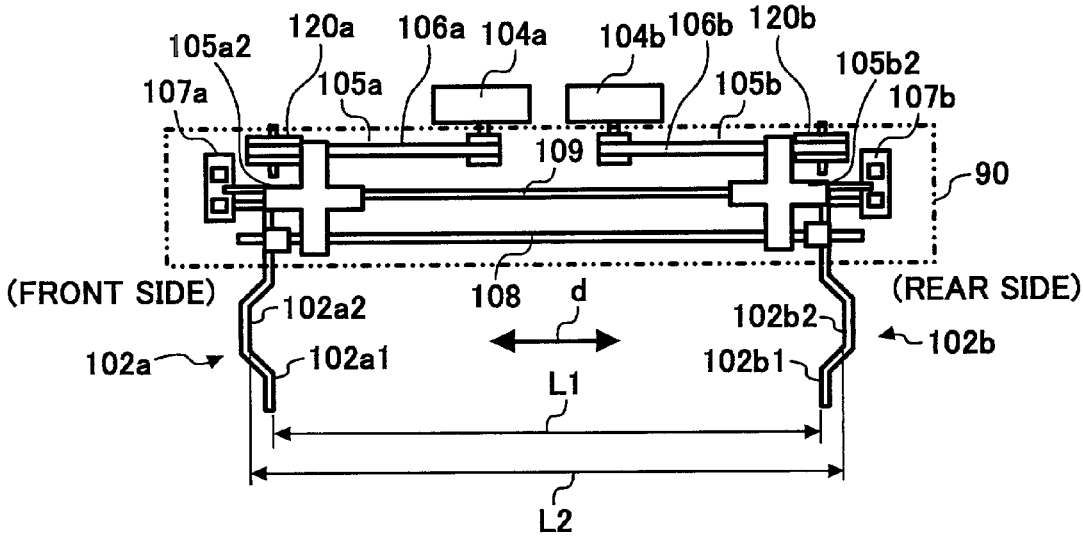
FIG. 9 is a schematic front view of the arranging member and the arranging member shift means when they are seen from the paper-discharging roller side.

In FIG. 9, when cutout 43L, which is a long one, of encoder 47 being rotated especially in direction of arrow 49 from the state shown in FIG. 7, is passed through the home sensor 48 and overlapped with long convex portion, the motor 44 stops. In this state, the pin 42 is in front side, and the tray 12 is also moved to front side with the end fence 131 of FIG. 6 being moved to front side.

In this manner, whether the tray 12 is in rear side or front side can be identified by sensing the cutout length of encoder 47 by the home sensor 48 and by using the sensed information.

Also, discharge of papers constituting a bundle under the some job is received by means of going-stroke of reciprocation of the tray 12, among the strokes of reciprocation of tray 12 in the shift direction d, while discharge of papers constituting another bundle under the next job is received by means of coming-stroke of the tray 12.

By repeating this sorting operation, a bundle of papers for each job is piled in a condition that each bundle is concavo-convexly offset one another by certain amount, so that every bundle for each job (bundle) can be sorted. Displacement amount d can be determined as a proper value, 5–25 mm which is enough to clarify the sorting amount in regard to the size of paper, for example, 20 mm for A4 size.

<Arranging Means>

(1) Whole Configuration

Upper end portions of the arranging members 102*a*, 102*b* shown in FIG. 3, FIG. 4 and FIG. 6 are supported within a frame 90 shown in FIG. 3. In this frame 90, moving means, evacuating means and driving means of the arranging member to be described below are provided as means for performing arranging operation of the arranging members 102*a*, 102*b* and other operations following the arranging operation.

The control means for operating the arranging members 102*a*, 102*b* uses in common the control means of the sheet-shaped medium after-treatment apparatus 51 shown in FIG. 3, and is connected to the frame 90 through input/output line not shown. The arranging members 102*a*, 102*b* performs the arranging operation of papers and other operations following the arranging operation.

Mechanical constituents for driving the ranging members 102*a*, 102*b* is integrally configured as an arranging unit within the box-like frame 90. In FIG. 3, the frame 90 is screwed down, or provided separably and attachably by means of convexo-concave engaging-disengaging means, to the main body of the sheet-shaped medium treatment apparatus 51, so that a user not requiring the arranging function by means of the arranging members 102*a*, 102*b* can be readily satisfied.

(2) Arranging Member

As shown in FIG. 4(A) and FIGS. 9 to 12, a pair of arranging members 102*a*, 102*b* are formed of panel-shaped bodies and arranging portions 102*a*1, 102*b*1 are located at the lowest of the arranging members 102*a*, 102*b*, so that mutually facing surfaces thereof are flat planes perpendicular to the shift direction d.

In this manner, since the mutually facing surfaces of arranging portions 102*a*1, 102*b*1 are formed of flat surfaces perpendicular to the shift direction d, it is possible that a bundle of papers are arranged through reliable contact and separation between arranging portions 102*a*1, 102*b*1 and ends of papers S piled on the tray 12 by means of movement of the arranging members 102, 103 in the shift direction d. Furthermore, by employing panel-shaped bodies, compact structure can be obtained.

In FIG. 9, in order to easily introduce papers S discharged from the discharging roller 3 shown in FIG. 3 and FIG. 4 into the gap between the arranging members 102*a*, 102*b*, the arranging members 102*a*, 102*b* are configured such that upper part of each arranging portion constitutes relief portions 102*a*2, 102*b*2 having a gap L2 wider than the opposite gap L1 between the arranging portions 102*a*1, 102*b*1.

Figure 10:
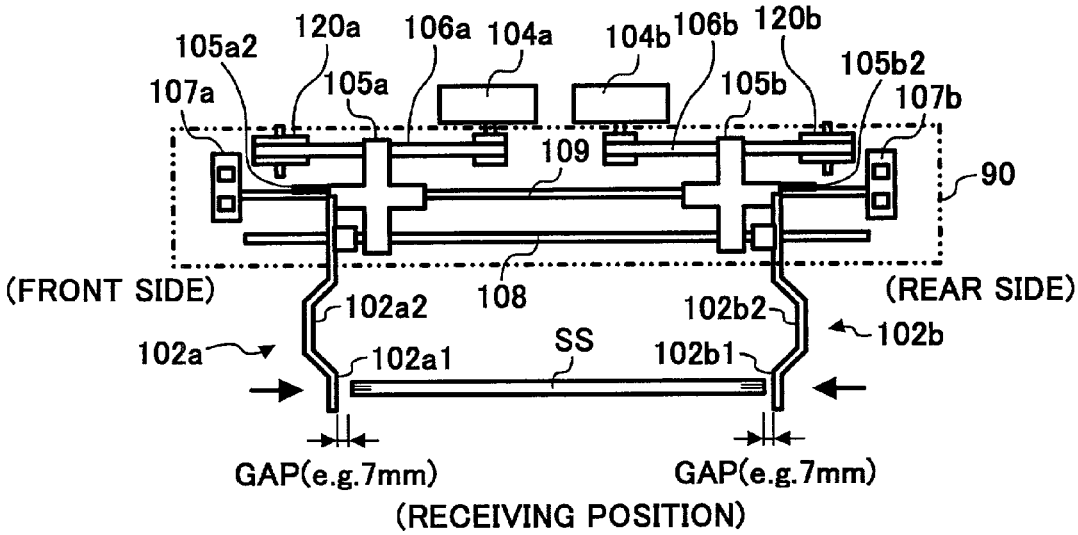
FIG. 10 is a schematic front view of the arranging member and the arranging member shift means when they are seen from the paper-discharging roller side.

Around the time of arranging operation, when paper S is discharged onto the tray 12, the arranging members 102*a*, 102*b* are moved to a insertion position where the arranging portions 102*a*1, 102*b*1 can wait for paper S to be inserted from the discharging roller 3, with the distance between the arranging portions wider than the width of said paper, and in the insertion position, wait for discharge of paper S from the discharging roller 3. In FIG. 10, the insertion position is, for example, a position in which one side is wider by 7 mm than width of a paper bundle SS of A4 size.

Figure 11:
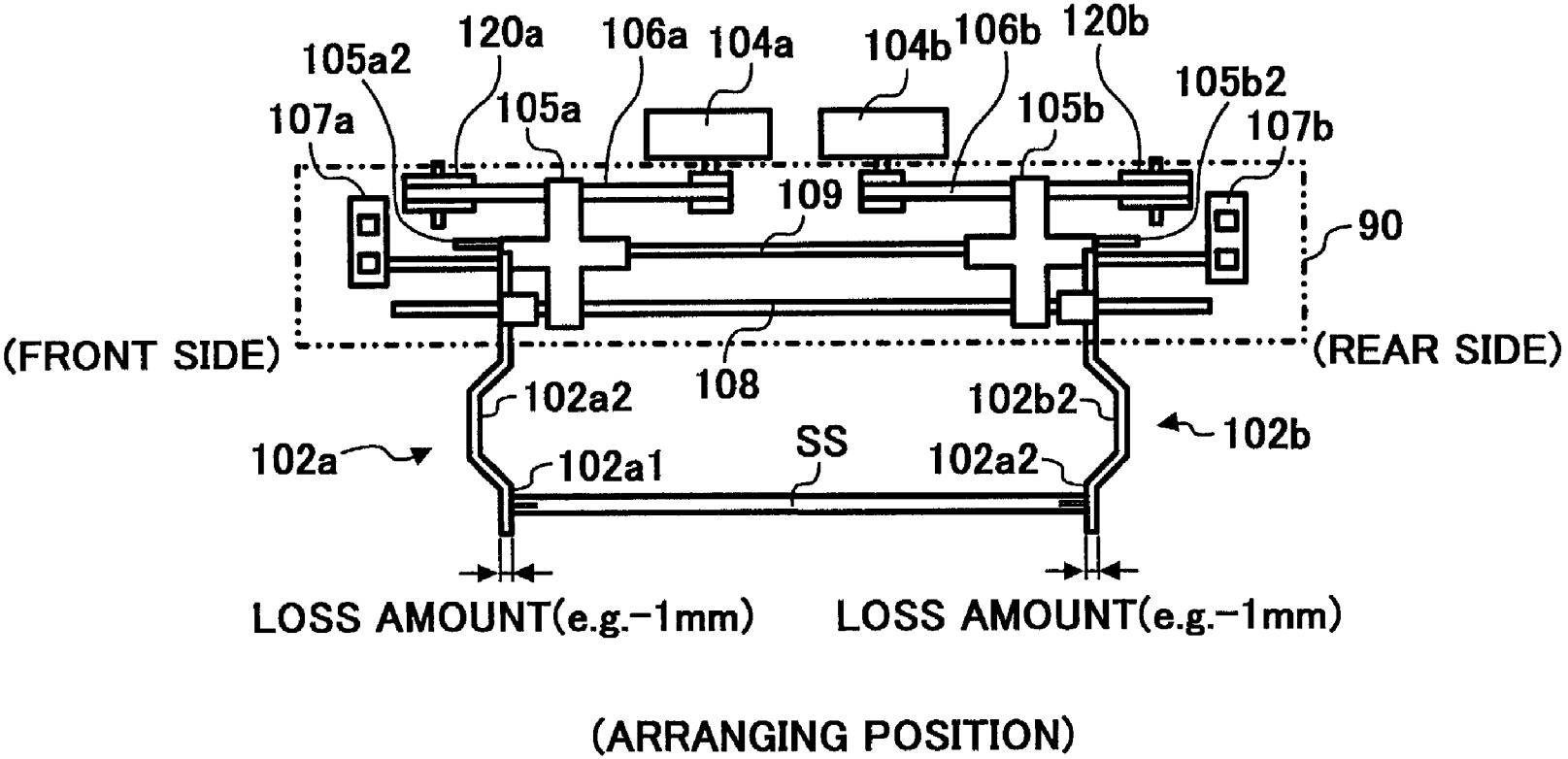
FIG. 11 is a schematic front view of the arranging member and the arranging member shift means when they are seen from the paper-discharging roller side.

The arranging members 102*a*, 102*b* stay at receiving positions where papers, to be discharged, slightly displaced in the shift direction d can be received with minimum clearance and then, if papers are discharged and piled on the tray 12, the arranging members are moved from the receiving positions to positions narrower than paper width shown in FIG. 11 to arrange the papers. The reason why the receiving positions are set like above is that it takes more time to return to home position at every arranging operation if the clearance is bigger. Of course, it is possible to move the arranging members from the home position to the arranging position each time.

After papers S are discharged from the discharging roller 3 and get in contact with the end fence 131 by means of the return roller 121 to carry out the longitudinal arrangement, (1) by approaching the arranging members 102*a*, 102*b* each other, as indicated by arrows in FIG. 10, or (2) by moving one arranging member of the arranging members 102*a*, 102*b* in the direction of arrow in FIG. 10, with the other prevented from moving, consequently, as shown in FIG. 11, the arranging portions 102*a*1, 102*b*1 are in contact with two ends of the paper bundle SS in parallel with the discharge direction (direction of penetrating the drawing plane), at a position where the gap between the arranging positions is slightly narrower than the paper width.

Said narrowed amount is, for example, in a status in which the arranging portions 102*a*1, 102*b*1 are in contact with ends of the paper bundle SS so that one side of paper is encroached by 1 mm, and ends of the paper bundle SS are arranged by the encroached amount. Thereafter, the arranging members 102*a*, 102*b* is returned to the receiving positions described in FIG. 10 and wait for discharging and piling next paper S.

Furthermore, when carrying out the arranging operation such as said (1), it is referred to as double movement mode that the arranging members 102*a*, 102*b* are approached each other to carry out arrangement.

Also, in operation as said (2), it is referred to as single movement mode that one arranging member 102*a* or 102*b* is moved in the arrow direction to carry out arrangement with the other arranging member stopped.

These movement modes will be explained in more detail in the following "arranging operation".

During the same job, until all the papers constituting the same job are discharged, the arranging members 102*a*, 102*b* are moved between the receiving positions shown in FIG. 10 and the arranging positions shown in FIG. 11, at a moving end of the tray 12.

When the arranging members 102*a*, 102*b* stay at the receiving positions shown in FIG. 10, each position, in the shift direction d, of papers S discharged from the discharging roller 3 is not always the same, and there may occur deviation due to skew, etc. Thus, if the receiving positions determined by a distance between the arranging portions 102*a*1, 102*b*1 is wide, it is easier to receive papers, but if it becomes too wide, displacement amount of tile arranging members 102*a*, 102*b* under arranging operation are so big that it is not applicable to models for rapid discharge.

Thus, it is preferable that the opposite gap between the arranging portions 102*a*1, 102*b*1 is as narrow as possible, that is, the receiving positions of arranging members 102*a*, 102*b* are as small as possible, and the opposite gap between upper portions of the arranging portions 102*a*1, 102*b*1 is wide.

In shift mode, in either of single movement mode or double movement mode, when a part of papers under current job, shifted by a predetermined shift amount, are piled on a part of papers already arranged for the previous job and the arranging operation is carried out, if the shift amount is about 20 mm in A4 size, the arranging member, of the arranging members 102*a*, 102*b*, located downstream in the shift direction just before current job faces and is in contact with the top surface of the paper bundle for the previous job.

In single movement mode, arrangement can be cried out by means of fixing the arranging member in contact with top surface of the paper bundle for the previous job and moving the other arranging member. However, in double movement mode, since both arrainging members 102*a*, 102*b* are moved, arrangement is carried out with both arranging members in contact with top surface of papers.

Also, in either of single movement mode or double movement mode, if the arranging members are being returned to the receiving position shown in FIG. 10 after completion of previous job, the paper bundle for the previous job already arranged may be caught and disarranged by the arranging members 102*a*, 102*b* during shift of the tray 12 for the next job, and thus, in order to avoid above disarrangement, evacuating operation from top surface of papers is employed to the respective arranging members 102*a*, 102*b* after completion of one job.

The evacuating operation may be cared out by moving the arranging members 102*a*, 102*b* themselves, by lowering the tray 12 and the like, and concrete examples will be described in "Evacuating operation". In a method, among methods of moving the arranging members, that the arranging members 102*a*, 102*b* is pivoted on 1 point and evacuated, lower ends of the arranging members 102*a*, 102*b* may be in contact with top surface of papers in the evacuating operation so that papers can be disordered.

Like this, in double movement mode, the arranging members may brush against top surface of papers in the arranging operation, and in both single movement mode and double movement mode, the arranging members may brush against top surface of papers in the evacuating operation. Although strength of such brushing is not constant because such brushing states are different, it is certain that lower ends of the arranging members 102*a*, 102*b* brush against top surface of papers S and disorder of papers is possible.

Thus, by selecting material quality of the arranging members such that the frictional coefficient of lower ends of the arranging members 102*a*, 102*b* in contact with papers S is smaller than mutual frictional coefficient between papers and by processing their surfaces with small surface roughness, a arranged part (paper bundle) might not be disordered due to contact with the arranging members in arranging or evacuating.

(3) Moving Means of Arranging Member

It has been described above that the arranging members 102*a*, 102*b* are moved in the shift direction d between the receiving position shown in FIG. 10 and the arranging position shown in FIG. 11. In addition, the arranging members 102*a*, 102*b* are constructed to move from the receiving position shown in FIG. 10 to the home position in a direction to be separated from each other. In order to make movement in the shift direction d possible, moving means for the arranging members 102*a*, 102*b* is provided. The moving means of the arranging members will be described.

With the moving means of the arranging members in single movement mode, one of the arranging members 102*a*, 102*b* is not moved and the other is moved and its roles are exchanged every time the tray 12 is shifted. In double movement mode, both of the arranging members 102*a*, 102*b* may be approached and separated by equal quantity every time the tray 12 is shifted. Thus, in double movement mode, gear mechanism in which one and the other of the arranging members gear with each other can be employed as moving means of the arranging members. However, the gear mechanism cannot be employed in single movement mode. In the gear mechanism, since one and the other driving source of the respective arranging members are used in common, general structure can be simplified, but here, as moving means suitable for single movement mode, moving means capable of moving independently the respective arranging members 102*a*, 102*b* in a contact-separate direction will be described.

The moving means capable of moving independently in the contact-separate direction, relating to below description, can be adapted for movement of the arranging members in double movement mode.

Figure 12:
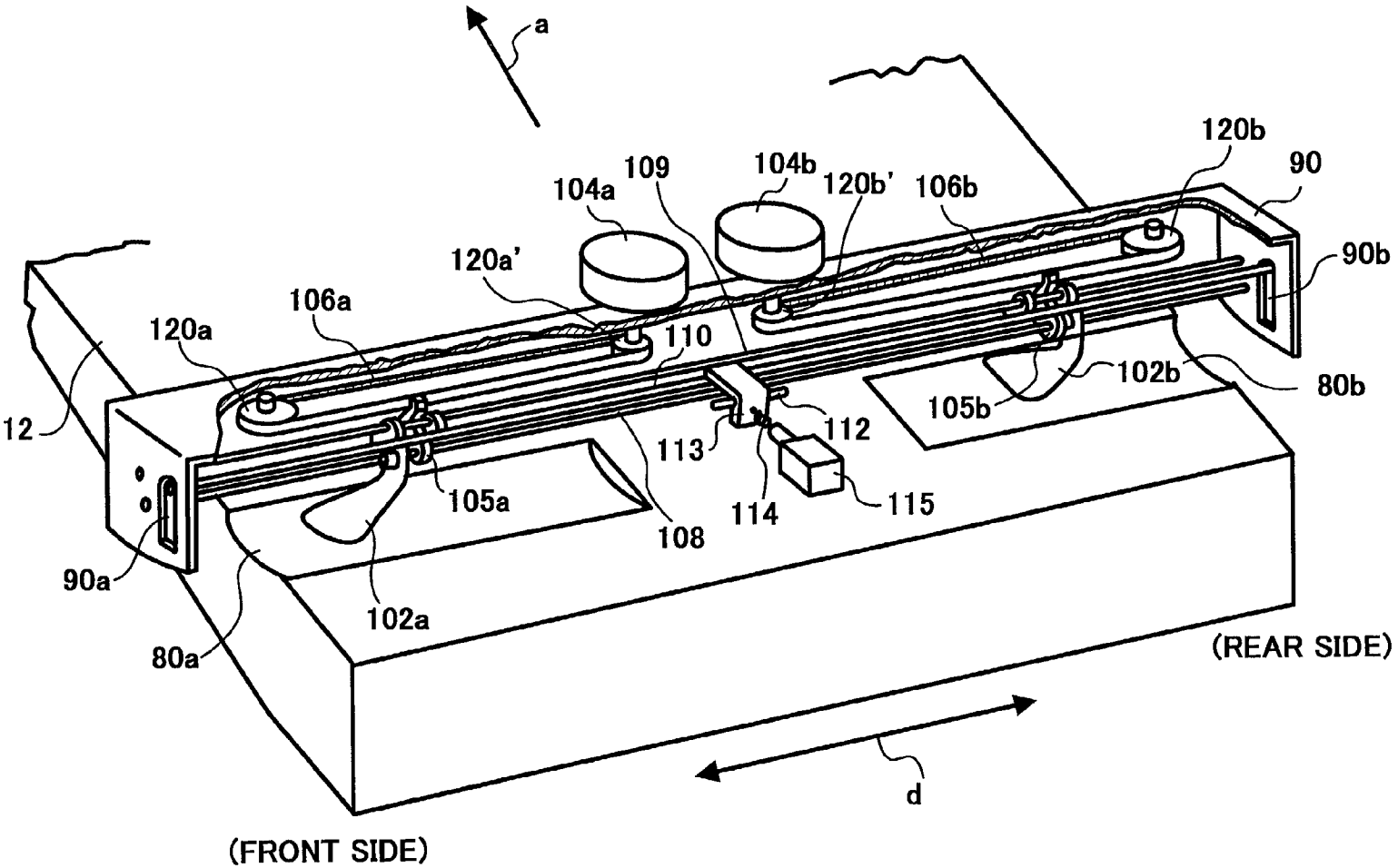
FIG. 12 is a perspective view illustrating important parts of the arranging member and the arranging member shift means.

In FIG. 12, when the tray 12 is seen from upstream toward downstream of the discharge direction a, let left side of the shift direction d be front side and right side thereof be rear side and then, the arranging member 102*a* is the front arranging member and the arranging member 102*b* is the rear arranging member.

First, moving means of the front arranging member 102*a* will be described.

In FIG. 12, the arranging member 102*a* is pivotally and slidably fixed on a cylinder-shaped shaft 108 parallel to the shift direction d. Both ends of the shaft 108 are fixed to the frame 90.

Figure 13:
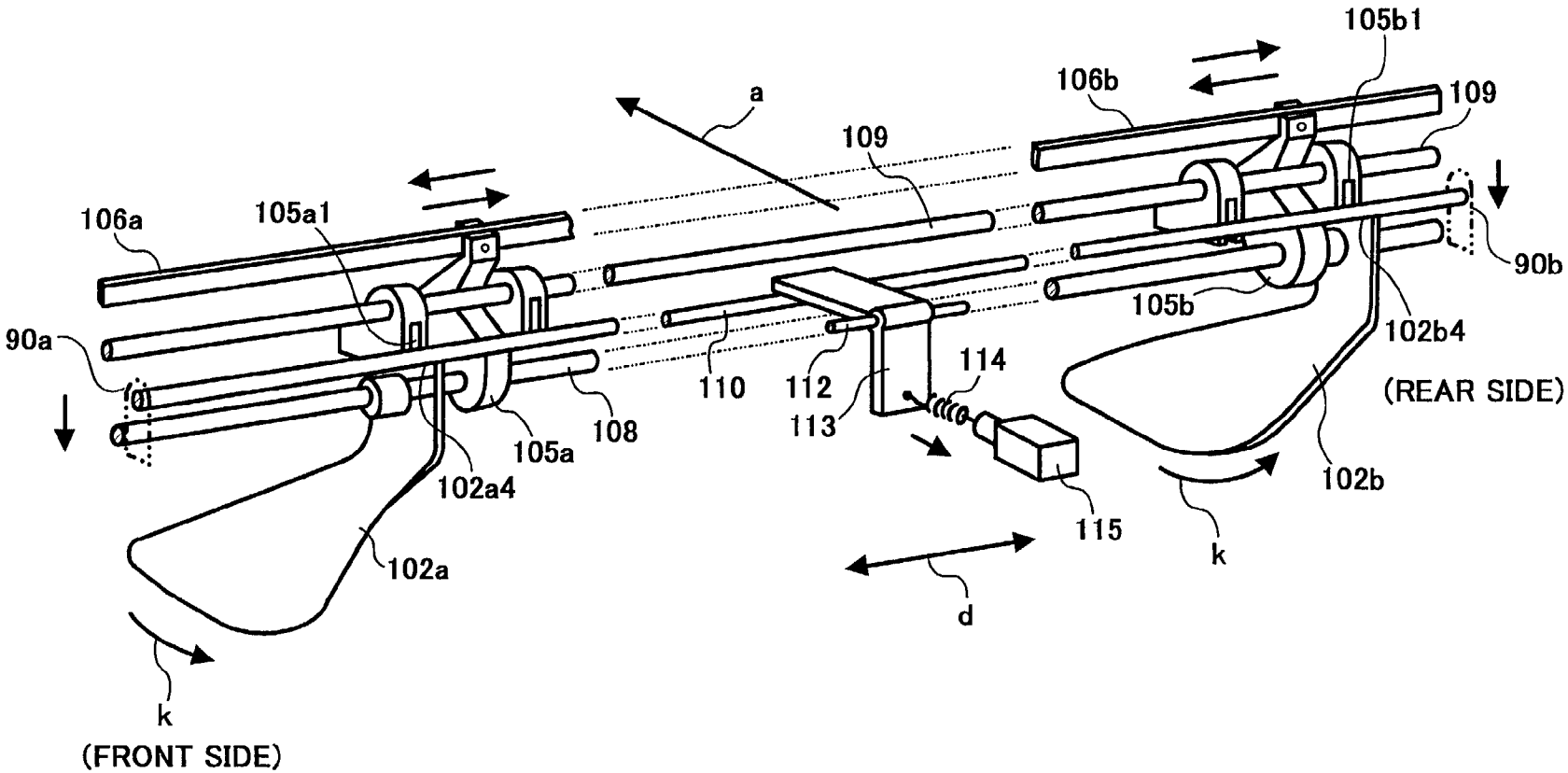
FIG. 13 is a perspective view illustrating important parts of a driving mechanism of arranging member.
Figure 14:
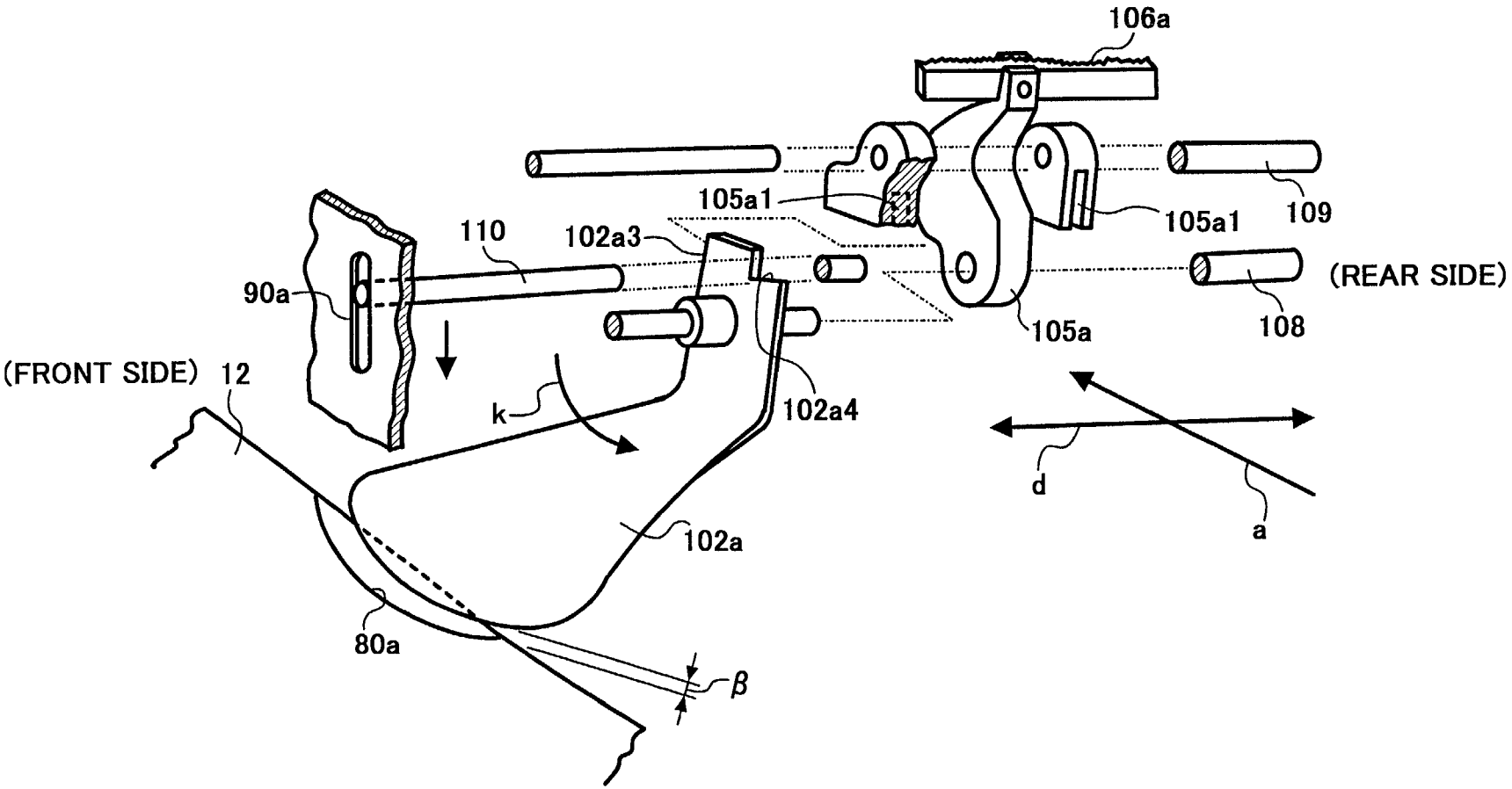
FIG. 14 is a perspective view illustrating important parts of a driving mechanism of arranging member.

As shown in FIG. 13 and FIG. 14, upper end of the arranging member 102*a* is inserted into a slit 105*a*1 parallel to a plane perpendicular to the shaft 108, the slit being formed in the reception support 105*a*. The reception support 105*a* is slidably fitted to the shaft 108 and also slidably fitted to a guide shaft 109 parallel to the shaft 108. Also, upper portion of the reception support 105*a* is fixed to a timing belt 106*a*.

The timing belt 106*a*, as shown in FIG. 12, is provided between pulleys 120*a*, 120*b*. The pulley 120*a* is axially supported on a shaft fixed to the frame 90. The pulley 120*a* is filed to a rotational shaft of a stepping motor 104*a* fixed to the frame 90.

These stepping motor 104*a*, reception support 105*a*, timing belt 106*a*, shaft 108 and guide shaft 109 are main constituents constructing the moving means of arranging member 102*a*.

Moving means of the rear arranging member 102*b* will be described.

As shown in FIG. 13 and FIG. 14, the arranging member 102*b* is pivotally and slidably fixed on the same shaft 108 as in the arranging member 102*a*. Also, the arranging member 102*b* is fitted to a slit 105*b*1 of a reception support 105*b*, just as the arranging member 102*a* engages with the reception support 105*a*.

Upper portion of the reception support 105*b* is fixed to a timing belt 106*b*. The timing belt 106*b*, as shown in FIG. 12, is provided between pulleys 120*a*, 120*b*. The pulley 120*b* is axially supported on a shaft fixed to the frame 90. The pulley 120*b* is fixed to a rotational shaft of a stepping motor 104*b* fixed to the frame 90.

These stepping motor 104*b*, reception support 105*b*, timing belt 106*b*, shaft 108 and guide shaft 109 are main constituents constructing the moving means of arranging member 102*b*.

In the present embodiment, the shaft 108 and the guide shaft 109 have functions of safely supporting the reception supports 105*a*, 105*b* and guiding and are used in common, but may be independently provided since zones used in movement of the arranging members 102*a*, 102*b* are dislocated in the front and rear sides.

Because, like this, the ranging members 102*a*, 102*b* have independent moving means, respectively, the timing belts 106*a*, 106*b* are separately rotated by separately driving the stepping motors 104*a*, 104*b* with forward rotation and reverse rotation thereof being switched, and accordingly, the reception supports 105*a*, 105*b* are moved, so that the arranging members 102*a*, 102*b* fitted to the slits 105*a*1, 105*b*1 formed in the reception supports 105*a*, 105*b* can be moved independently in the shift direction d.

By means of moving means of the arranging members 102*a*, 102*b* constructed like this, the respective arranging members 102*a*, 102*b* can be separately driven. For example, in case of carrying out the a arranging operation in single movement mode, as when the arranging member 102*a* is made not to move and the arranging member 102*b* is made to move at any job, the arranging member 102*b* is made not to move and the arranging member 102*a* is made to move at the next job after the tray 12 is shifted, roles of not-moving side and moving side of the respective arranging members 102*a*, 102*b* can be switched in turn and the arranging operation after sorting can be carried out.

Also, double movement mode in which both arranging members 102*a*, 102*b* are made to move may be employed in the arranging operation. The single movement mode has a feature that arranged state of papers is difficult to be in disorder since the arranging member located in the paper bundle on the tray 12 is not moved, compared with the double movement mode, but when the independent moving means are provided, such single movement mode may be employed.

(4) Position Control of Arranging Member

In FIG. 13 and FIG. 14, the shaft 108 is a guide for guiding the arranging member 102*a* in the shift direction d and is a supporting axis for rotatably supporting the arranging member 102*a*. Upper end of the arranging member 102*a* is inserted into the slit 105*a*1 as described above and lower end of the arranging member 102*a* extends more toward the discharge direction a than the shaft 108. For this reason, center position of the arranging member 102*a* is displaced toward the discharge direction a and moment in a direction of arrow K about the shaft 108 acts on the arranging member 102*a* by its own weight.

Figure 15:
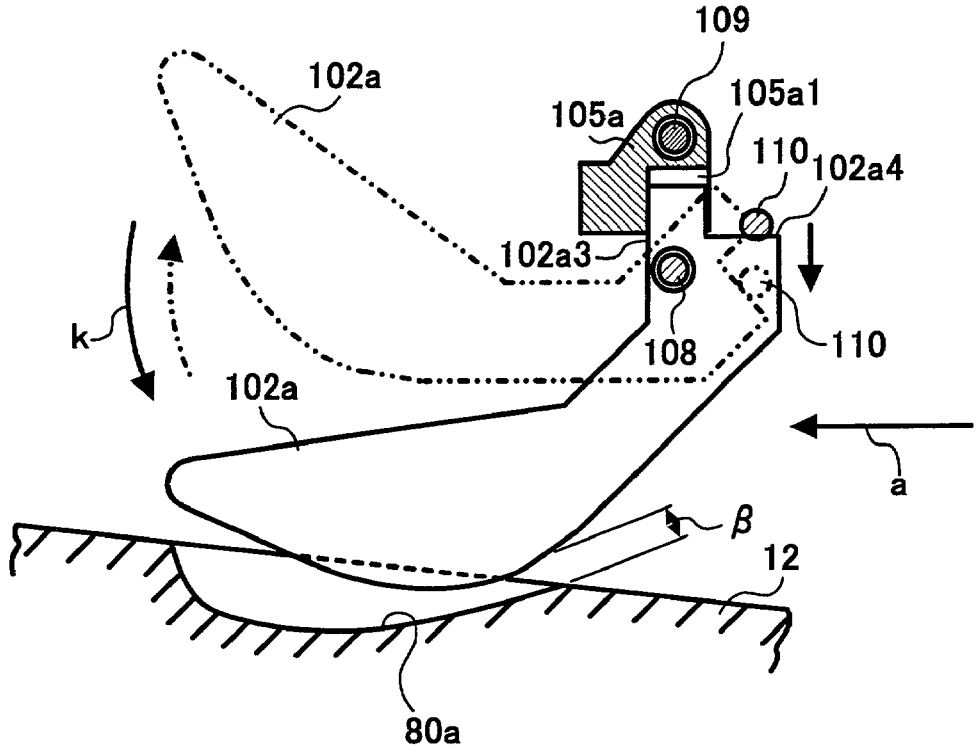
FIG. 15 is a front view illustrating an evacuating position and an arranging position of arranging member.

As shown in FIG. 14 and FIG. 15, inside of the slit 105*a*1 is closed, not opened. For this reason, rotation of the arranging member 102*a* due to moment in a direction of arrow K is blocked by means of contact of upper edge 102*a*3 of the arranging member 102*a* with inside of the slit 105*a*1, so far as interference with paper S on the tray 12 does not exist. In FIG. 15, the arranging member 102*a* in a state that its rotation is blocked is indicated by solid lines.

Since the slit 105*a*1 is formed in the reception support 105*a*, the reception support 105*a* may serve as a regulating member for regulating rotational amount of the arranging member 102*a* about the shaft 108. The same structure and operation apply to the arranging member 102*b* and the reception support 105*b*.

By means of regulating operation of rotational amount through the reception supports 105*a*, 105*b* having slits of which insides are closed, rotational driving of the arranging members 102*a*, 102*b* due to moment of its own weight is regulated and a constant position in the rotational direction is automatically supported, so that special positioning mechanism in the rotational direction is not required to be provided.

As shown in FIG. 12, FIGS. 14 to 16 and FIG. 18(B), when sheets are not piled on the recesses 80*a*, 80*b*, the arranging members 102*a*, 102*b* are established to be fitted to inside of the slits 105*a*1, 105*b*1 in a state that the respective lower ends of the arranging members 102*a*, 102*b* are placed below top surface of the tray 12, that is, within the recesses 80*a*, 80*b*.

As shown in FIG. 10, when the arranging members 102*a*, 102*b* is placed at the receiving position in the shift direction d, if the recess 80*a* is formed in a part, opposite to the arranging member 102*a*, of top surface of the tray 12 and sheets are piled to block the recess 80*a*, the arranging member 102*a* gets in contact with top surge of sheets by means of contacting force due to its own weight. Similarly, if the recess 80*b* is formed in a part, opposite to the arranging member 102*b* at the receiving position, of top face of the tray 12 and sheets are piled to block the recess 80*b*, the arranging member 102*b* gets in contact with top surface of sheets by means of contacting force due to its own weight.

The arranging members 102*a*, 102*b* tends to be rotated by means of moment due to its own weight normal times and in order to make rotation within the recesses 80*a*, 80*b* possible in a case that sheets do not exist on the tray 12, engages with inner portions of the slits 105*a*, 105*b*1 as shown in FIGS. 13 and 15. Like this, rotation in direction of arrow K is blocked but the reverse rotation is not blocked Therefore, when paper S is piled on the tray 12 to close the recesses 80*a*, 80*b*, the arranging members 102*a*, 102*b* is in contact with paper S on the tray 12 by means of its own weight.

As described above, if sheets are not on the tray 12, lower ends of the arranging members 102*a*, 102*b* are placed in the recesses 80*a*, 80*b* due to its own weight and if sheets exist, the arranging members 102*a*, 102*b* is in contact with top surface of sheets due to its own weight. In any of the two states, movement in the shift direction can accompany arrangement.

Then, this state is referred to as arranging operation position, hereinafter.

Figure 16:
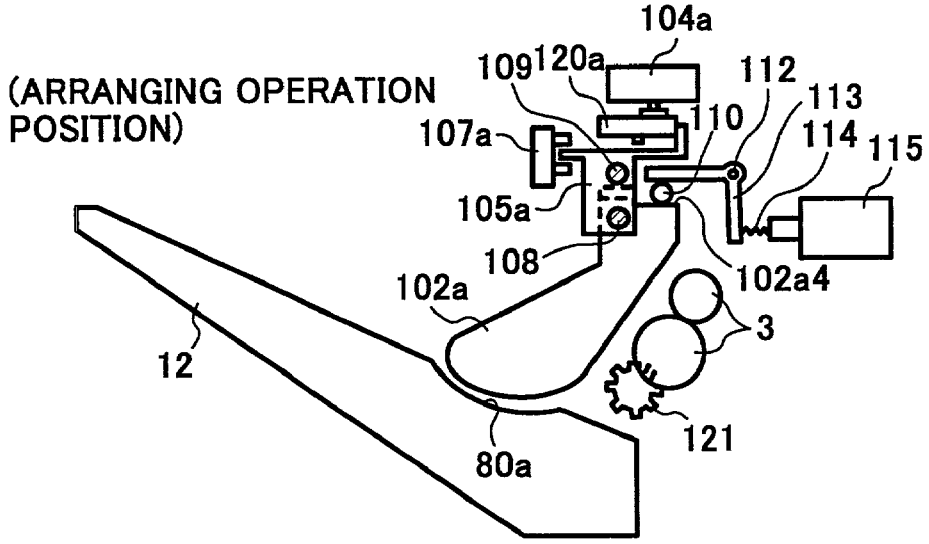
FIG. 16 is a front view illustrating the arranging position of arranging member.

In FIG. 16 illustrating a representative example, position of the arranging member 102*a* when sheets do not exist is shown as the arranging operation position. However, when sheets exist, lower end of tie arranging member 102*a* is in contact with top surface of the sheets. The arranging operation position as shown in FIG. 16 includes both states. Also, the arranging member 102*b* can take the same operation position as the arranging member 102*a*.

Like this, if sheets are not piled on the recesses 80*a*, 80*b* of the tray 12, the arranging members 102*a*, 102*b* placed at the receiving position shown in FIG. 10 are kept in a state that a part thereof is inserted into the recesses 80*a*, 80*b* and if sheets are piled on the recesses 80*a*, 80*b*, are in contact with top surface of sheets due to its own weight.

In a state that the arranging members 102*a*, 102*b* are placed at the receiving position of FIG. 10 in the shift direction d and at the arranging operation position of FIG. 16, in the rotational direction about the shaft 108, when paper S is piled on the tray 12 between the arranging members 102*a*, 102*b*, sheets piled on the tray 12 can be arranged by means of moving one or both of the arranging members 102*a*, 102*b* to carry out the arranging operation.

Through properly establishing central position of the arranging members 102*a*, 102*b*, pressure thereof onto paper S can be controlled small and in sorting and arranging operation, sheets arranged already cannot be dislocated.

In FIGS. 9 to 11, the reception supports 105*a*, 105*b* are provided with shielding plates 105*a*2, 105*b*2, respectively. When the stepping motors 104*a*, 104*b* are driven to move the reception supports 105*a*, 105*b* away from each other, the shielding plate 105*a*2 of the reception support 105*a* is inserted into the home position sensor 107*a* to shield light and the shielding plate 105*b*2 of the reception support 105*b* is inserted into the home position sensor 107*b* to shield light. These shielding states are detected by the home position sensors 107*a*, 107*b* and on the basis of the detected signal, the stepping motors 104*a*, 104*b* are controlled to stop.

The home positions of the arranging members 102*a*, 102*b* is a state that the respective home position sensor 107*a*, 107*b* detect the shielding plate 105*a*2, 105*b*2 and the home position is a position where the arranging members 102*a*, 102*b* are opened wider than the greatest width of various sized sheets to be sorted and arranged.

Before entering into the sorting and arranging operation, the arranging members 102*a*, 102*b* stand by at the home position. In FIG. 9, the arranging members 102*a*, 102*b* is positioned at the home position.

As shown in FIG. 10 along surface of paper S to be discharged from the discharging roller 3, if the stepping motors 104*a*, 104*b* are rotated from each home position in the arrow direction shown in FIG. 10 by amount corresponding to predetermined pulse, the arranging members 102*a*, 102*b* stand by at the receiving position and after sheets are dropped onto the tray 12, stopped completely and stuck, are moved to the arranging position shown in FIG. 11 to carry out arranging operation. At that time, paper bundle SS piled on the tray 12 is arranged and the arranging members are moved again to the receiving position shown in FIG. 10 and stand by in order to enter receiving state for next sheets.

Such operations are repeated and at a time a series of jobs relating to the arranging operation are completed, the arranging members 102*a*, 102*b* are moved again to the home position shown in FIG. 9.

By means of the moving means such as stepping motors 104*a*, 104*b*, reception supports 105*a*, 105*b* including shielding plates 105*a*2, 105*b*2, timing belts 106*a*, 106*b*, shaft 108 and guide shaft 109 or control means such as home position sensors 107*a*, 107*b*, the arranging portions 102*a*1, 102*b*1 of the arranging members 102*a*, 102*b* can be placed at least at two positions of the receiving position shown in FIG. 10 and the arranging position shown in FIG. 11. Like this, by establishing the receiving position, movement amount of the arranging members 102*a*, 102*b* in arranging can be set smaller than movement amount from the home position to receive and arrange sheets.

(5) Evacuating Means of Arranging Member

In FIGS. 13 to 17, the arranging member 102*a* is pivotally fixed on the shaft 108 as described above and L-shaped cutout is formed at upstream part from the pivot point in the discharge direction a. In this cutout, when the arranging member 102*a* is placed at the arranging operation position shown in FIG. 16, surface which is along almost horizontal direction is referred to as press-movement surface and indicated by 102*a*4. Similarly, press-movement surface 102*b*4 is formed at the arranging member 102*b*.

A shaft 110 parallel to the shaft 108 is in contact with such press-movement surfaces 102*a*4, 102*b*4 due to their own weight. Both ends of the shaft 110 in the longitudinal direction are vertically-movably inserted into vertically-long holes 90*a*, 90*b* (See FIG. 13) formed in side plate of the frame 90.

As shown in FIG. 12, FIG. 13 and FIG. 16, one end of L-shaped lever 113 pivotally fired to tho frame 90 via the shaft 112 is placed at central part of the shaft 110. The other end of the lever 113 is connected to plunger of solenoid 115 via a spring 114. The solenoid 115 is provided in the frame 90.

When the solenoid 115 is turned off (not-excited), as shown in FIG. 14 and FIG. 15, upper edge part 102*a*3 of the arranging members 102*a*, 102*b* is in contact with inner portion of the slit 106*a*1 or lower ends of the arranging members 102*a*, 102*b* are in contact with paper on the tray 12. By this, the arranging members 102*a*, 102*b* is placed at the arranging operation position shown in FIG. 16, where the upper edge 102*a*3 is slightly separated from the inner portion of the slit 105*a*1.

At the arranging operation position, the arranging members 102*a*, 102*b* are in contact with inner part of the recesses 80*a*, 80*b* on the tray 12, or top surface of sheets piled on the tray 12.

Figure 17:
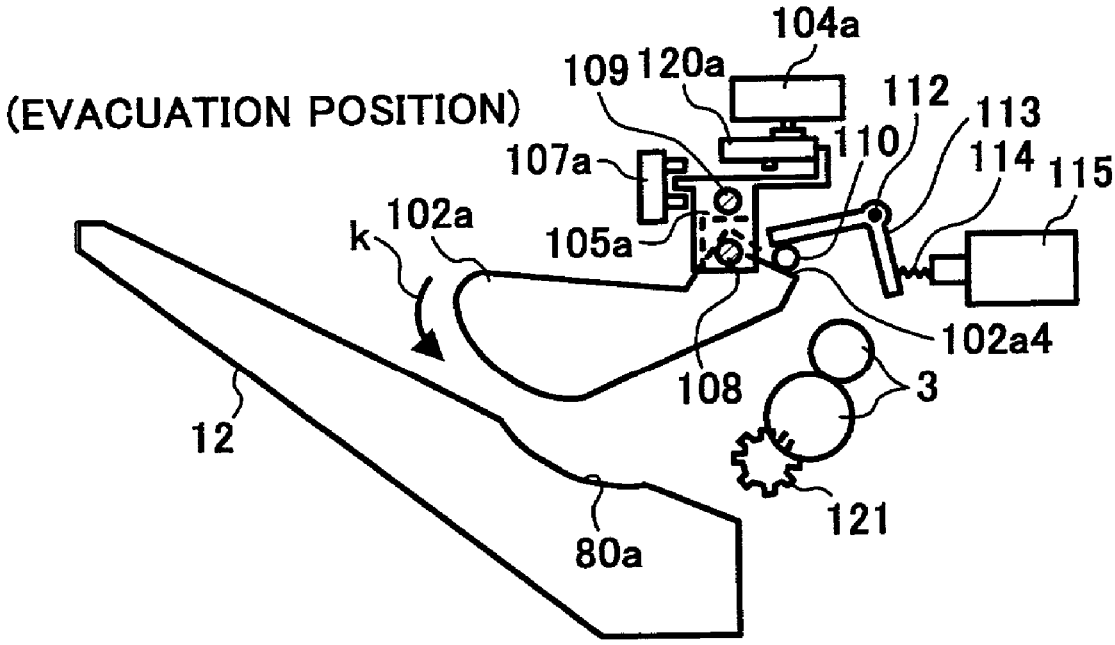
FIG. 17 is a front view illustrating the evacuating position of arranging member.

As shown in FIG. 17, if the solenoid 115 is turned on (excited), plunger of the solenoid 115 is pulled and tile lever 113 is rotated. By this, as shown in FIG. 13 and FIG. 14, the shaft 110 is guided into the long holes 90*a*, 90*b* provided in the frame 90 and pressed down by the lever 113.

As shown in FIGS. 13 to 17, since the shaft 110 engages with the press-movement surfacer, 102*a*4, 102*b*4 of cutouts formed in the arranging members 102*a*, 102*b*, as shown in FIG. 17, the shaft 110 is pressed down and, thereby, the ranging members 102*a*, 102*b* are rotated in a direction opposite to the arrow K and moved to a position above the tray 12 separated greatly from inner part of the recesses 80*a*, 80*b* or from top surface of sheets piled on the tray 12.

Like this, position of the arranging members 102*a*, 102*b* when being moved above the tray 12 is indicated by two-dotted chained-line in FIG. 15 and by a solid line in FIG. 17, and the position is referred to as the evacuating position. The shaft 110, the lever 113, the solenoid 115 and the like constitutes the evacuating means for evacuating the arranging members 102*a*, 102*b*.

(6) Driving Unit of Arranging Member

In FIG. 13, FIG. 14, FIG. 16 and FIG. 17, constituents supporting the arranging members 102*a*, 102*b* includes the shaft 108 as a supporting point on which the arranging members 102*a*, 102*b* are pivotally fixed, the shaft 110 as a press-movement shaft for rotating the arranging members 102*a*, 102*b* about the shaft 108 and getting in contact with the press-movement surface 102*a*4, 102*b*4 as each point of operation on the arranging members deviated from the shaft 108, and a rotation blocking member consisting of the reception supports 105*a*, 105*b* including the respective inner parts of the slits 105*a*1, 105*b*1, capable of blocking rotation abut the shaft 108 by means of moment due to self-weight of the arranging members 102*a*, 102*b*.

The shaft 108 also serves as a guide shaft for guiding the arranging members 102*a*, 102*b* in the shift direction d, and the reception supports 105*a*, 105*b* also serves as driving means for moving the arranging members 102*a*, 102*b* in the shift direction d. Also, a pair of arranging members for sandwiching ends parallel to the paper-discharge direction a to be in contact with and be separated from the ends and being moved in the arranging direction to arranging the positions of ends, is provided.

Like this, the arranging members 102*a*, 102*b* can get in contact with top surface of paper S by means of weight corresponding to moment due to self-weight, and by control the weight, contact pressure on the paper S can be freely controlled. When paper S does not exist, as shown by a solid line in FIG. 15, the arranging members 102*a*, 102*b* can be placed within the recesses 80*a*, 80*b* of the tray 12 while upper portion of the arranging member 102*a* engages with inner part of the slit 105*a*1, and sure contact of the arranging portion 102*a*1, 102*b*1 with ends of paper S is made possible. Also, by means of providing the switching driving means consisting mainly of lever 113 and solenoid 115, in which a press-moved state that the shaft 110 as a press-movement shaft and the press-movement surface 102*b*4 as a point of act are pressed and a released state can be freely switched, the arranging members 102*a*, 102*b* can be switched to an evacuated state from top surface of paper S and an contact state by means of rotational moment due to self-weight.

(7) Relationship Between the Arranging Members and Tray

It is intended that the position of tray 12 in the ascent and descent direction shall be controlled by the positioning means 96 explained in reference to FIG. 4, so that the top surface of tray 12 or the uppermost surface of papers piled on the top surface of tray 12 will be located in a proper discharging position where it is appropriate to the papers S discharged from the discharging roller 3, and the position for arranging operation described with reference to FIG. 16 is set to the proper discharging position.

The arranging members 102*a*, 102*b* are adapted to satisfactorily exhibit the arranging function when they move in the shift direction d and execute the arranging operation, and the interference between arranging members 102*a*, 102*b*, and it is intended that the papers on the tray 12 shall be avoided at the time such as when the try 12 is shifted for sorting.

When the arranging members 102*a*, 102*b* are in the position for arranging operation illustrated in FIG. 16, the lower ends of arranging members 102*a*, 102*b* are partially received in the recesses 80*a*, 80*b* provided on the tray 12, and the arranging members 102*a*, 102*b* do not interfere with the tray 12 by thing a space β within the recesses 80*a*, 80*b*, as shown in FIGS. 14 and 15. At this time, the tray 12 is located in the proper discharging position by the positioning means 96 for positioning the tray in the ascent and descent direction as illustrated in FIG. 4.

By forming the recesses 80*a*, 80*b* so that the lower ends of arranging members 102*a*, 102*b* are positioned within the recesses 80*a*, 80*b*, i.e., below the top surface of tray 12, the lower ends of arranging members 102*a*, 102*b*, in more detail, the arranging parts 102*a*1, 102*b*1 positioned inside of the lower ends of arranging members 102*a*, 102*b* take a form surely intersected with the ends of papers S through the recesses 80*a*, 80*b*, whereby the arranging parts 102*a*1, 102*b*1 can surely abut against the end of lowermost paper S and arrange the papers.

(8) Avoidance of Interference Between the Arranging Members and Papers

If the tray 12 moves in the shift direction d after the discharging and subsequent arranging of papers of job are terminated and in the state that the arranging members 102*a*, 102*b* are maintained in the receiving position shown in FIG. 10, a bundle of barely arranged papers SS are tripped against the lower ends of arranging members 102*a*, 102*b* and the array falls into disorder as the tray 12 is shifted. Therefore, in order to avoid this, it is intended that the papers on the tray 12 and arranging members 102*a*, 102*b* shall be spaced and evacuated in advance by evacuating means.

Also, when the sorting and arranging of predetermined number papers are terminated and then next predetermined number of papers are to be sorted and arranged, it is needed to move the arranging members 102*a*, 103*a* to a position more remotely spaced than the receiving position by way of precaution against cage of width of papers and the like. For this purpose, in order to prevent the arranging members 102*a*, 102*b* from interfering the already arranged papers on the tray 12, the papers on the tray 12 and arranging members 102*a*, 102*b* are spaced and evacuated in advance before the arranging members 102*a*, 102*b* are moved to a position (home position) more opened than the receiving position, or an optional position narrower than this home position.

There are three ways in such an evacuation mode: a method for swiveling the arranging members 102*a*, 102*b*, a method for lowering the tray 12, and a method for lowering the tray 12 simultaneously with swiveling the arranging members 102*a*, 102*b*. In addition, when determining the amount of evacuation, it is preferable to specifically determine the amount of evacuation in a practical apparatus considering the relationship between the degree of curling of paper and amount of shift of tray.

<Evacuation of Arranging Members>

In FIGS. 13 to 17, the shaft 110, lever 113, solenoid 115 and etc. form the evacuating means for placing the arranging members 102*a*, 102*b* in the evacuated position.

By means of the evacuating means, the solenoid 115 is turned to ON, each time a job is terminated, i.e., each time before the tray 12 is sifted, and the arranging members 102*a*, 102*b* are placed in the evacuated position as shown in FIG. 17. Alternatively, the arranging members 102*a*, 102*b* are placed in the evacuated position as shown in FIG. 17 as needed, when the sorting and arranging of predetermined number of papers are terminated.

In the evacuated position as shown in FIG. 15, the lower end parts of arranging members in FIG. 16 (the parts which were overlapped with the tray 12) are pushed up and a gap is produced between the lower end parts and tray 12. Because the tray 12 moves in the shift direction d for sorting when the gap was produced, it is possible to avoid the contact between the uppermost surface of papers and arranging members 102*a*, 102*b*.

The arranging members 102*a*, 102*b*, which are placed in the evacuated position shown in FIG. 17 by the evacuating means, can be returned to the position for arranging operation shown in FIG. 10 due to a moment created by their own weights merely by turning the solenoid 115 to OFF.

However, the timing for returning from the evacuated position to the position for arranging operation is determined to be later than the time when the arranging members 102*a*, 102*b* move to the receiving position shown in FIG. 10.

If the arranging operation is one-side moving mode, when the arranging members 102*a*, 102*b* have been returned to the position for arranging operation, one of the arranging members 102*a*, 102*b* is placed on the top of a bundle of papers of and the other is placed outside of the end of the bundle of papers of previous job, in which in the next job to be performed after shift of tray 12, the arranging member placed on the top of the bundle of papers does not move and the arranging member placed outside of the end of the bundle of papers of previous job repeatedly contacts with and separates from the end of the bundle of papers, thereby performing the arranging operation.

If the arranging operation is both-side moving mode, it is same with the one-side moving mode in that when the arranging members 102*a*, 102*b* have been returned to the position for arranging operation, one of the arranging members 102*a*, 102*b* is placed on the top of a bundle of papers of previous job and the other is placed outside of the end of the bundle of papers of previous job, but in the next job to be performed after shift of tray 12, both of the arranging member placed on the top of the bundle of papers and the arranging member placed outside of the end of the bundle of papers of previous job repeatedly contact with and separates from the end of the bundle of papers, thereby performing the arranging operation.

Both of one-side moving mode and both-side moving mode occasionally remove papers from the tray 12 after the arranging members 102*a*, 102*b* completed the arranging operation for a series of papers. Also in this case, if the arranging members 102*a*, 102*b* are placed on the evacuated position shown in FIG. 17 from the position for arranging operation shown in FIG. 16, it becomes easy to remove the bundle of papers, of which the sorting and arranging on the tray 12 are terminated.

<Evacuation by Lowering the Tray>

It is possible to avoid the interference between the papers on the tray 12 and arranging members 102*a*, 102*b* in the shift of tray 12 by lowering the tray 12 from the proper discharging position by means of ascent and descent means 95 shown in FIG. 4(A).

The lowered state of tray 12 due to this reason is continued until and after the tray 12 is shifted by a predetermined amount of shift required for sorting, or until and after the size of papers to undergo the arranging operation from now is determined and then the arranging members 102, 103 are moved to the receiving position suited to the size, thereafter the tray 12 being lifted to the proper discharging position. Thereby, the arranging operation can be executed while the papers are discharged onto the tray in a desired form.

<Combination of said Evacuation of Arranging Members and Lowering Evacuation of Tray>

This is the evacuation that combines the evacuation in which the arranging members 102*a*, 102*b* is operated by turning the solenoid switch 115 to ON and the evacuation in which the tray 12 is lowered by driving the ascent and descent means 95. This evacuation is performed to secure a desired amount of evacuation when an especially large amount of evacuation is needed and an amount of evacuation obtained solely by turning the solenoid 115 to ON or solely by driving the ascent and descent means 95 is not sufficient. Also, the arranging members 102*a*, 102*b* and tray 12 are moved to be spaced each other, whereby a desired amount of evacuation can be secured in short time.

Such a case that the curl of paper is large is considered as the case that requires the especially large amount of evacuation. When the arranging members 102*a*, 102*b* and tray 12 are relatively moved in the shift direction d, a conventional amount of evacuation cannot cover such a case that a paper S is curled and the amount of curl is large.

For example, there is a case that the paper S is curled in the central recess in relation to the shift direction d and the like. In this case, the tray 12 is lowered and the arranging members 102*a*, 102*b* are evacuated as needed, whereby it is possible to obtain an amount of evacuation which allows to prevent the interference with the uppermost surface of papers.

(9) Arranging Operation

As arranging operation, there are two modes: (1) single movement mode where any one of the arranging member 102*a* and the arranging member 102*b* is not moved, while the other arranging member is moved toward the one arranging member, thereby to carry out arrangement, and (2) double movement mode where the arranging members 102*a*, 102*b* are moved toward each other to carry out arrangement.

In single movement mode, since the not-moved side arranging member gets in contact with top surface of sheets already arranged for previous job, there is an advantage that disorder of paper occurs less in the arranging operation, but since the arranging members should be driven separately, operating mechanism becomes complex.

In double movement mode, since a pair of arranging members get in contact with paper arranged already for previous job in turn, it is required that frictional coefficient between the arranging members and paper should be smaller than that between papers, but since gear mechanism gearing the arranging means can be employed, the driving mechanism can be simplified.

The respective arranging operations in single movement mode and in double movement mode will be described.

(Single Movement Mode)

Figure 18A:
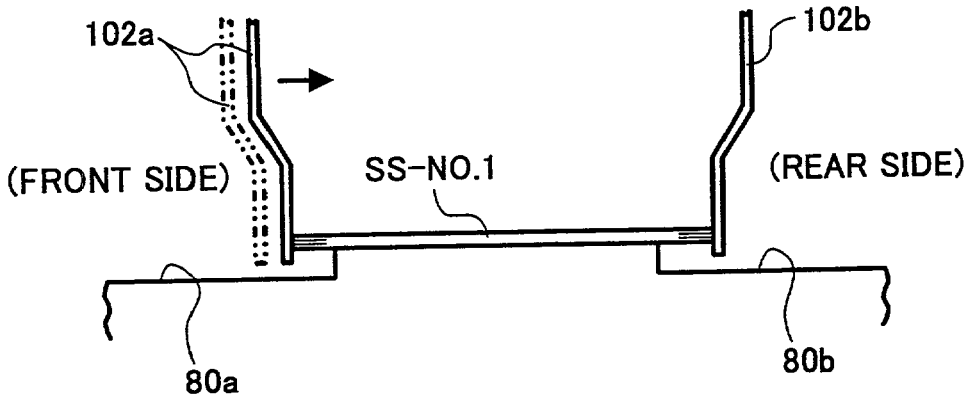
FIGS. 18(A), (B) and (C) successively show the sorting and arranging operations according to single movement mode.
Figure 18B:
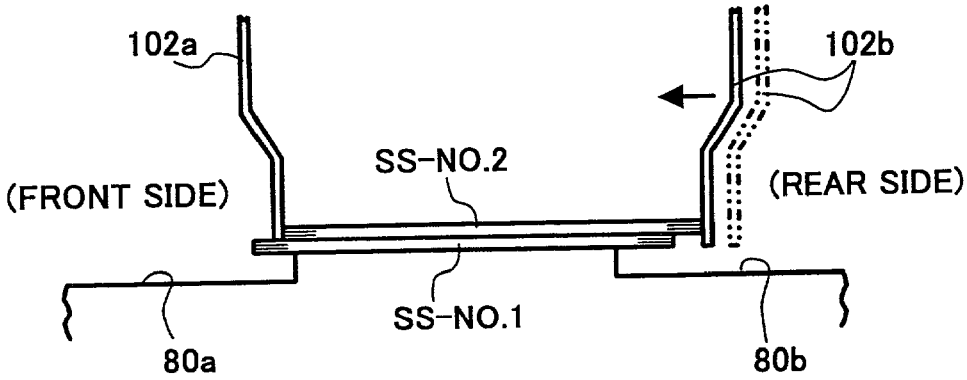
Figure 18C:
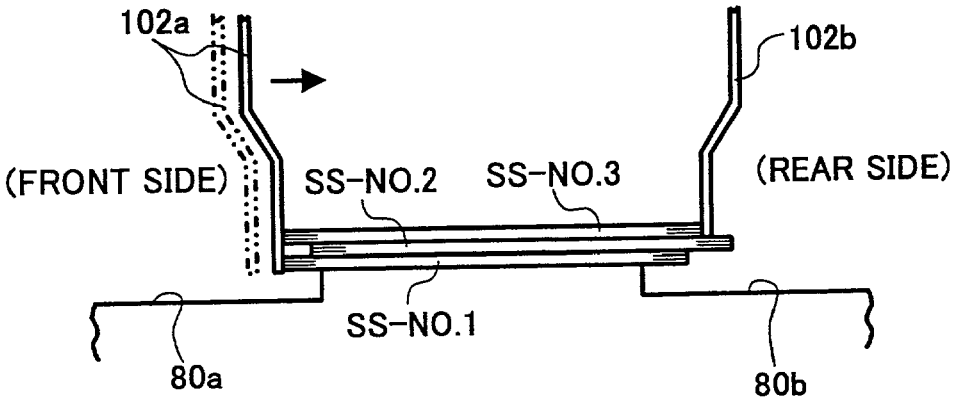
Figure 20:
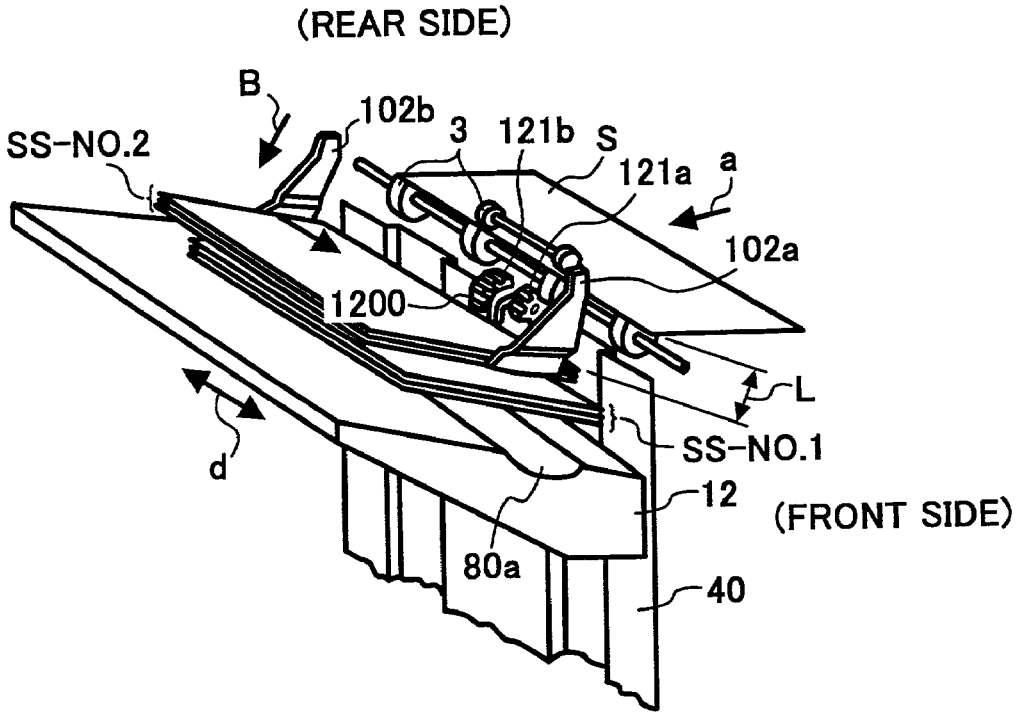
FIG. 20 is a perspective view illustrating a shift position of the arranging member in relation to paper.
Figure 21:
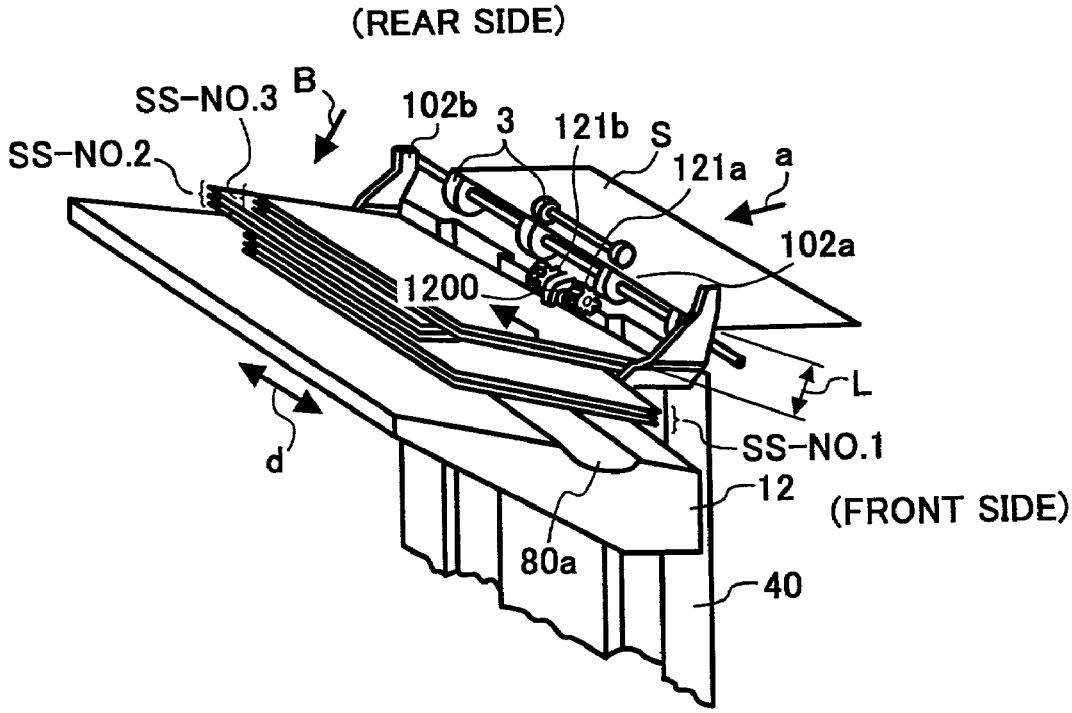
FIG. 21 is a perspective view illustrating a shift position of the arranging member in relation to paper.

Arranging operation by means of the arranging members 102*a*, 102*b* in single movement mode will be described with reference to FIGS. 18 to 21. FIG. 18 is a view of the tray 12 when the tray 12 is seen from upstream toward downstream in the discharge direction a in FIG. 3, and FIGS. 20 to 21 are perspective views of the arranging operation. FIG. 18(A) corresponds to FIG. 19, FIG. 18(B) corresponds to FIG. 20 and FIG. 18(C) corresponds to FIG. 21, respectively.

In FIG. 3, papers S passing through the conveying path provided with a pair of conveying rollers 2*b*, discharging sensor 38, discharging roller 3 and the like, are discharged in the discharge direction a by means of the discharging roller 3.

[First Job]

Figure 19:
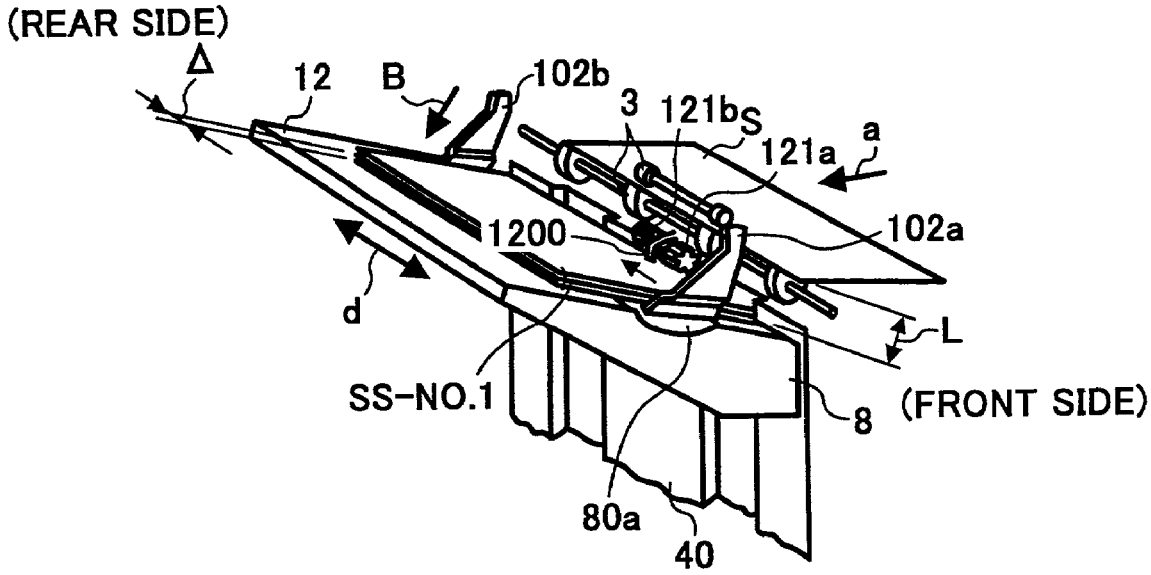
FIG. 19 is a perspective view illustrating a shift position of the arranging member in relation to paper.

In FIG. 18(A) and FIG. 19, paper S is influenced by gravity and proceeds in direction of arrow B along inclination to be dropped onto the tray 12. Here, several sheets of papers under job have been already piled, Before discharge of papers S, the tray 12 is previously shifted toward one end in the shift direction d, for example toward rear side by means of the tray reciprocating mechanism described in FIGS. 6 to 8, the arranging members are placed at the receiving position shown in FIG. 10 and at the arranging position shown in FIG. 16, and several sheets of papers constituting a first paper bundle SS-NO. 1 relating to the first job have been piled.

When papers S are discharged, the arranging member 102*b* is not operated and the arranging member 102*a* is moved in a direction approaching the paper bundle SS-NO. 1 and the paper bundle SS-NO. 1 is inserted therebetween to get in contact with ends of papers parallel to the discharge direction a, or is moved to the arranging position shown in FIG. 11 to carry out the arranging operation. Through this arranging operation, the paper bundle SS-NO. 1 is arranged to be in a state that there is no transverse deviation Δ (See FIG. 19) in the shift direction d taking place during free falling of papers S along the free falling distance L shown in FIG. 44. Thereafter, the arranging member 102*a* is operated again to be returned to the receiving position shown in FIG. 10. Such operations are carried out every time papers S are discharged and piled onto the tray 12.

Papers to be discharged may include shift command signal and may not. Paper including the shift command signal is a leading paper of a part and when paper passes through the discharging sensor 38, it is recognized by control means whether the shift command signal is included or not.

If the control means does not recognize the shift command signal after a certain number of sheets constituting the first paper handle SS-NO. 1 are completely discharged, it means completion of job. Thus, the tray 12 is not shifted and the arranging members 102*a*, 102*b* are returned to the home position (See FIG. 9).

[Second job]

When the control means recognizes the shift command signal after a certain number of sheets constituting the first paper bundle SS-NO. 1 are completely discharged, the paper is a leading paper for next job. Before the paper reaches the discharging tray 12, the tray 12 is shifted in order to make boundary with next job apparent.

At this shifting time, the arranging members 102*a*, 102*b* are evacuated by means of movement to the evacuating position shown in FIG. 17 (or by means of descent of the tray 12 or combination of descent of tray and evacuation of the arranging members), and in this evacuating state, the tray 12 is shifted from rear to front.

After said shift, the arranging members 102*a*, 102*b* are moved from the evacuating position shown in FIG. 17 to the arranging position on the basis of FIG. 16, and also, to the receiving position shown in FIG. 10. This state is shown in FIG. 18(B) and FIG. 20. By means of shift of the tray 12, the front arranging member 102*a* is placed on and is in contact with the first paper bundle SS-NO. 1 and the rear arranging member 102*b* is placed at a predetermined receiving position. Also, in FIG. 18(B) and FIG. 20, a few papers constituting the second paper bundle SS-NO. 2 relating to second job are piled.

When papers S relating to the second job are discharged, the front arranging member 102*a* is not operated and the rear arranging member 102*b* is moved in a direction approaching the second paper bundle SS-NO. 2, and the paper bundle SS-NO. 2 is inserted therebetween to get in contact with ends of papers parallel to the discharge direction a, or is moved to the arranging position shown in FIG. 11 to carry out the arranging operation.

Through this arranging operation, the second paper bundle SS-NO. 2 is arranged. Thereafter, the arranging member 102*b* is operated again to be returned to the receiving position shown in FIG. 10. Such operations are carried out every time papers S are discharged and piled onto the tray 12.

Papers to be discharged may include shift command signal and may not. Paper including the shift command signal is a leading paper of a part and when paper passes through the discharging sensor 38, it is recognized by the control means whether the shift command signal is included or not.

If the control means does not recognize the shift command signal after a certain number of sheets constituting the second paper bundle SS-NO. 2 are completely discharged, it means completion of job. Thus, the tray 12 is not shifted and the arranging members 102*a*, 102*b* are returned to the home position (See FIG. 9).

[Third Job]

When the control means recognizes the shift command signal after a certain number of sheets constituting the second paper bundle SS-NO. 2 are completely discharged, the paper is a leading paper (first sheet) for next job. Before the paper reaches the discharging tray 12, the tray 12 is shifted for next job. At this shifting time, the arranging members 102*a*, 102*b* are evacuated by means of movement to the evacuating position shown in FIG. 17 (or by means of descent of the tray 12 or combination of descent of the tray and evacuation of the arranging members), and in this evacuating state, the tray 12 is shifted from rear to front.

After said shift, the arranging members 102*a*, 102*b* are moved from the evacuating position shown in FIG. 17 to the arranging position on the basis of FIG. 16, and also, to the receiving position shown in FIG. 10. This state is shown in FIG. 18(C) and FIG. 21. By means of shift of the tray 12, the rear arranging member 102*b* is placed on and is in contact with the second paper bundle SS-NO. 2 and the front arranging member 102*a* is placed at a predetermined arranging position Also, in FIG. 18(C) and FIG. 21, a few papers constituting the third paper bundle SS-NO. 3 relating to third job are piled.

When papers S relating to the third job are discharged, the rear arranging member 102*b* is not operated and the front arranging member 102*a* is moved in a direction approaching the third paper bundle SS-NO. 3, and the paper bundle SS-NO. 3 is inserted therebetween to get in contact with ends of papers parallel to the discharge direction a, or is moved to the arranging position shown in FIG. 11 to carry out the arranging operation. Through this arranging operation, the third paper bundle SS-NO. 3 is arranged.

Thereafter, the arranging member 102*a* is operated again to be returned to the receiving position shown in FIG. 10. Such operations are carried out every time papers S are charged and piled onto the tray 12.

Papers to be discharged may include shift command signal and may not. Paper including the shift command signal is a leading paper of a part and when paper passes through the discharging sensor 38, it is recognized by the control means whether the shift command signal is included or not.

If the control means does not recognize the shift command signal after a certain number of sheets constituting the third paper bundle SS-NO. 3 are completely discharged, it means completion of job. Thus, the tray 12 is not shifted and the arranging members 102*a*, 102*b* are returned to the home position (See FIG. 9).

When the control means recognizes the shift command signal after a certain number of sheets constituting the third paper bundle SS-NO. 3 are completely discharged, the sheet is a leading paper for next job. Before the paper reaches the discharging tray 12, the tray 12 is shifted for next job. At this shifting time, the arranging members 102*a*, 102*b* are evacuated by means of movement to the evacuating position shown in FIG. 17 (or by means of descent of the tray 12 or combination of descent of the tray and evacuation of the arranging members), and in this evacuating state, the tray 12 is shifted from rear to front and wait for discharge of the leading paper. The above-described operations are repeated in order.

(Double Movement Mode)

Arranging operation by means of the arranging members 102*a*, 102*b* in double movement mode will be described with reference to FIG. 22. FIG. 22 is a view of the tray 12 when the tray 12 is seen from upstream toward downstream in the discharge direction a in FIG. 3.

In FIG. 3, papers S passing through the conveying path provided with conveying roller 7, discharging sensor 38, discharging roller 3 and the like, are discharged in the discharge direction a by means of the discharging roller 3.

[First Job]

Figure 22A:
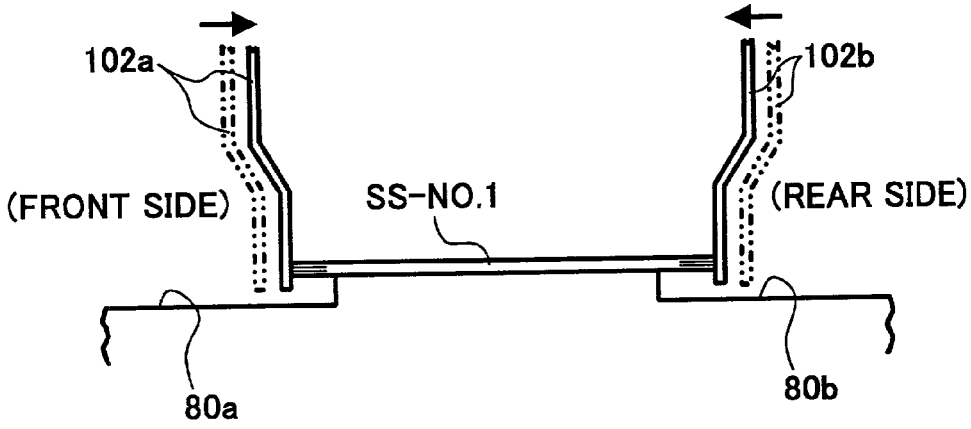
FIGS. 22(A), (B) and (C) successively show sorting and arranging operations according to double movement mode.

In FIG. 22(A), paper S is dropped onto the tray 12, just as in the single movement mode. Here, several sheets of papers under job have been already piled. Before discharge of paper S, the tray 12 is previously shifted toward one end in the shift direction d, for example toward rear side by means of the tray reciprocating mechanism described in FIGS. 5 to 8, the arranging members 102*a*, 102*b* are placed at the receiving position shown in FIG. 10, in the shift direction d and at the arranging position shown in FIG. 16, in up and down direction and several a few sheets constituting a first paper bundle SS-NO. 1 relating to the first job have been piled on the tray 12.

When paper S is discharged, the arranging members 102*a*, 102*b* are moved in a direction approaching the paper bundle SS-NO. 1 from the receiving position and the paper bundle SS-NO. 1 is inserted therebetween to get in contact with ends of paper parallel to the discharge direction a, or is moved to the arranging position shown in FIG. 11 to carry out the arranging operation.

Figure 44:
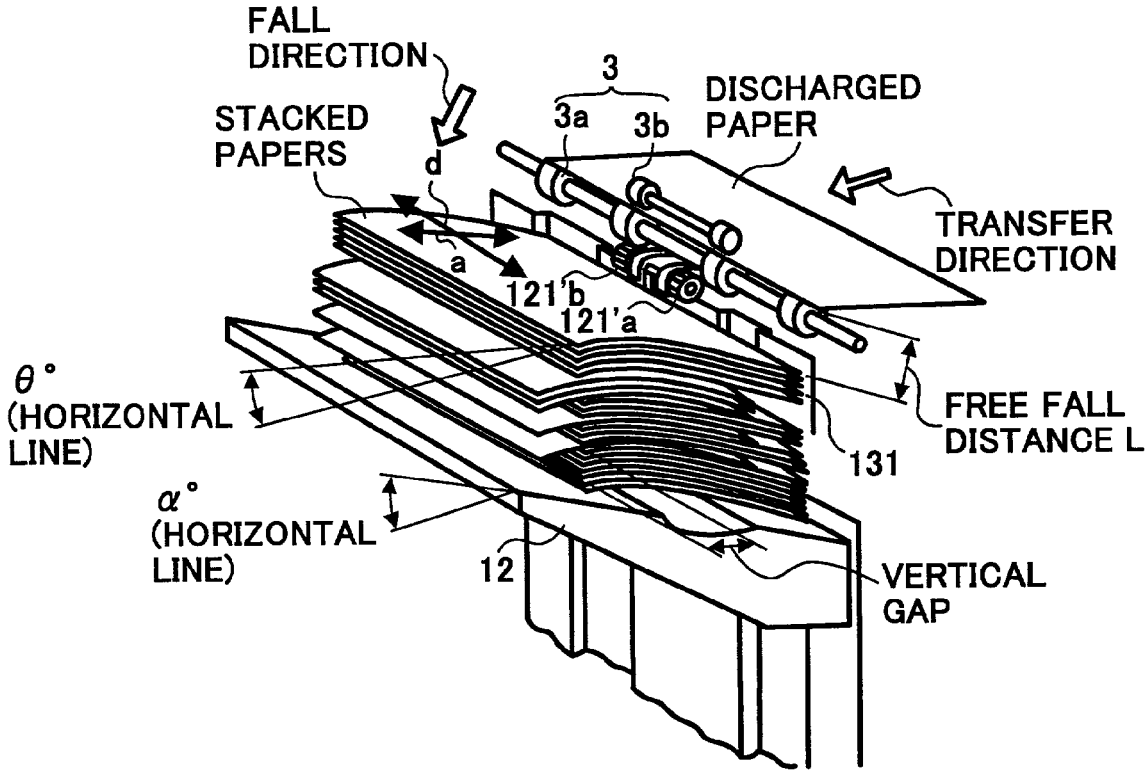
FIG. 44 is a perspective view illustrating influence by curl of paper piled on the tray.

Through this arranging operation, the paper bundle SS-NO. 1, just as in the single movement mode, is arranged to be in a state that there is no transverse deviation Δ (See FIG. 19) in the shift direction d taking place during free failing of paper S along the free fag distance L shown in FIG. 44. Thereafter, the arranging members 102*a*, 102*b* are operated again to be returned to the receiving position shown in FIG. 10. Such operations are carried out every time paper S is discharged and piled onto the tray 12.

Papers to be discharged may include shift command signal and may not. Paper including the shift command signal is a leading paper of a part and when paper passes through the discharging sensor 38, it is recognized by control means whether the shift command signal is included or not.

If the control means does not recognize the shift command signal after a certain number of sheets constituting the first paper bundle SS-NO. 1 are completely discharged, it means completion of job. Thus, the tray 12 is not shifted and the arranging members 102*a*, 102*b* are returned to the home position (See FIG. 9).

[Second Job]

When the control means recognizes the shift command signal after a certain number of sheets constituting the first paper bundle SS-NO. 1 are completely discharged, the paper is a leading paper for next job and before the paper reaches the discharging tray 12, the tray 12 is shifted for next job. At this shifting time, the arranging members 102*a*, 102*b* are evacuated by means of movement to the evacuating position shown in FIG. 17 (or by means of descent of the tray 12 or combination of descent of tray and evacuation of the a arranging members), and in tis evacuating state, the tray 12 is shifted from rear to front.

Figure 22B:
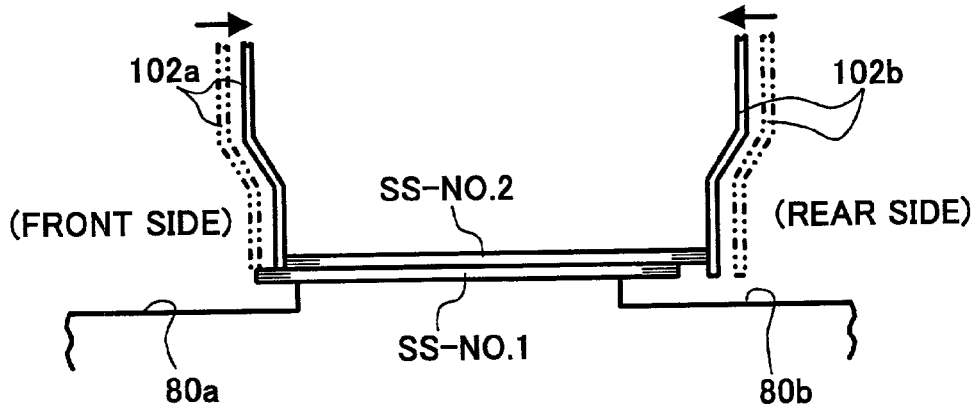

After said shift, the arranging members 102*a*, 102*b* are moved from the evacuating position shown in FIG. 17 to the arranging position on the basis of FIG. 16, and also, to the receiving position shown in FIG. 10. This state is shown in FIG. 22(B). By means of shift of the tray 12, the front arranging member 102*a* is placed on and is in contact with the first paper bundle SS-NO. 1 and the rear arranging member 102*b* is placed at a predetermined receiving position. Also, in FIG. 22(B), a few sheets constituting the second paper bundle SS-NO. 2 relating to second job are piled.

When paper S relating to the second job is discharged, the arranging members 102*a*, 102*b* are moved in a direction approaching the second paper bundle SS-NO. 2, and the paper bundle SS-NO. 2 is inserted therebetween to get in contact with ends of paper parallel to the discharge direction a, or is moved to the arranging position shown in FIG. 11 to carry out the arranging operation. Through this arranging operation, the second paper bundle SS-NO 2 is arranged. Thereafter, the arranging members 102*a*, 102*b* are operated again to be returned to the receiving position shown in FIG. 10. Such operations are carried out every time paper S is discharged and piled onto the tray 12.

Sheets to be discharged may include shift command signal and may not. A sheet including the shift command signal s a leading sheet of a part and when sheets pass through the discharging sensor 38, it is recognized by the control means whether the shift command signal is included or not.

If the control means does not recognize the shift command signal after a certain number of sheets constituting the second paper bundle SS-NO. 2 are completely discharged, it means completion of job. Thus, the tray 12 is not shifted and the arranging members 102*a*, 102*b* are returned to the home position (See FIG. 9).

[Third Job]

When the control means recognizes the shift command signal after a certain number of sheets constituting the second paper bundle SS-NO. 2 are completely discharged, the sheet is a leading sheet (first sheet) for next job and before the sheet reaches the discharging tray 12, the tray 12 is shifted for next job. At this shifting time, the arranging members 102*a*, 102*b* are evacuated through movement to the evacuating position shown in FIG. 17 (or by means of descent of the tray 12 or combination of descent of the tray and evacuation of the arranging members), and in this evacuating state, the tray 12 is shifted from rear to front.

Figure 22C:
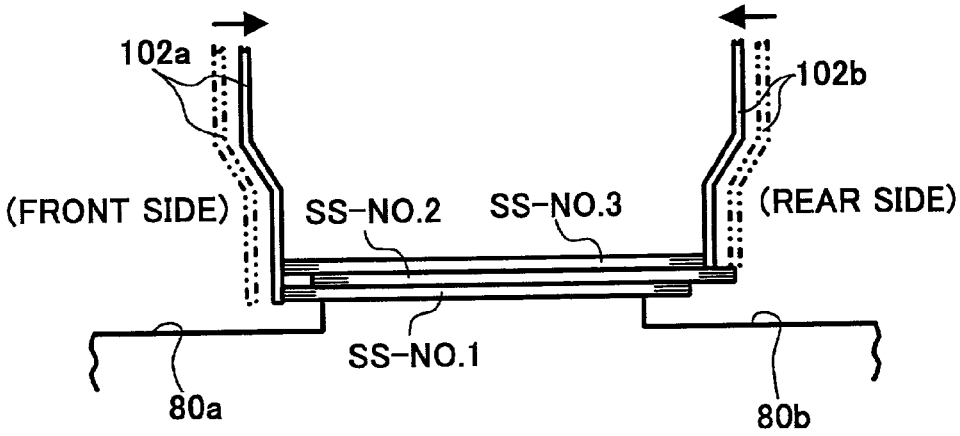

After said shift, the arranging members 102*a*, 102*b* are moved form the evacuating position shown in FIG. 17 to the arranging position on the basis of FIG. 16, and also, to the receiving position shown in FIG. 10. This state is shown in FIG. 22(C). Through shift of the tray 12, the rear arranging member 102*b* is placed on and is in contact with the second paper bundle SS-NO. 2 and the front arranging member 102*a* is placed at a predetermined arranging position. Also, in FIG. 22(C), a few sheets constituting the third paper bundle SS-NO. 3 relating to third job are piled.

When paper S relating to the third job is discharged, the arranging members 102*a*, 102*b* are moved in a direction approaching the third paper bundle SS-NO. 3, and the paper bundle SS-NO. 3 is inserted therebetween to get in contact with ends of sheets parallel to the discharge direction a, or is moved to the arranging position shown in FIG. 11 to carry out the arranging operation. Through this arranging operation, the third paper bundle SS-NO. 3 is arranged.

Thereafter, the arranging members 102*a*, 102*b* are operated again to be returned to the receiving position shown in FIG. 10. Such operations are carried out every time papers S are discharged and piled onto the tray 12.

Sheets to be discharged may include shift command signal or may not. A sheet including the shift command signal is a leading sheet of a part and when sheets pass through the discharging sensor 38, it is recognized by the control means whether the shift command signal is included or not.

If the control means does not recognize the shift command signal after a certain number of sheets constituting the third paper bundle SS-NO. 3 are completely discharged, it means completion of job. Thus, the tray 12 is not shifted and the arranging members 102*a*, 102*b* are returned to the home position (See FIG. 9).

When the control means recognizes the shift command signal after a certain number of sheets constituting the third paper bundle SS-NO. 3 are completely discharged, the sheet is a leading sheet for next job and before the sheet reaches the discharging tray 12, the tray 12 is shifted for next job. At this shifting time, the arranging members 102*a*, 102*b* are evacuated by means of movement to the evacuating position shown in FIG. 17 (or by means of descent of the tray 12 or combination of descent of the tray and evacuation of the arranging members), and in this evacuating state, the tray 12 is shifted from rear to front and waits for discharge of the leading sheet. The above-described operations are repeated in order.

Also, when carrying out sorting, except for sorting through slit of the tray 12 in the shift direction, shift and arrangement are made possible by not carrying out shift of the tray 12 and by carrying arrangement at a position to which the arranging members 102*a*, 102*b* are moved in the shift direction by a necessary amount.

(Return Means)

(1) FIRST EXAMPLE

Figure 23:
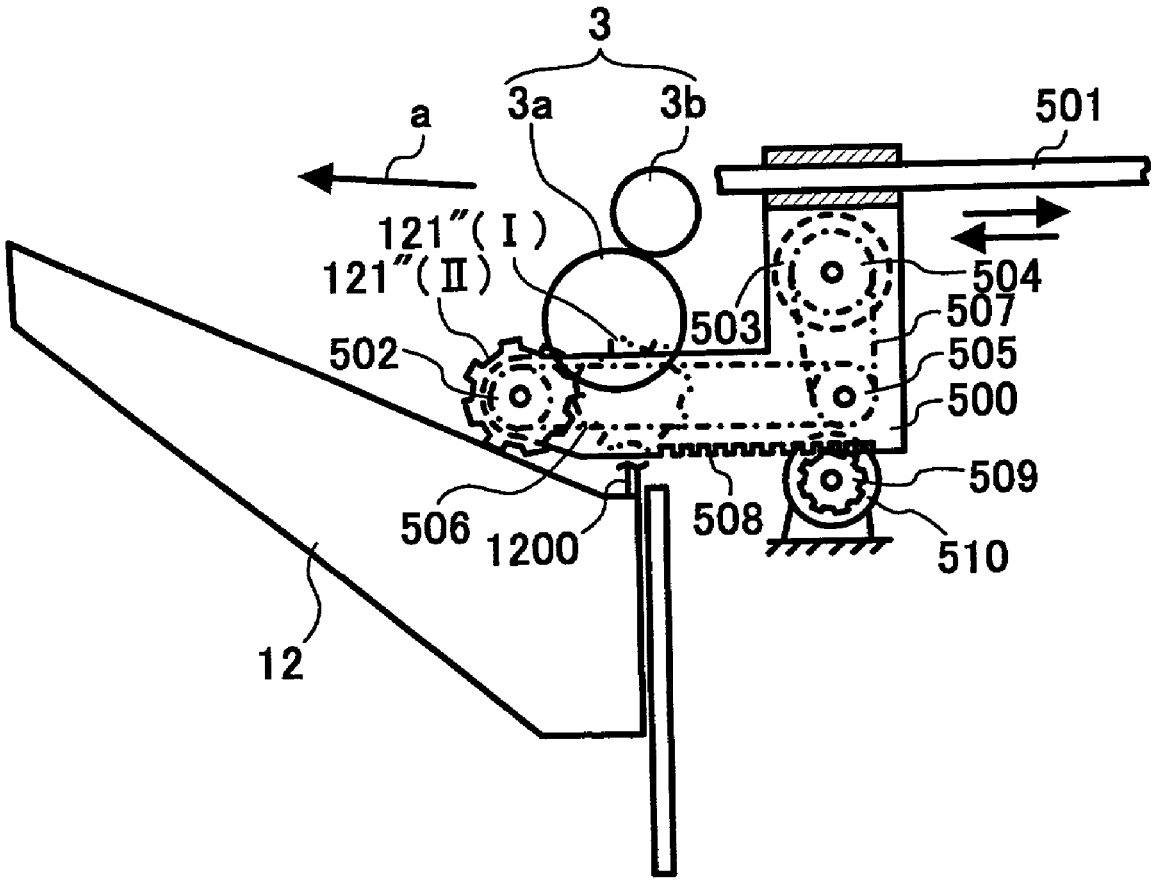
FIG. 23 is a front view illustrating another example of the return roller.

With reference to FIG. 23, examples of the return roller 121 as a return means and a displacing means for displacing the return roller 121 in the discharge direction will be described.

In FIG. 23, the return roller 121 is formed of elastic material having a sponge-like state and a convexo-concaved surface, and is axially supported on a mobile body 500. The mobile body 500 has a front shape of "L" and upper portion thereof is slidably fitted to a guide member 501 long in displacing direction. The return roller 121 is axially supported on the mobile body 500 and a pulley 502 is integrally provided in a shaft constituting a body with the return roller 121. Also, a motor 503 is fixed to the mobile body 500 and a pulley 504 is fixed to a shaft thereof.

The idle pulley 505 is axially supported on the middle position between the pulley 502 and pulley 504 on the moving body 500, in which a belt 506 is wound around the idle pulley 505 and the pulley 502 and a belt 507 is wounded around the idle pulley 505 and the pulley 504.

The rotation of motor 503 is transmitted to the retain roller 121, whereby it is possible to rotate the return roller 121 independently of the rotation of discharging roller 3. The bottom surface of moving body 500 is formed with a rack 508. A pinion 509 is engaged with this rack 508. The pinion 509 is fixed on the spindle of motor 510 axially supported on a stationary member.

In the displacement means constituted from this construction, the moving body 500 is reciprocated along the guide member 501 in response to the rotational direction of the motor 510 through the engagement of rack 508 and pinion 509, by driving the motor 510, and it is possible to move the return roller 121 to an optional position on the discharging direction a (displacement direction), by controlling the rotational amount and direction of motor 510.

In the displacement means of this embodiment, because the displacement is performed by using the engaging relation of rack and pinion, the moving trace of return roller 121 is characterized as being linear, and the roller 121 is displaceable between the home position (I), in which it is spaced from the top surface of tray 12 or top surface of papers piled on the tray 12 and is positioned adjacent the upstream side end in the discharging direction a, and the compress returning position (II), in which it can grasp the rear end of discharged paper on the discharging direction from the home position (I) and lightly contacts with the top surface on the tray.

In the displacement means according to the present embodiment, the rear end of papers previously piled is compressed by determining the compressing/return position (II) as described in the above, whereby it is possible to prevent the leading end of next paper to be discharged from being pushed out, and when the paper to be discharged becomes not to be pushed out, firstly the return roller 121 is returned to the home position (I), and after the discharged paper drops, it is moved again to the compressing/return position (II) and then rotated in the returning direction to return the discharged paper until the rear end of discharged paper collides against the end fence 131, whereby it is possible to execute a longitudinal arrangement.

Like this, because the motor 504, which is a rotational driving system of return roller 121, is constructed to be independent from the rotational driving system of discharging roller 3, it is possible to control stopping, starting, and inwrinkles/dewrinkles of rotational speed of the return roller 121 in connection with the displacement operation without being affected by the rotational speed of the discharging roller 3.

(2) SECOND EXAMPLE

Figure 24:
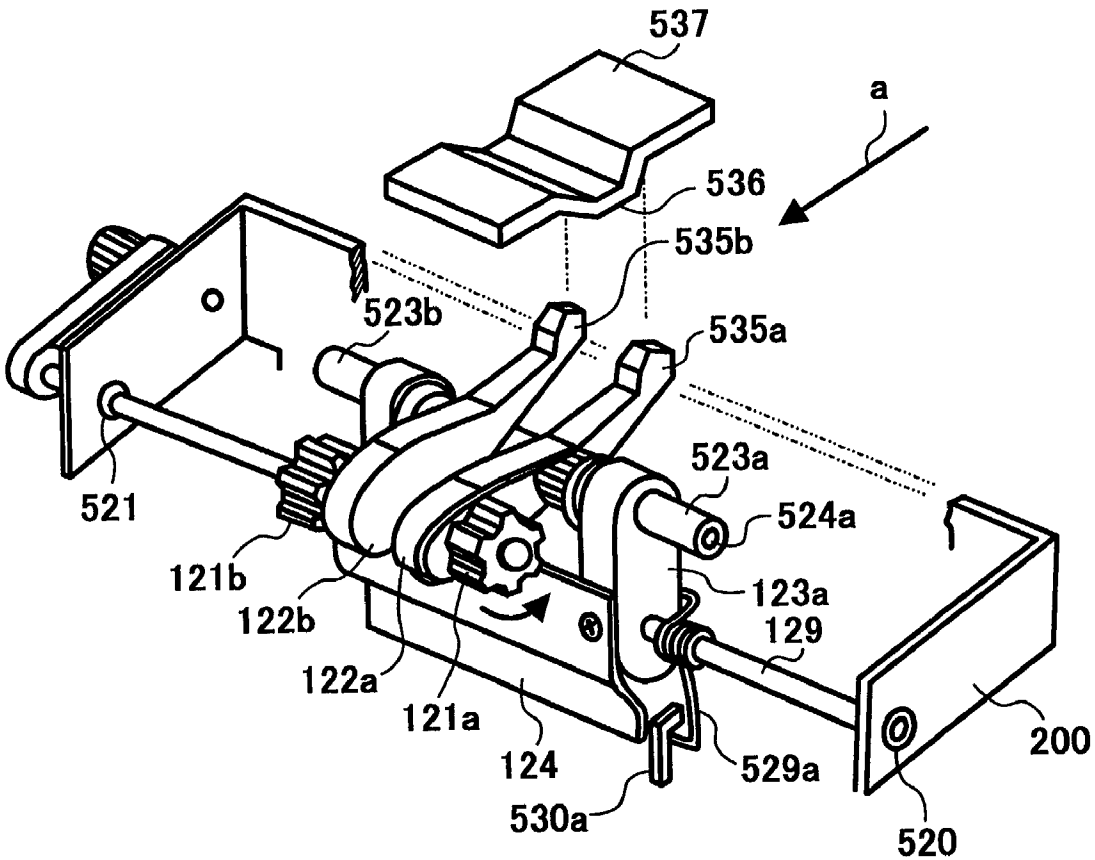
FIG. 24 is a perspective view illustrating peripheral important parts of the return roller.
Figure 25:
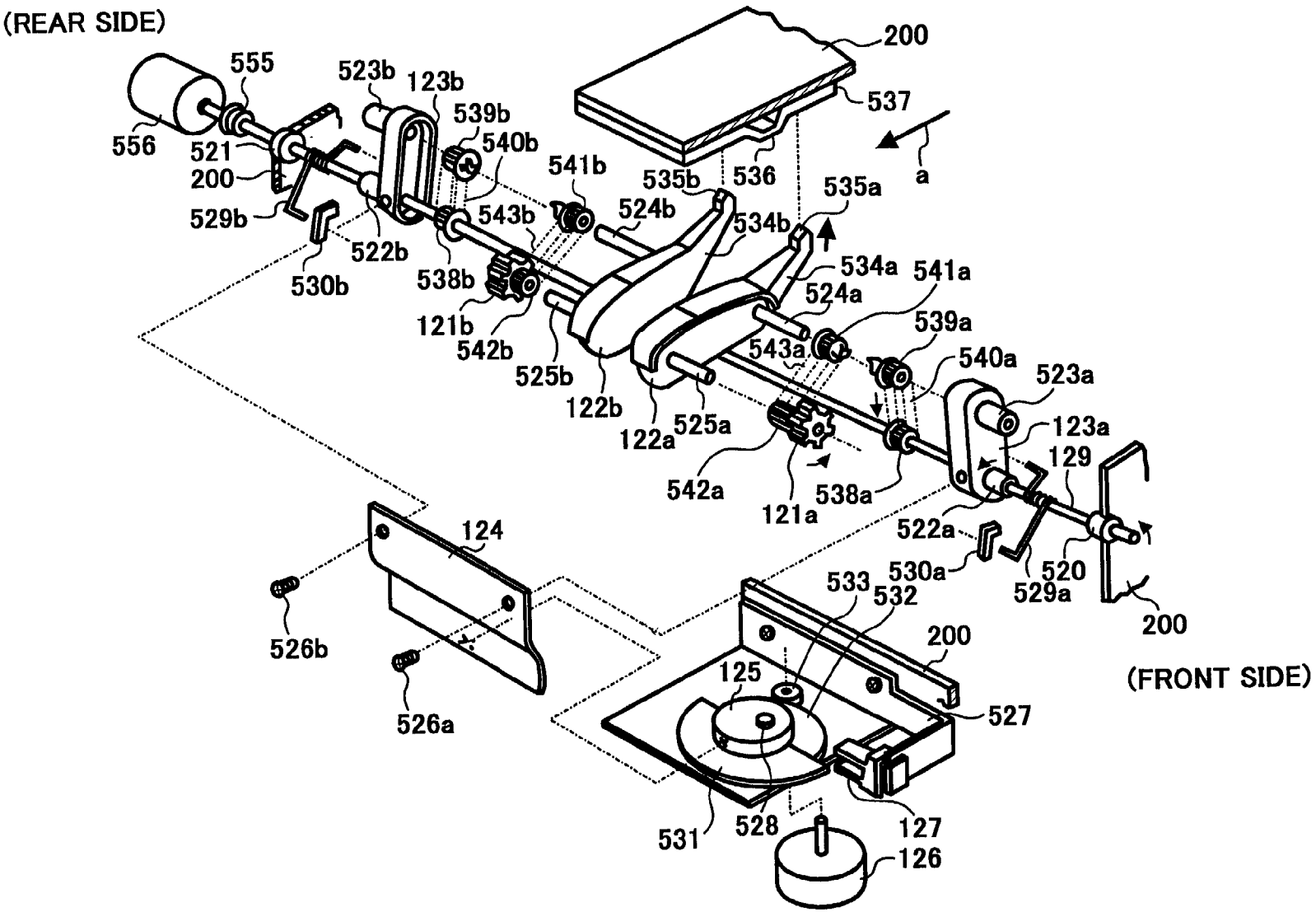
FIG. 25 is an exploded perspective view illustrating peripheral important part of the return roller.

Another example of displacement means, which comprises return rollers 121*a*, 121*b* as returning memo and executes displacement on the discharging direction, will be described with reference to FIGS. 24 to 29. For convenience of description, the two return rollers 121*a*, 121*b* are also generically named as return roller 121 in some cases. FIG. 24 shows the main parts of the displacement means in the assembled state together with the return rollers 121*a*, 121*b*, and FIG. 25 shows the displacement means in the disassembled state together with the return rollers 121*a*, 121*b*. The constitutional elements of displacement means are incorporated into a frame 200.

The return rollers 121*a*, 121*b* are formed from a material same with that of the return roller 121 in a shape substantially identical to that of the latter. Means for displacing the return roller 121*a* and means for displacing the return roller 121*b* have a completely identical construction in their common parts. And, for the common parts, reference numerals followed by character, "a" are denoted and described in detail in connection with the return roller 121*a* and reference numerals followed by character, "b" are denoted and the description thereof will be omitted in connection with the return roller 121*b*, in order to avoid complicatedness of description.

The basic construction of displacement means is as follows:

Referring to FIGS. 24 and 25, the first member 123*a* (herein below, to be referred as "driving lever") is the longest member and pivotally mounted on the frame 200, which is a stationary member, by a shaft 129 passing through the middle part thereof. Here, the shaft 129 is rotatable with respect to the driving lever 123*a*, and both ends of shaft 129 are pivotally supported on the frame 200 via bearings 520, 521. The part of driving lever 123*a*, through which the shaft 129 is a pivot connection and is to be referred as first pivot connection 522*a*. The driving lever 123*a* can execute a rocking movement about the first pivot connection 522*a* within a predetermined extent.

The second member 122*a* (herein below, to be referred as driven lever) is a longitudinally elongated member and is pivotally mounted by fitting a shaft part 524*a* projected from its middle portion into the second pivot connection 523*a*, which is in one free end side deviated from the first pivot connection 522*a* on the driving lever 123*a*. The driven lever 122*a* can execute a rocking movement about a second pivot connection 523*a* within a predetermined extent.

An optional free end side deviated from the rotational center (center of shaft part 524*a*) in the second pivot connection 523*a* of driven lever 122*a* is integrally formed with a shaft part 525*a*, on which the return roller 121*a* is pivotally mounted.

By combining the rocking movement centered on the first pivot connection 522*a* of driving lever 128*a* and the rocking movement centered on the second pivot connection 523*a* of driven lever 122*a*, it is possible to displace the return roller 121*a* pivotally mounted on the free end side of driven lever 122*a* to a different position on the discharging direction a.

With the present embodiment, the return roller 121*a* can be more remotely displaced as compared to the construction in which a tip end of single pivotable lever is provided with a return roller (not shown) or the displacement means formed from the combination of rack and pinion as described with reference to FIG. 23, as will be described herein below, it is possible to obtain a more compact construction as compared to other construction for obtaining an identical amount of displacement stroke due to the construction of bendable driving lever 123*a* and driven lever 122*a*, and it becomes possible to pass over a rear portion upwardly raised by a face curl to abut on a paper on the tray, because it is possible to execute up and down displacement for mountain-shaped tracing.

If the driving lever 123*a* is considered as centered on the first pivot connection 522*a*, a bracket 124 formed from a sheet metal is fired on the free end side opposite to the side provided with the driven lever 122*a* by a screw 526*a*. Due to this, the driving lever 123*a* is integrated with the plate type bracket 124.

The peripheral surface of an eccentric cam 125 for rocking the driving lever 123*a* abuts on the lateral surface of upstream side in the discharging direction of this bracket 124. The eccentric cam 125 is made to rotate in union with the shaft 528 axially supported on a supporting plate 527 integrally formed with the frame 200. As a first abutting means for elastically abutting the cam surface of eccentric cam 125, a spiral coil spring 529*a* is provided. In this spiral coil spring 529*a*, one end side of the spiral coil spring 529*a* loosely wound on the circumference of the first pivot connection 522*a* which is in the form of boss is engaged on one end side of the first pivot connection 522*a*, and the other end side of the spiral coil spring 529*a* is engaged on a hook 530*a* which is constructed as a part of the frame 200.

Due to the elasticity of this spiral coil spring 529*a*, the driving lever 123*a* is forced to rotate in the direction depicted by an arrow about the first pivot connection 522*a* and elastically compressed against the eccentric cam 125. Therefore, by rotationally driving the eccentric cam 125, the driving lever 123*a* rocks about the first pivot connection 522*a* depending on the displaced amount of cam surface.

As the eccentric cam 125 has an endless cam surface, it is possible to provide a periodic displacement to the driving lever 123*a*, and further more to the return roller 121*a*.

The first rocking means is constructed by the spiral coil spring 529*a* as the first abutting means and the eccentric cam 125, the sliding contact between the eccentric cam 125 and the free end side of driving lever 123*a* (bracket 124) is obtained, and it is possible to rotate the driving lever 123*a* to a predetermined angle in response to the rotation of eccentric cam 125 depending on the eccentric amount.

Like this, as the driving lever 123*a* is rocked to a predetermined angle by the first rocking means, the driven lever riding on the driving lever 123*a* is moved together with the return roller 121*a*, whereby it is possible to provide an arch-shaped displacement with respect to the discharge direction a to the return roller 121*a*.

On the shaft 528 for fixing the eccentric cam 125, a shield plate 531 formed by cutting a disk into a semi-circular shape fixed at its axial center part and also a gear 532 is fixed at its axial center part. A gear 533 is engaged with the gear 532 and the gear 533 is adapted to be rotationally driven by a stepping motor 126 fixed on the supporting plate 527.

As a sensor 127 is fixed on a part that the cut portion of shield plate 531 passes, it is possible to detect the amount of rotation of eccentric cam 125 from an information of shield plate 531 detected by the sensor 127 and to control drive stoppage of the stepping motor 126. This sensor 127 is able to serve as a return roller HP sensor for detecting the home position of return roller 121.

The combination of sensor 127 and shield plate 531 constitutes an encoder, and the eccentric cam 125 is controlled in the amount of rotation by the encoder, using the stepping motor 126 as a driving source.

Figure 28:
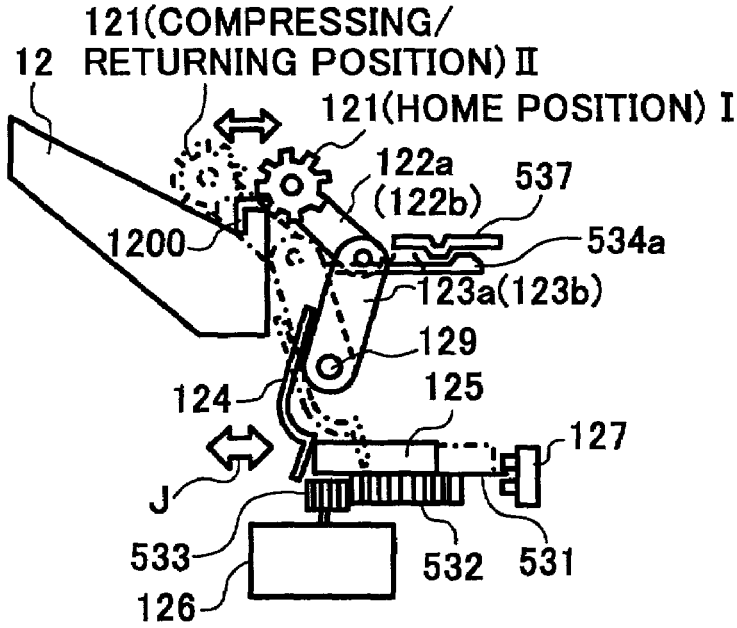
FIG. 28 is a front view illustrating operations of the return roller.

By adapting the combined construction of stepping motor and encoder in this manner, it is possible to properly manage the position of return roller 121*a*. For example, it is possible to position so that the return roller 121*a* is to be located on the home position (I), compressing/returning position (II) and the like as shown in FIG. 28.

The home position (I) is spaced from the top surface of tray 12 or a paper piled on the tray 12 and located adjacent to the upstream side end in the discharging direction a and the compressing/returning position (II) is located in the position that it grasps the rear end of discharged paper and lightly contacts with the top surface of paper on the tray in the discharging direction from the home position (I).

The driven lever 122*a* is rocked by the second rocking means provided to act on the free end side 534*a* opposite to the side where the return roller 121*a* is mounted to be spaced from the second pivot connection 523*a* (shaft part 524*a*) on this driven lever 122*a*.

By providing such second rocking means, which rocks the driven lever 122*a* by a predetermined amount of angle about the second pivot connection 523*a* following the rocking of driving lever 123*a*, to displace the angle of driven lever 122*a* in relation to the driving lever 123*a* centered on the second pivot connection 523*a*, it is possible to move the return roller 121*a* to a desired position with a desired trace. In addition, by combining the rocking operation of driven lever 122*a* and the rocking operation of driving lever 123*a*, it is possible to gain a stroke of return roller 121*a*.

The second rocking means flyer comprises a flat plate type cam 537, which slides on a projection 535*a* formed on the free end side 584*a* opposite to the side provided with the return roller 121*a* offset from the second pivot connection on the driven lever 122*a* and which is formed with a bulged part 536 in the shape of a trapezoid on a part of main surface of indefinite curvature, and a second contact means for bring the flat plate type cam 537 into contact with the projection 535*a*. This second contact means can be constructed by winding a spiral coil spring on the shaft part 524*a*, engaging the one end side of spiral coil spring with the driven lever 122*a* and the other end side of spiral coil with the driving lever.

Because it is possible to periodically move the return roller 121*a* up and down depending on the rocking of driving lever 123*a* and it is possible to displace the return roller 121*a* with a mountain-shaped trace by combination of rocking movements of driving lever 123*a* and driven lever 122*a*, since the contacted condition of projection 535*a* to the flat plate type cam 537 can be obtained by the second contact means, the return roller can be moved to the compressing/returning position (II) without being pushed out in the discharging direction a by being collided against papers piled on the tray 12.

As shown in FIG. 28, the flat plate type cam 537 is positioned above the free end side 534*a* of driven lever 122*a*. In this positional relationship, the tray 12 is positioned below the return roller 121*a*.

As previously explained, the tray 12 is adapted to be motor-driven so that it will be lowered as the height of papers discharged on the tray 12 is increased, in order to maintain the distance between the top surface of papers piled on the tray 12 and the paper-discharging roller 3 to be constant.

The upper limit and lower limit of tray 12 are provided with a limit switch as a measure of safety, in which although the motor for moving the tray up and down is controlled to be stopped when it is abnormally operated too fast, if the flat plate type cam 537 is constructed to be positioned over the free end side 534*a* of driven lever 122*a*, the driven lever 122*a* can escape centering around the second pivot connection 528*a*, even if the tray 12 is lifted by the unusual situation due to uncertain reason before it arrives at the limit switch and even if the tray 12, which is being lifted, pulls up the return roller 121*a*, and because merely the swivel of driven lever prevents interference with other members, it is possible to avoid damage of members.

The power transmission system for rotationally driving the return roller 121*a* will be explained. The power transmission system essentially consists of pulleys, which rotate about each pivot center of the first pivot connection 522*a* and second pivot connection 523*a*, and a belt mounted between these pulleys. The terms, pulley and belt are intended to include gear and chain as identical power transmission means.

FIG. 25 shows a combination consisting of a pulley 538*a* which integrally rotates with the shaft 129, a pulley 539*a* which is pivotally connected to the shaft part 524*a*, and a belt 540 a wound around these pulleys 538*a* and 539*a*.

There is also shown a combination consisting of a pulley 541*a* which is pivot connected to the shaft part 524*a*, a pulley 542*a* which is pivotally connected to the shaft part 525*a* and integrally formed with the return roller 121*a*, and a belt 543*a* wound on these pulleys 541*a* and 542*a*.

Also, the pulley 541*a* and pulley 539*a* will be integrally rotated when the engaging parts formed on their lateral surfaces are engaged with each other, in the state that they are fitted around the common shaft part 524*a*.

At the axial end of the shaft 129, a stepping motor 556 is fixed on the frame via a joint 555 to rotate the shaft 129. As the shaft 129 rotates, power is transmitted in the order of the pulley 538*a*, belt 540*a*, pulley 539*a*, pulley 541*a*, belt 543*a*, pulley 542*a*, and return roller 121*a* so that the return roller 121*a* is rotated and rotation for returning a paper toward the end fence is executed.

In this manner, because the construction is made in such a manner that the pulleys are located on each of rocking fulcrum parts of driving lever 123*a* and driven lever 122*a*, so that the power is transmitted to the return roller 121*a* through these pulleys, and the shaft parts of power transmitting pulleys are in common with the shaft of rocking fulcrum parts for displacement of the returning rotor, the power transmission system can be simply constructed, the power can be easily inputted even from the outside of the driving lever 123*a*, and the displacement means can be made to be light-weighted as well as compact.

As explained in the above, the power for rotating the return roller 121*a* is transmitted through the pulley 538*a* integrally mounted on the shaft 129 which is concentric with the first pivot connecting part 522*a*, the pulley 539*a* pivotally connected to the shaft part 524*a* which is concentric with the pivot connecting part 523*a*, and the belt 540*a* mounted between these pulleys 538*a* and 539*a*, in FIG. 25.

Figure 26:
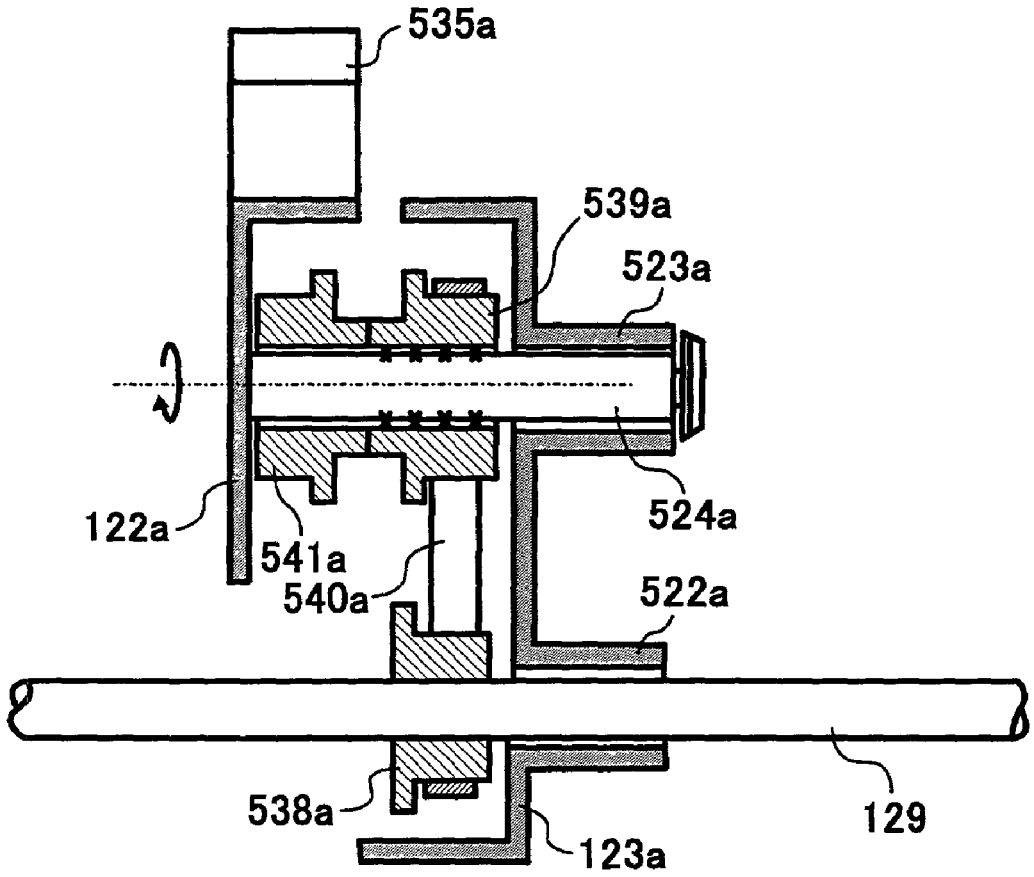
FIG. 26 is a cross-sectional view of power transmission unit illustrating rotation driving system of the return roller.

Referring to FIG. 26 showing cross-section of power transmission system, the pulley 538*a* is integrally fixed on the shaft 129. The pulley 539*a* is pivotally connected to the shaft part 524*a*. Specifically in this embodiment, a proper frictional force is applied between the inner diameter part of pulley 539*a* and shaft part 524*a* by properly selecting tension of the belt 540*a* mounted between the pulleys 538*a* and 539*a* and compressing the pulley 539*a* against the shaft part 524*a* by means of the tension. Due to this frictional force, the rotational force of pulley 539*a* is also transmitted to the shaft part 524*a*, so that the driven lever 122*a* is pivotally biased about the second pivot connecting part 523*a*.

In FIGS. 24 and 25, the rotational direction for rendering the return roller 121*a* to execute the returning operation for returning a paper to the end fence 131 is counterclockwise. The rotational direction of pulley 539*a* when rotating the return roller 121*a* in this direction is counterclockwise, a swivel compressive force provided to the driven lever 122*a* by the frictional force when rotated in this direction is also counterclockwise about the second pivot connecting part 523*a*, and the projection 535*a* of driven lever 122*a* is biased to the direction to be compressed against the flat plate type cam 537 by the swivel compressive force.

As in this embodiment, because it is possible to allow the second biasing means to execute its function for compressing the projection 535*a* of driven lever 122*a* against the flat plate type cam 537 by means of the frictional force between the pulley 539*a* and shaft part 524*a* caused by the tension of belt 540*a* and the swivel biasing of driven lever 122*a* using the rotational force of pulley 539*a*, the construction can be simplified as compared with the case where a spiral coil spring is used. The tension of belt 540*a* is properly set so that the pulley 539*a* and shaft part 524*a* slip in the state that the projection 535*a* is compressed against the flat plate type cam 537 with a suitable compressive force.

In this embodiment, it is possible to obtain the returning function and compressing function by means of the returning means consisting of a rotating body, by positively displacing the returning means into a position with a different discharging direction, using the combined direction of rocking movements of first and second members.

The return roller 121 is rotated at the lime of returning function, but it is not necessary to rotate it at the time of compressing function. Meanwhile, it is needed to continuously rotate the paper-discharging roller 3. In this embodiment, the rotational driving system of return roller 121 and the rotational driving system of the paper-discharging roller 3 are separated from each other to be able to respectively and independently undergo rotational control.

Now, the constitutional example of rotational driving system for return roller 121 will be described with reference to FIG. 29. The return roller 121*a* is integrally formed with the pulley 542*a* as illustrated in FIG. 25, and the pulley 542*a* is connected to the pulley 541*a* on the shaft part 524*a* by the belt 543*a*. Also, the pulley 539*a*, which is concentric or integral with the pulley 541*a*, is connected to the pulley 538*a* of driving side via the belt 540*a*.

The belt 540*a* is rotated by the pulley 538*a*, which rotates in unison with the shaft 129 connected to the stepping motor 556, which is separated from the stepping motor 132 for rotating the paper-discharging roller 3, to rotate the pulleys 539*a*, 541*a*, whereby the pulley 542*a* is rotated through the belt 543*a* and thus the return roller 121 is rotated. This applies correspondingly to the pulley 542*b*.

Here, the belt 543*a* is received within the driven lever 122*a* and the belt 540 is received within the driving lever 123*a*. These constructions are same as described with reference to FIG. 25. In addition, the paper-discharge roller 3 obtains rotating power from the stepping motor 132, which is a paper-discharging motor, through the belt. Like this, it is possible to individually control the driving of paper-discharging roller 3 and the driving of return roller 121.

(Displacement of Return Roller)

Herein, the operation for displacing the return roller 121 between the home position (I) and compressing/returning position (II) by the displacement means as illustrated in FIGS. 24 to 26 will be described. Also, the following description applies correspondingly to the control of return roller 121 by the displacement means shown in FIG. 23, which is executed by the motor 510. As shown in FIG. 28, in the home position (I), the return roller 121 is located at a position adjacent to the lower side of discharging roller 3, i.e., at a position adjacent to the upstream side end in the paper-discharging direction a and spaced from the top surface of piled papers above the tray 12, and is located to be opposite to the central part of the shift direction d (widthwise direction of paper).

A paper surface lever 1200 for detecting the height of piled paper surface is positioned between the return roller 121*a* and return roller 121*b*. By this, the contact point between the paper surface lever 1200 and the surface of papers piled on the tray 12 is controlled always to be in a constant height.

Figure 45:
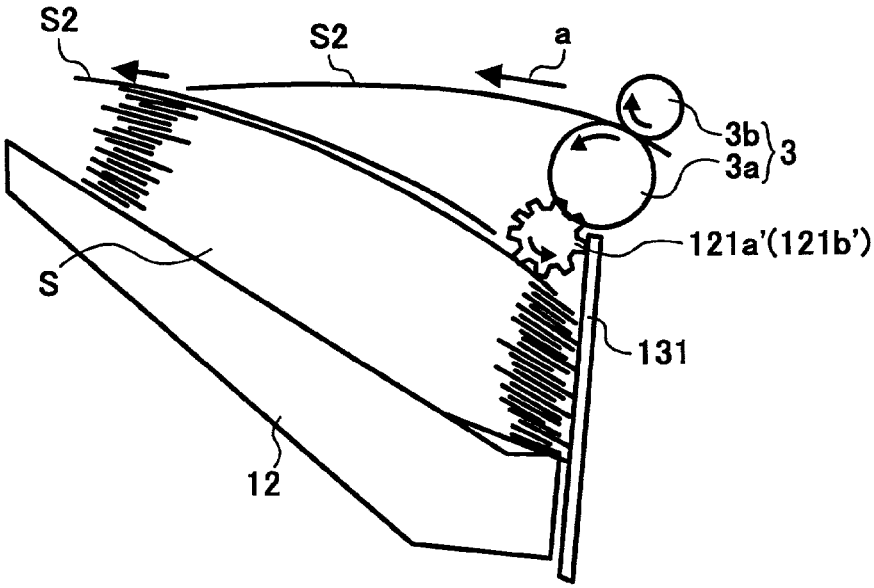
FIG. 45 illustrates a state that a discharged paper extrudes a piled paper.

As illustrated in FIG. 45, if there is a curl in papers piled on the tray 12, the uppermost surface of papers piled on the tray 12 is more slowly inclined than the inclination provided on the tray 12, so that a paper newly discharged onto the tray 12 can not be moved until it collides against the end fence 131 due to its own weight. Due to this, the upstream side end of the discharging direction a and downstream side end do not coincide with each other.

In order to prevent the longitudinal disarrangement due to the non-return of a paper dropped on the piled papers to the end fence 131, the return roller 121 driven by the displacement means of this embodiment is used, wherein it is displaced from the home position (I) to the compressing/returning position (II) where it can grasp the rear end of projected paper S2 and is brought into contact with the rear end of paper from the above, thereby returning the paper until it collides against the end fence 131 by means of rotating force of the return roller 121.

As previously described, the return rollers 121 are pivotally connected to the shaft parts 525*a*, 525*b* of driven levers 122*a*, 122*b* and the opposite shaft parts 524*a*, 524*b* of these driven levers 122*a*, 122*b* are inserted into the driving levers

123*a*, 123*b*, so that the driven levers 122*a*, 122*b* are adapted to swivel about these shaft parts 524*a*, 524*b*.

In addition, the driving levers 123*a*, 123*b* are pivotally connected to the driven levers 122*a*, 122*b* in one sides thereof, and the shaft 129 is inserted through the other sides of the drive levers 123*a*, 123*b*, so that the driving levers 123*a*, 123*b* are adapted to swivel about the shaft 129. Also, the bracket 124 is attached to the driving levers 123*a* and 123*b*, so that if the bracket 124 is displaced by the eccentric cam 125, the driving levers 123*a*, 123*b* are rocked about the shaft 129 and the driven levers 122*a*, 122*b* pivotally connected to the driving levers 123*a*, 123*b* are rocked, whereby the return roller 121 is displaced.

Figure 1:
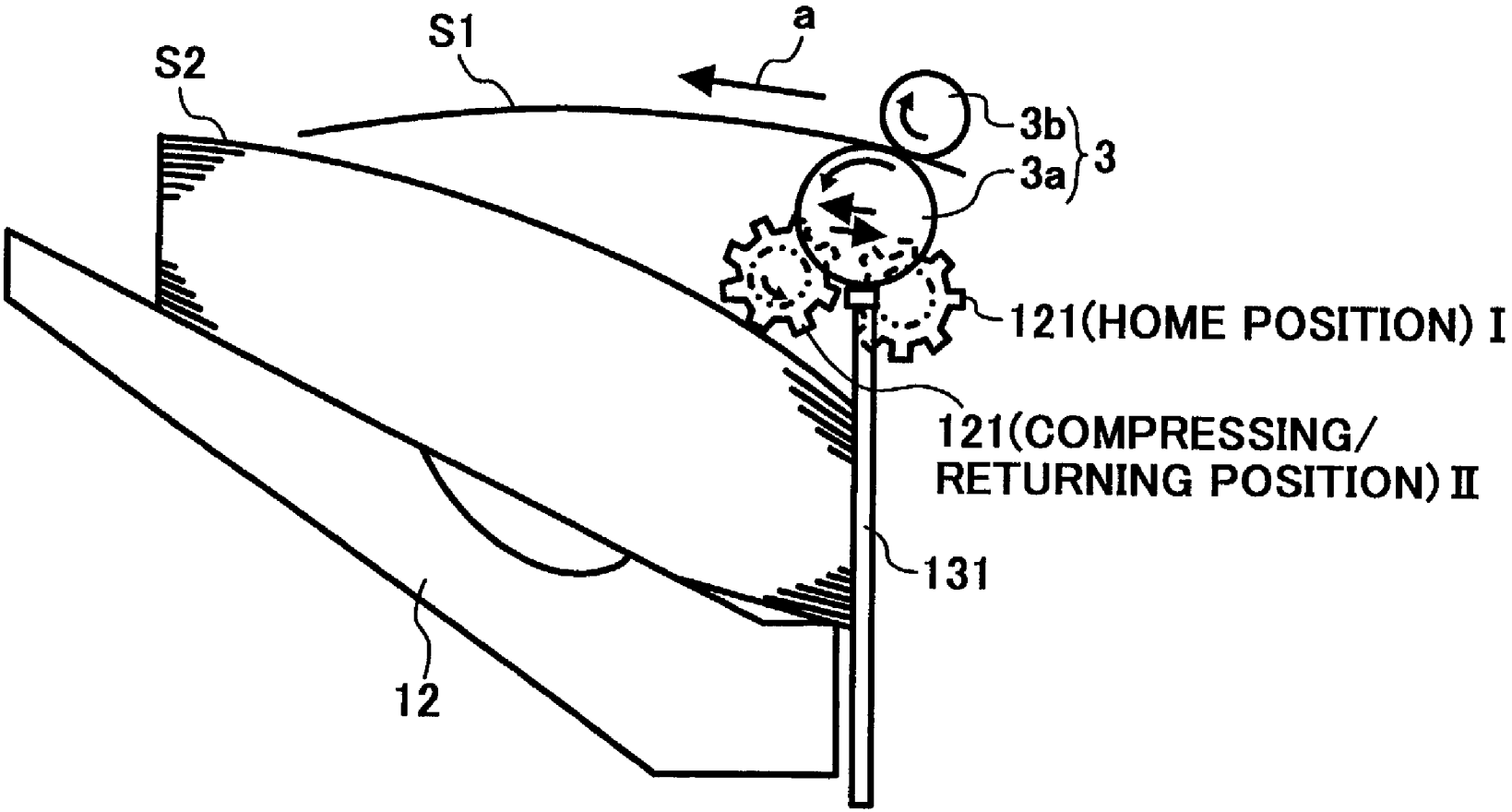
FIG. 1 is an explanatory view for explaining positions of return rollers in a first embodiment of the present invention.
Figure 2:
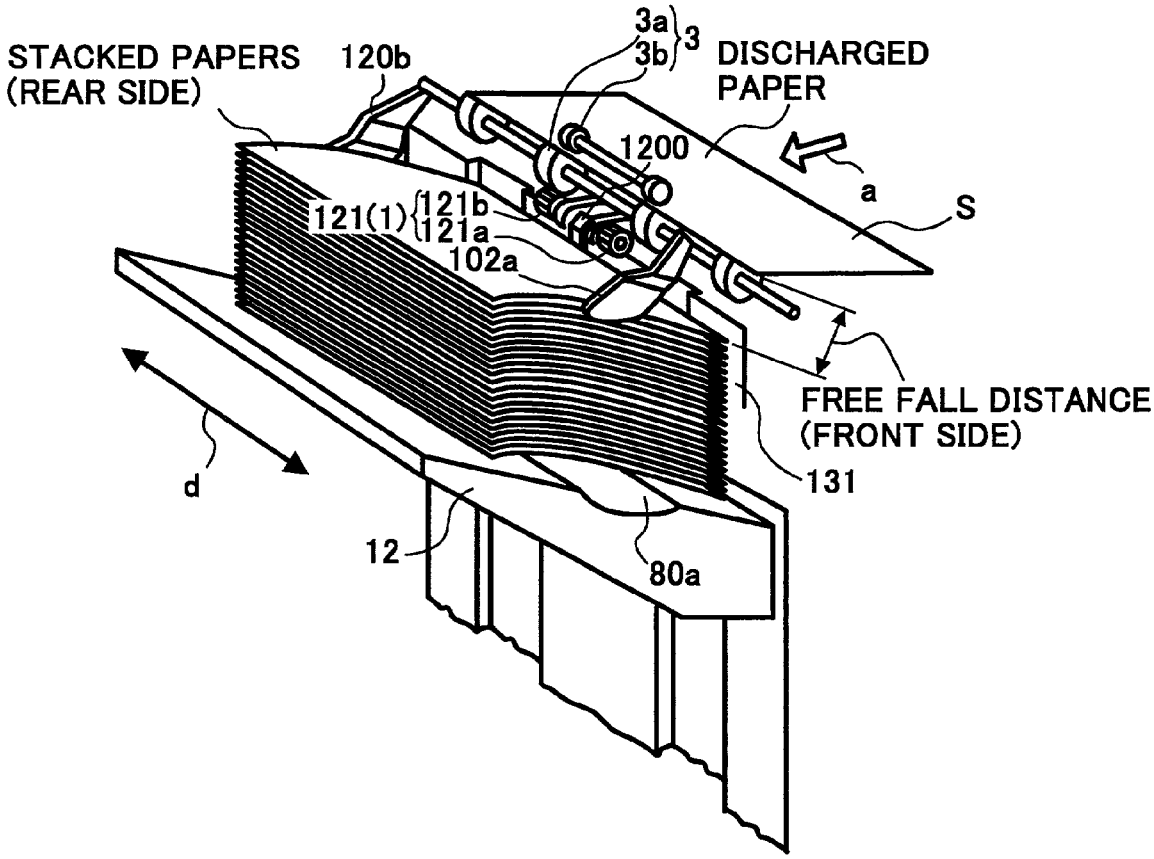
FIG. 2 is a perspective view of a return roller, arranging members and a tray shown in FIG. 1.

As shown in FIGS. 1 and 28, when the paper S1 is discharged, the return roller 121 previously moves from the home position (I) to the compressing/returning position (II) indicated by a two-dot chain line to compress the paper S2 piled on the tray 12, thereby preventing the leading end of paper S1 from pushing the paper 82 while being discharged, returns to the home position for the moment until the paper S1 drops on the paper S2, moves again to the compressing/returning position (I) after the drop of paper S1, and serves to return the piled paper S1 toward the end fence 131. As a result, the arranged condition without longitudinal misalignment is obtained as shown in FIGS. 1 and 2.

Figure 27:
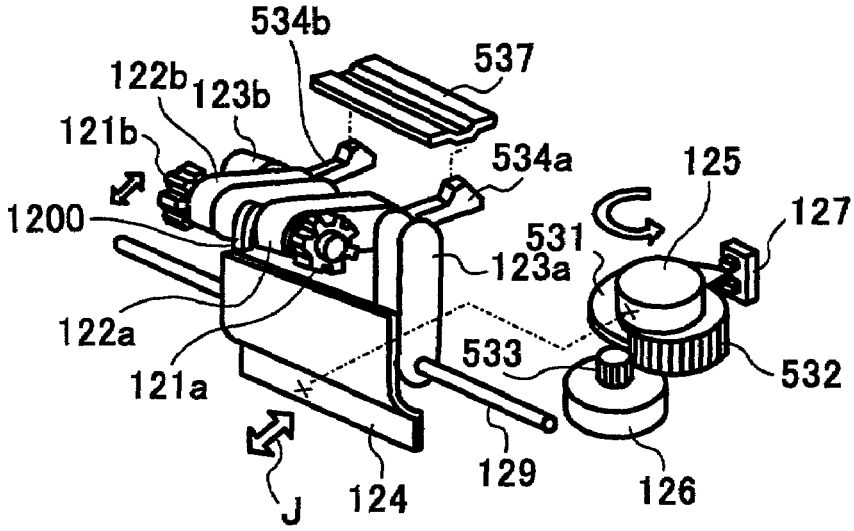
FIG. 27 is a exploded perspective view of the return roller and driving means thereof.

Referring to FIG. 27, the eccentric cam 125, which displace the bracket 124 attached on the driving levers 123*a*, 123*b* in the direction indicated by arrow J, receives the drive transmitted from the stepping motor 126 by the gears 533, 532 thereby being rotated, and by this rotation, the displacement of return roller 121 between the home position (I) and compressing/returning position (II) is executed. The eccentric cam 125 is additionally provided with a semi-circular shield plate 531, wherein if the sensor 127 detects this shield plate 531, the stop position of eccentric cam 125 and hence the stop position of return roller 121 are restricted.

The displacement timing of return roller 121 will be described.

Typically, when it is in the home position (I), a paper is discharged from the paper-discharging roller 3 and it is displaced to the compressing/returning position (II) just after the real end of this paper drops onto the tray 12 following the periphery of lower roller 3*a*.

In the case where the discharged paper is the leading paper, the rear end of leading paper is also shifted from the tray 12 in the state that it is still engaged with the paper-discharging roller 3, and after the leading paper is discharged and drops from the paper-discharging roller 3 after the shift, the return roller 121 is displaced to the compressing/returning position (II).

The return roller 121 is displaced following the mountain shaped trace along the cam shape by virtue of flat plate type cam 537 and then lowered from the upper side onto the rear end of paper to be contacted thereto, and if the return roller 121 stays at the position and returns paper to the end fence 181 with its rotational force, the eccentric cam 125 is rotated again and displaces the ret roller 121 to the home position (I). Due to this operation, it is possible to positively return a paper projected as explained below, whereby the accuracy of arrangement as to the discharging direction a can be enhanced.

In this embodiment, a sponge type elastic material is used as the return roller 121 and the surface is formed with unevenness pattern. Due to this, it is brought into deformable contact with the top surface of the paper S, whereby it is easy to obtain a proper compressive force and the paper can be positively grasped.

(Compressing Operation)

The compressing operation is to compress the paper S2 in the compressing/pressing position (II) with the return roller 121, so that the already piled paper S2 will not be pushed to move by the leading end of the paper S1 discharged from the paper-discharging roller 3 toward the tray 12, as shown in FIG. 1.

a. Outline of Control

In following examples of controls, although description is made with reference to the return roller 121 of FIGS. 24 to 29, the control to said return roller 121 applies correspondingly to the return roller 121 of FIG. 23.

As shown in FIG. 3, the examples of controls are the examples of arranging, returning and sorting controls of papers executed under the entire construction in which a sheet-shaped medium after-treatment apparatus 51 is connected to an image forming apparatus 50 as shown in FIG. 3, and the sheet-shaped medium after-treatment apparatus 51 is provided with sheet-shaped medium treatment apparatus according to the present invention.

Herein below, the sorting operation will be explained with the aspect of shifting the tray 12 and the arranging operation will be explained based on the case of both side-movement mode aforementioned in reference to FIG. 22.

b. Control Circuit

Figure 30:
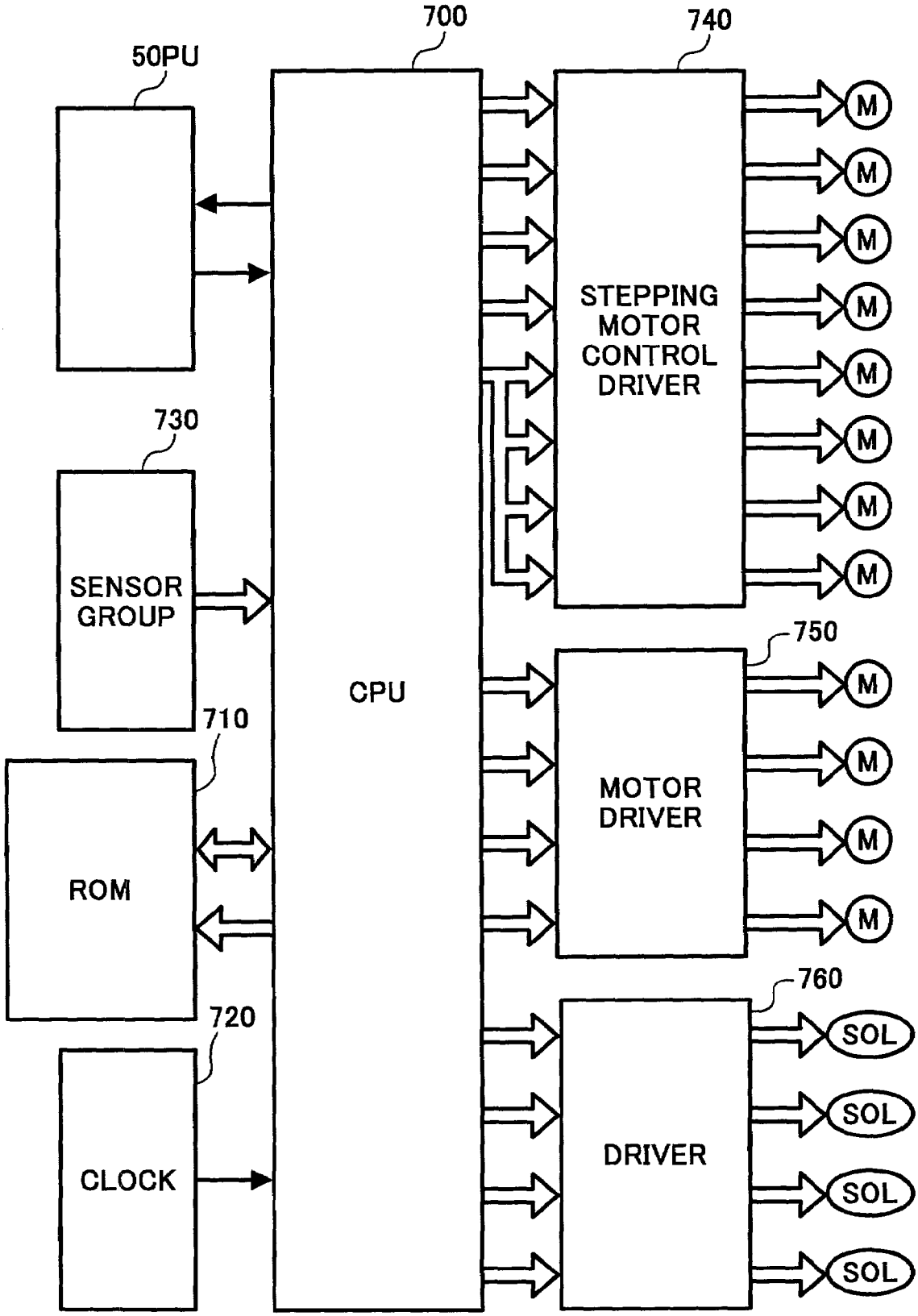
FIG. 30 is a block diagram of control system.

Referring to FIG. 30 showing a control circuit of control means, CPU 700 exchanges information with ROM 710 in which a control program is stored, and implements the control indicated in each of flowcharts to be explained below by inputting a clock signal from a clock 720.

For that purpose, CPU 700 exchanges signals with the image forming apparatus 50 and is adapted to output information to a step motor control driver 740, a motor driver 750 and driver 760 by inputting information from a group of sensors 730. The group of sensors 730 generically expresses various sensors used in the sheet-shaped medium after-treatment apparatus 51 and sheet-shaped medium collating apparatus according to the present invention, and various sensors appeared during the control based on the flowcharts to be explained below correspond to them.

The stepping motor control driver 740 controls various stepping motors used in the sheet-shaped medium after-treatment apparatus 51 and sheet-shaped medium treating apparatus according to the present invention, and in particular various stepping motors appeared in the flowchart to be explained below correspond to them. In FIG. 30, they are illustrated by a symbol M.

The motor driver 750 controls various DC motors used in the sheet-shaped medium after-treatment apparatus 51 and sheet-shaped medium treatment apparatus according to the present invention, and in particular various motors appeared in the flowchart to be explained below correspond to them. In FIG. 30, they are illustrated by a symbol M. The CPU 700 is adapted to exchange information with the control means (CPU) 50PU of image forming apparatus 50.

The driver 760 controls various solenoids used in the sheet-shaped medium after-treatment apparatus 51 and sheet-shaped medium treatment apparatus according to the present invention, and in particular various solenoids appeared in the flowchart to be explained below correspond to them. In FIG. 30, they are illustrated by a symbol SOL. CPU 700 in FIG. 30 is a main part for performing the flow to be explained below and forms the core of control means in the present invention.

(1) Premise

Referring to FIG. 3, when a shift mode for sorting papers is selected in the sheet-shaped medium after-treatment apparatus 51, a paper conveyed from a discharging roller 560 of the image forming apparatus 50 is received by a pair of inlet rollers 1, passed through a pair of conveyance rollers 2*a* and a pair of conveyance rollers 2*b*, and discharged to a tray 12 by a discharging roller 3 which is final conveyance means. At that time, branch claws 8*a*, 8*b* continuously maintain a default position and sheets are sequentially passed one by one through a same conveyance passage and discharged onto the tray 12.

Following flowcharts show only the parts related to the present invention in the sheet-shaped medium after-treatment apparatus. If the main switch, which generally controls the image forming apparatus 50 and sheet-shaped medium after-treatment apparatus 61 of FIG. 3 is turned to ON and thus the sorting mode is selected, the initial routine and main routine thereafter are executed. In the initial routine, "initial control of each driving part" is executed in STEP P1, the arranging members 102*a*, 102*b* move to the home position shown in FIG. 9, and each flag is reset to zero. In addition, "jogger" on the flowcharts to be explained below means the arranging members 102*a*, 102*b*.

If STEP P1 is terminated, it jumps to the main routine. In the main routine, "paper conveyance control" of STEP P2 (See FIG. 32 for details), "return roller compressing control" of STEP P3 (See FIGS. 35 and 36 for details), "shift control" of STEP P4 (See FIG. 37 for details), "return roller returning control" of STEP P5 (See FIG. 38), "jogger control" of STEP P6 (See FIGS. 39 and 40) are sequentially executed and repeated over required times.

(2) Paper Conveyance Control

The paper conveyance control will be described with reference to FIG. 32. As paper-discharging sensor ON flag is 0 in STEP P7 (STEP P1), it proceeds to STEP P8, and if paper-discharging sensor 38 detects the leading end of paper S (FIG. 41(A)), the paper-discharging sensor ON flag is set to 1 (STEP P9) and acceleration control of the stepping motor 132 which is the paper-discharging roller for driving the paper-discharging roller 3 is executed in order to reduce the time (STEP P10), and the return roller compressing operation flag is set in STEP P11 and at the same time, the return roller compressing operation timer is reset in STEP P12. In the sequence to this point, the return roller compressing operation timer starts to count time T1 simultaneously at the time t1 when the paper-discharging sensor 38 detects the leading end of paper (see FIG. 42(A)).

Some of the papers discharged in are carrying shift command signal. Paper carrying a shift command signal is the leading paper, and whether shift command signal is carried or not is detected by control means when paper passes discharge sensor 38. The shift command signal is sent to CPU 700 by control means 50PU of image forming apparatus 50.

If the paper which has passed through the paper-discharging sensor 38 is the leading paper of the section, CPU 700 waits for the rear end of paper being passed through the paper-discharging sensor 38 after setting the shift operation flag in STEP P14 because it is already received the shift command signal, and if the rear end of paper have passed through the paper-discharging sensor 38 (STEP P15, FIG. 41(B3)), it executes deceleration control of stepping motor 132, which is the paper-discharging motor, after setting the paper-discharging sensor ON flag to 0, in order to stabilize a landing position on the tray 12 (STEP P17). By setting the shift operation flag in said STEP P14, the shift control for shifting tray 12 is executed after the return roller 121 terminates compressing operation, to be explained with reference to FIG. 37.

The return roller returning operation flag is set in STEP P18, the return roller returning operation timer is reset (STEP P19), and jogger operation flag is set (STEP P20).

Figure 42A:
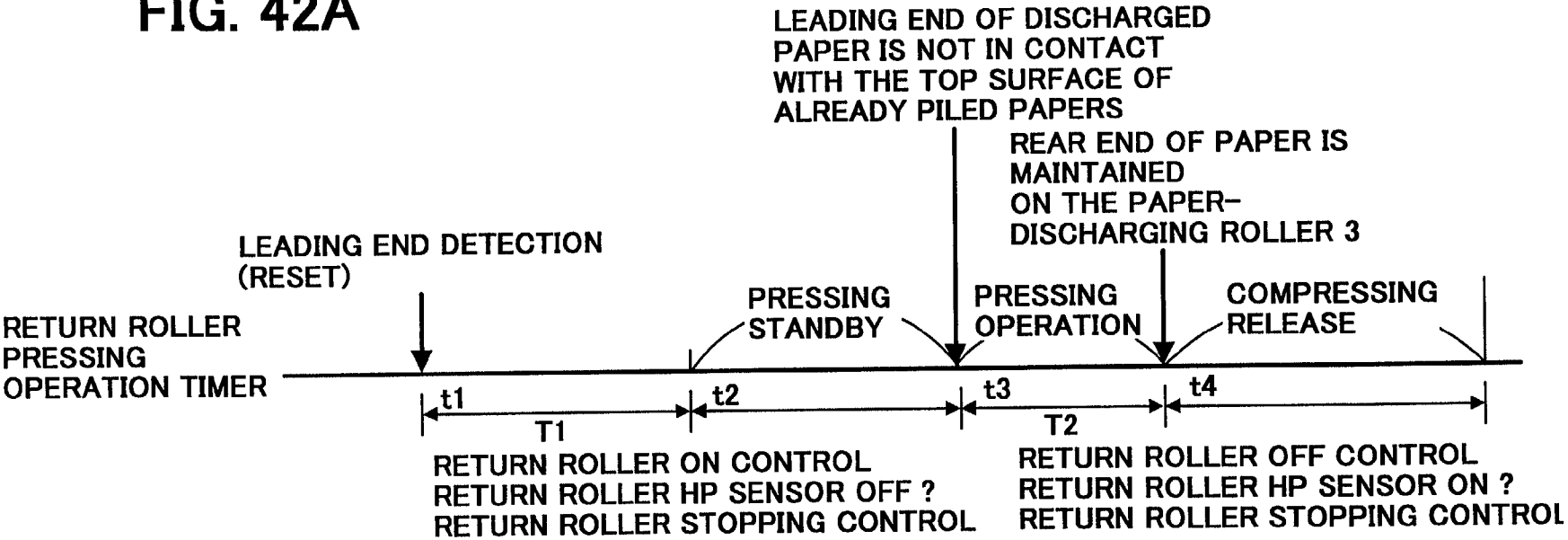
FIG. 42(A) is a timing chart relating to the pressing operation of the return roller and FIG. 42(B) is a timing chart relating to the return operation of the return roller.
Figure 42B:
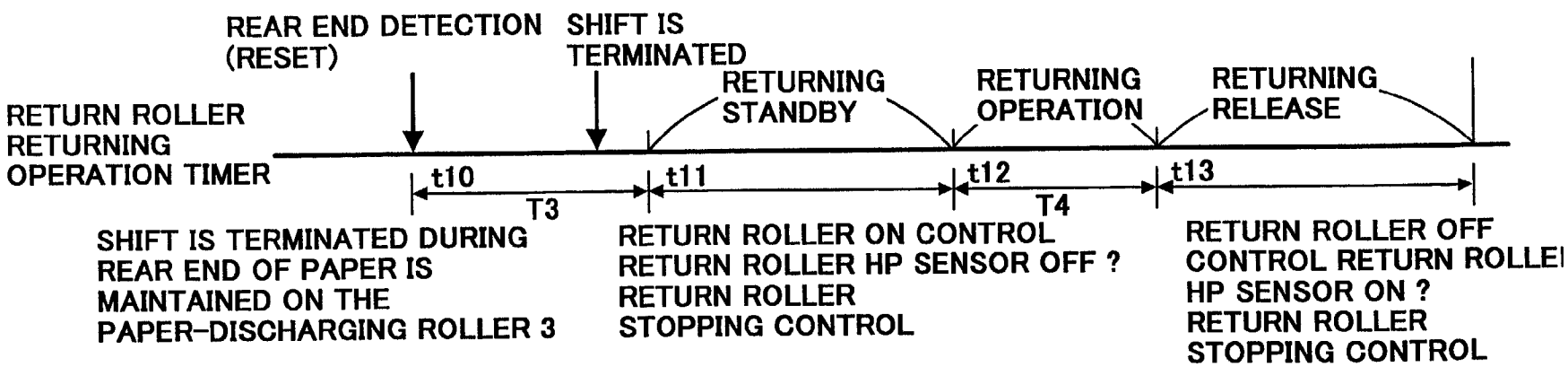

In the sequence to this point, the return roller returning operation timer starts to count the time T3 at the time t10 when the paper/discharging sensor 38 detects the rear end of paper (FIG. 42(B)).

(3) Return Roller Compressing Control

The return roller compressing control will be explained with reference to FIGS. 35 and 36. In STEP P29, the return roller compressing operation a proceeds to STEP P30, as its setting has already been completed in STEP P11. Because each flag is maintained in the reset condition in STEP P30, STEP P31, and STEP 32, the lapse of time T1 by means of return roller compressing operation timer is monitored in STEP P33, and at a point of time t2 after the lapse of time T1 (FIG. 42(A)), standby for compressing is started for compressing papers already piled on the tray 12 with the return roller 121. At this point of time t2 after lapse of T1, the leading end of discharged paper, which is still the leading paper of operation, is not in the state that it is in contact with the top surface of already piled papers.

In standby of compressing by means of return roller, the return roller 121 is started to move by means of the return roller ON control (STEP P34) for initiating the movement of return roller 121 from the home position (I) to the compressing/returning position (II). Also, as the return roller ON movement initiating flag is set (STEP P35) and the stepping motor 126 of FIG. 25 starts to move, the sensor 127 is turned to OFF (STEP P36), and as it moves to a predetermined amount to move the return roller 121 to compressing/returning position (II), the stepping motor 126 is stopped (STEP P37). At a point of time t3 when the such a standby is terminated and the return roller 121 reaches to the compressing/returning position (II), the leading end of discharged paper is not still in contact with the top surface of already piled papers (FIG. 41(C)).

As the return roller 121 is not required to be rotated because it merely compresses previously piled papers when executing compressing operation, it is possible to control the return roller 121 to stop rotation.

After time T1 has passed since the paper-discharging sensor 38 detected the leading edge of paper, and furthermore the return roller 121 has moved from the home position (I) to the compressing/returning position (II), the leading end of discharged paper, which is the leading paper of operation, is brought into contact with the top surface of previously piled papers.

Since the distance required for the return roller 121 to move from the home position (I) to the compressing/returning position (II) is constant and thus the required time is already known, it is possible to move the return roller 121 into the compressing/returning position (II) before the leading end of paper get into contact with the previously piled papers. In expectation of the standby time required for such a moving operation of return roller, the time T1 is established (FIG. 41(D)))

At the point of time t3 when the standby for compressing has terminated and the return roller 121 has moved to the compressing/returning position (II) (see FIG. 42(A)), the return roller ON movement initiating flag is reset (STEP P38), the return roller ON movement terminating flag is set (STEP P38), and furthermore the return roller compressing operation timer is reset (STEP P39), whereby the count of time T2 is started by the return roller compressing operation timer. Until the time T2 lapses, the leading end of discharged paper is fed out from the paper-discharging roller 3 while being brought contact with the top surface of previously piled papers. At a point of time to after the lapse of time T2, the rear end of paper is still maintained on the paper-discharging roller 3. The time T2 is established to meet with such a maintained condition.

At the point of time t4 that the T2 lapses, the rear end of paper is still maintained on the paper-discharging roller 3 and the leading end of paper is in contact with the top surface of previously piled papers but only a few amount for pushing out previously piled papers are remained. And, unless the tray is shifted in the state that the rear end of paper is maintained on the paper-discharging roller 3, it is impossible to position the leading edge to the next job position.

Figure 41A:
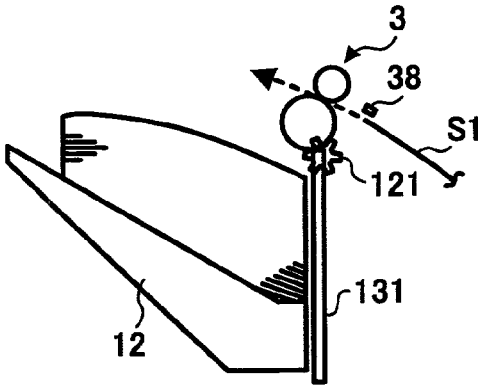
FIG. 41(A) illustrates front end detection by means of a sensor.
Figure 41B:
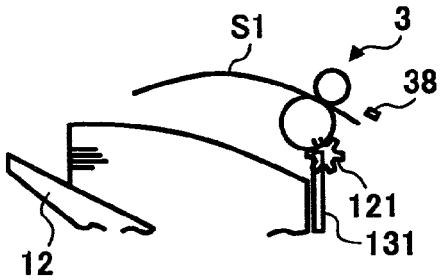
FIG. 41(B) illustrates rear end detection.
Figure 41C:
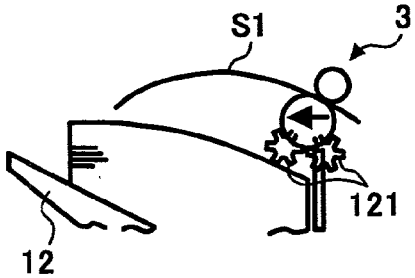
FIG. 41(C) illustrates shift of the return roller to a pressing/returning position.
Figure 41D:
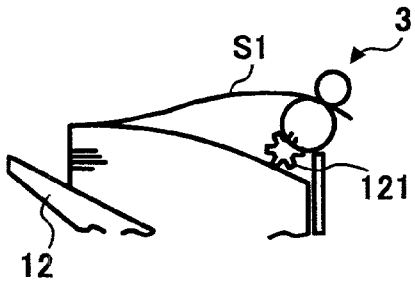
FIG. 41(D) illustrates pressing state by means of the return roller.
Figure 41E:
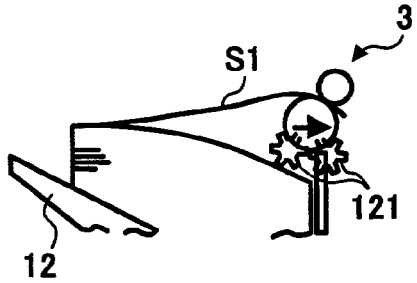
FIG. 41(E) illustrates a state that the return roller is shifted to a home position.

Therefore, at the point of time that the time T2 lapses, the compression by means of the return roller 121 is released, and if the time T2 has lapsed (STEP P40), the return roller 121 starts to move from the compressing/returning position (II) toward the home position (I) (STEP P41, FIG. 41(E)), the return roller ON movement terminating flag is reset, the return roller OFF movement initiating flags set (STEP P42), the sensor 127 detects and checks whether the return roller 121 reaches to the home position (STEP P43) and then stops the stepping motor 126 (STEP P44), and the return roller compressing operation flag and return roller OFF movement initiating flag are reset (STEP P45).

(4) Shift Control

The shift control will be explained with reference to FIG. 37.

Figure 32A:
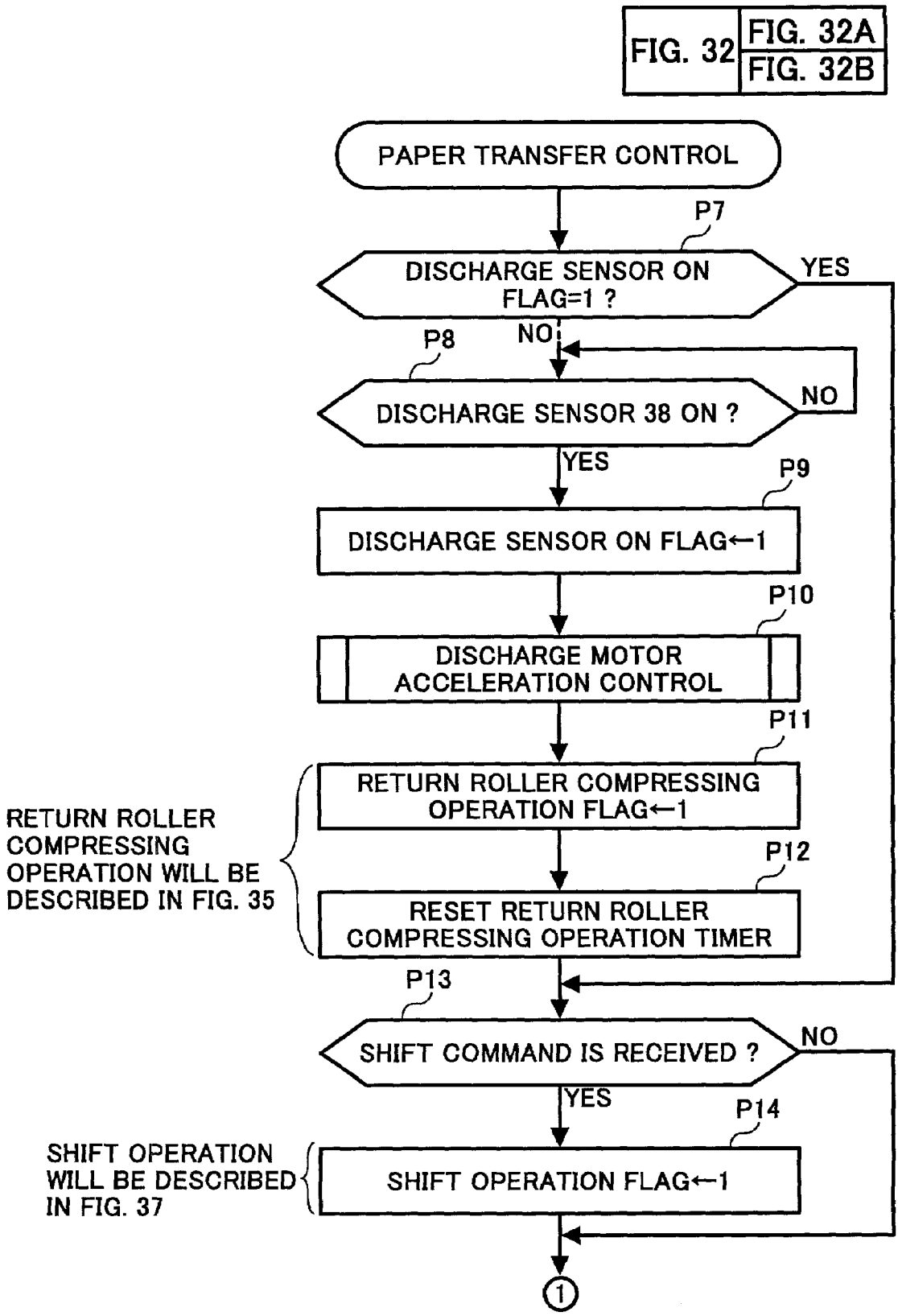
FIG. 32 is a flowchart illustrating paper conveyance control according to the first embodiment of the present invention.
Figure 32B:
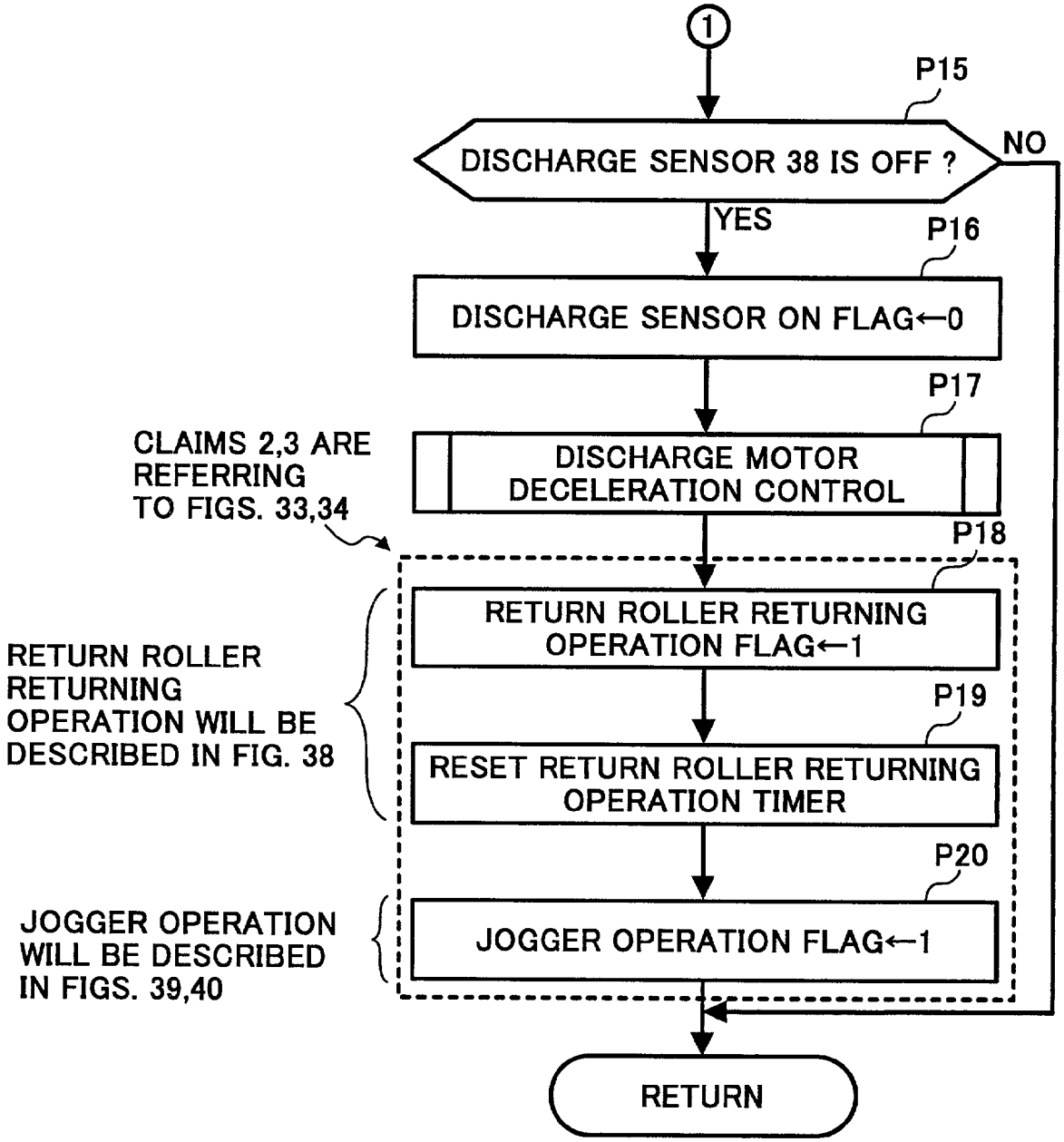
Figure 37:
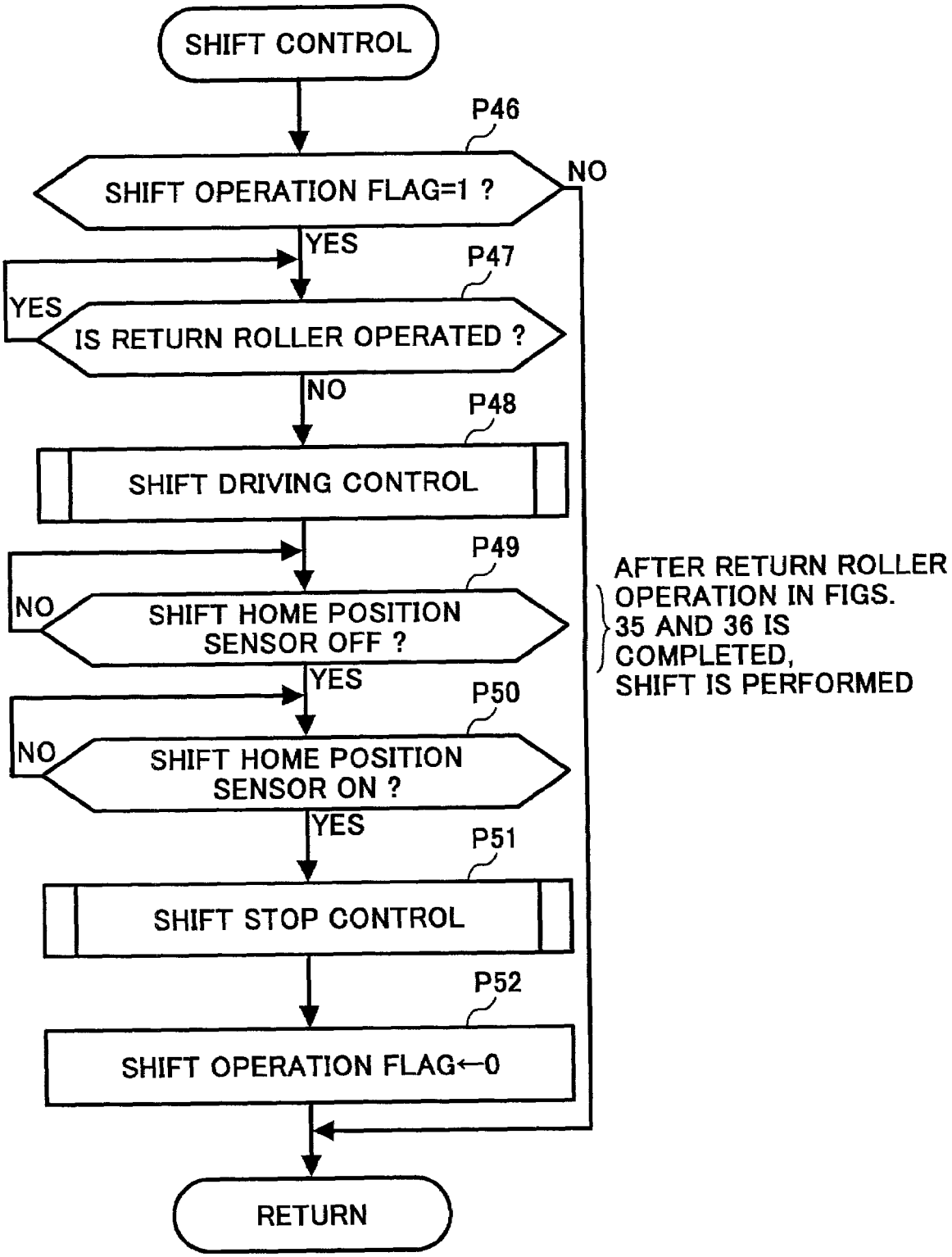
FIG. 37 is a flowchart relating to shift control according to the first embodiment of the present invention.

Because the shift operation flag is set to 1 in STEP P14 as illustrated in FIG. 32, it proceeds from STEP P46 to STEP P47 in FIG. 37, it is checked whether the return roller 121 is moving toward the home position (I) or not, and if not moving, it proceeds to STEP P48 and drive control is executed by driving motor 44 illustrated in FIG. 6.

The tray 12 moves from one side to the other side of shift direction d, and the home sensor 48 is turned to OFF and then turned to ON (STEP P49, STEP P50). That is, the tray 12 shifts to the shift direction d while the rear end of leading paper is maintained on the paper-discharging roller 3, whereby the leading paper offset by a predetermined amount from the papers previously piled in the prior job (FIG. 41(E)).

If the home sensor 48 is ON, the motor is stopped to execute shift stopping control in STEP 51 and the shift operation flag is reset (STEP P 52).

(5) Return Roller Returning Control

Figure 38:
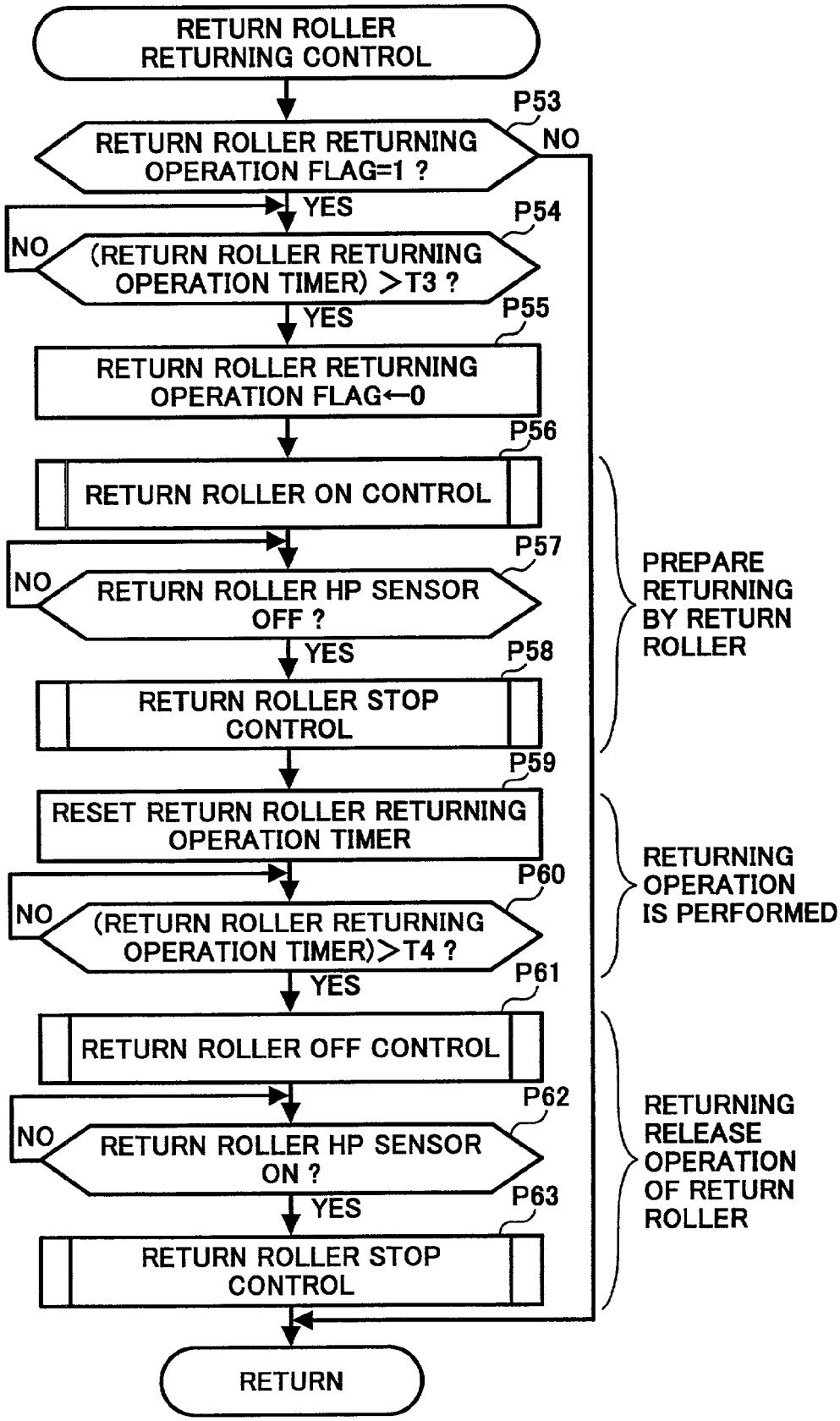
FIG. 38 is a flowchart relating to return control of the return roller according to the first embodiment of the present invention.

Herein, the returning control in which the paper S1 discharged on the tray 12 is returned to abut against the end fence 131 by the return roller 121 is executed. In FIG. 38, the return roller returning operation flag has already been set to 1 in STEP P18, STEP 53 proceeds to STEP P54, and it is checked whether the counting time of return roller returning operation timer lapses T3 from the point of time t10 or not. Time T3 is the time lapsed from the point of time t10 of return roller returning operation timer reset (STEP P19) accompanied with detection of rear end of leading paper in STEP 15 of FIG. 32, and the shift of tray 12 is terminated under the condition that the rear end of leading end of job is still maintained on the paper-charging roller 3 during the time interval until the time T3 lapses. Also, in FIG. 42(B), the shift of tray 12 is terminated during the time interval and the leading paper of job drops on the tray 12 (FIG. 41(F)).

Referring to FIG. 38, at a point of time t11 after the lapse of time T3 in STEP P54, the return roller 121 is rotationally driven in the direction for returning the paper, and at the same time the return roller 121 moves to the home position (I) to the compressing/returning position (II) as a standby operation (see STEP P55, STEP P56, STEP P57, and STEP P58).

That is, the return roller returning operation flag is reset in STEP P55, the return roller 121 is started to move by the starting of stepping motor 126 in STEP P56, and if there is the detection of sensor 127 in STEP P57, the stepping motor 126 is stopped in STEP P58 (STEP P58). Referring to FIG. 42(B), the return roller 121 has arrived at the compressing/returning position (II) at the point of time t12 (FIG. 41(G)).

In this point of time t12, like return roller returning operation timer is reset and counting of T4 is initiated (STEP P59), and at the same time, the leading paper is returned to the end fence 131 by the return roller 121. The time T4 is a sufficient time required for the rear end of paper to be collided against the end fence 131 to be collated by the return roller 121, and from the point of time t13 after the lapse of time T4 (STEP P60), the return roller 121 moves from the compressing/returning position (II) to the home position (I), whereby the returning function is released (STEP P61, STEP P62, STEP P63).

(6) Jogger Control

Description will be made with reference to FIGS. 30 and 40. In STEP 64, because the jogger operation flag has already set to 1 in STEP 20, it proceeds to STEP P65. In STEP P65, STEP P66, and STEP P67, because each flag is in the reset state in STEP P1, it proceeds to STEP P68, and the inward movement control for inwardly moving the jogger, i.e., arranging members 102*a*, 102*b* is executed in STEP P69 on condition that the returning operation of return roller is terminated. For example, this operation corresponds to the operation shown in FIG. 21(*b*).

The inward jogger movement initiating control flag is set in STEP P70 and then the termination of jogger movement (corresponding to the arranging position shown in FIG. 11) is checked in STEP P71, and if Yes, the inward jogger movement initiating flag is reset and the inward jogger movement terminating flag is set in STEP P72 and count of time T5 is started by resetting the jogger operation timer in STEP P73. This time T5 is time for the condition of arranging members 102*a*, 102*b* in the arranging position for the purpose of stably arranging the papers.

If the time lapses in STEP P74, the arranging members 102*a*, 102*b* are outwardly moved and opened in STEP 75, the inward jogger movement termination flag is reset and the outward jogger movement initiating flag is set in STEP P76, and then if it is judged that the arranging members 102*a*, 102*b* have moved to the receiving position shown in FIG. 10 in STEP P77, the jogger operation flag and outward jogger movement initiating flag are reset in unison in STEP P78.

Also, because the shift command signal is not received in STEP P13 when a paper, which is not the leading paper of job, is discharged, the shift of tray 12 is not executed but the returning, compressing and arranging operations equal to those explained in the above are executed.

Like this, according to the control of this embodiment, the return roller is operated to compress the piled papers when a paper is discharged, thereby preventing the piled papers from being pushed out in the discharge direction, and after the discharged paper drops on the tray, the discharged paper is returned to the end fence by the rotational movement of return roller and then lateral arrangement is performed by the arranging members, whereby arranging and sorting operations can be preferably executed regardless of the curled condition or piled condition of papers.

Reliable arranging and sorting are possible, but on the other hand, when executing the sorting, time for sorting operation is needed and if the discharge interval is short, it is required to lengthen the paper interval only at the time of sorting operation, whereby the productivity becomes reduced. Meanwhile, because the arranging operation can be synthetically performed at the time of discharging succeeding papers even if the arranging operation is not executed for each sheet of papers, if the arranging operation is omitted for the leading paper of job at the time of sorting operation, it becomes possible to supplement arranging operation for the paper when arranging the second paper or thereafter.

Based on this thoughts in the other control according to the present invention, arranging operation is omitted at the time of sorting operation, so that the time needed in the operation can be reduced, whereby a drop in productivity can be prohibited.

Each flow shown in FIGS. 31, 32, 35, 36, 37, 38, 39 and 40, in which the flow surrounded by a dotted line in FIG. 32 is constructed in substitution of the flow surrounded by a dotted line in FIG. 83, is used for control according to the present invention.

Figure 33:
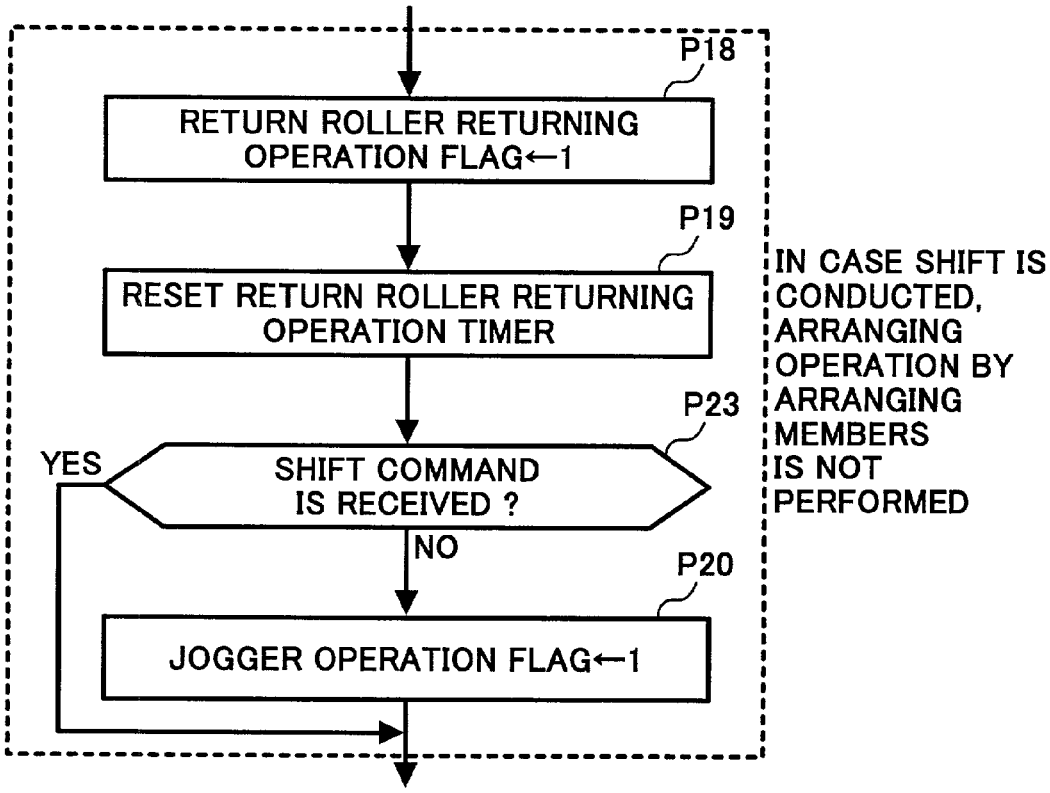
FIG. 33 is a flowchart relating to operations of the return roller according to the first embodiment of the present invention.
Figure 39:
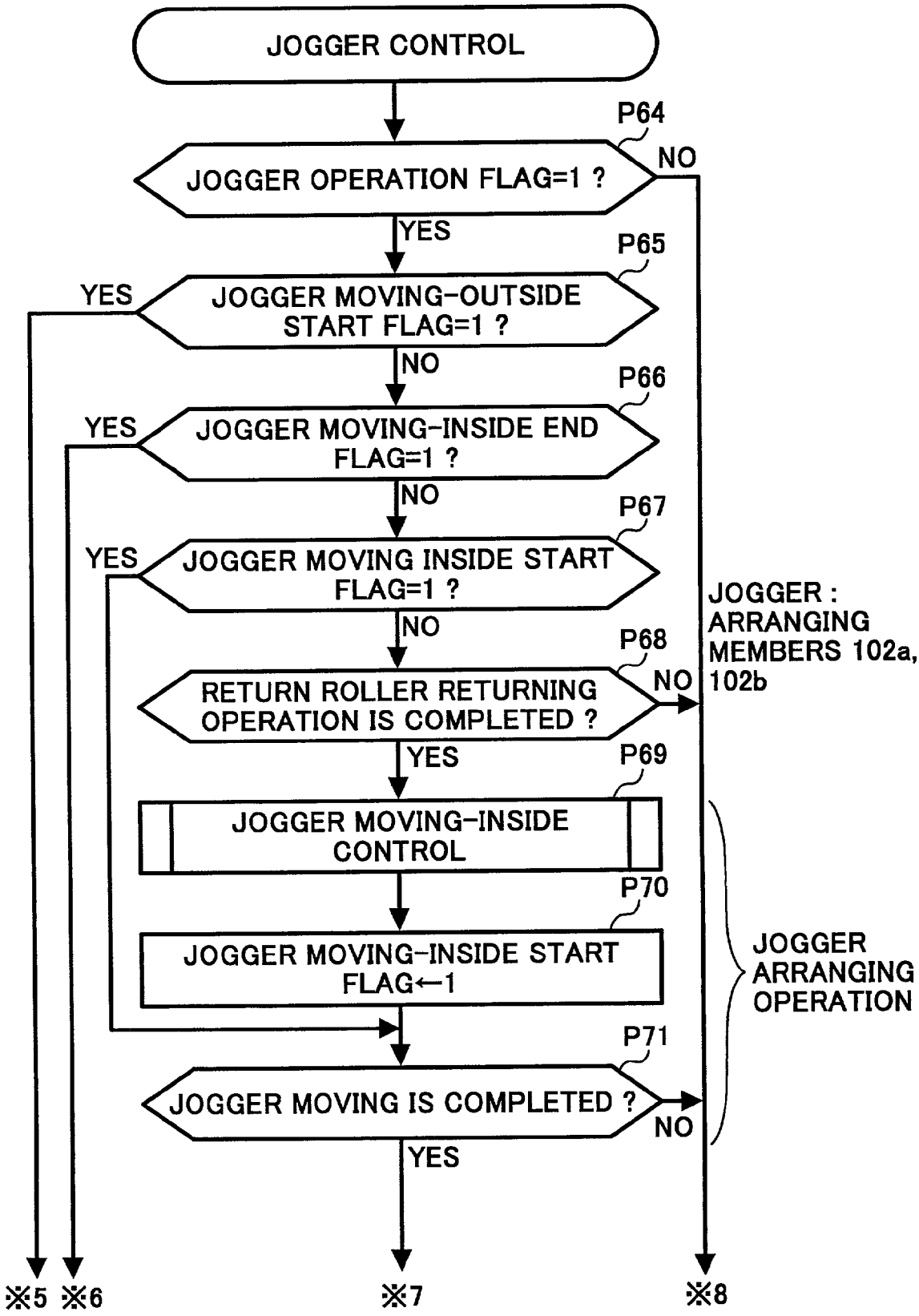
FIG. 39 is a flowchart relating to jogger control according to the first embodiment of the present invention.

For the leading paper in the job for executing the sorting, because it proceeds to the "yes" direction in checking the "is shift command signal received" of STEP P23 and the jogger operation flag of STEP P20 is not set, as shown in FIG. 33, it is judged as "no" in STEP P64 in FIG. 39, whereby it is returned and arranging operation by means of the arranging members is omitted.

Meanwhile, because sorting is not executed for the papers other than the leading paper of job, it proceeds to "no" in the check of "is shift command received" of STEP P23 in FIG. 38 and "jogger operating flag" is set in STEP P20, so that in FIG. 39 it proceeds from STEP P64 to "yes", whereby arranging operation by means of arranging members 102*a*, 102*b* is performed.

According to this control, the arranging operation by means of arranging members 102*a*, 102*b* is omitted or the leading paper of job at the time of sorting operation, whereby processing time can be shortened and thus a drop in productivity can be prohibited.

Because later arrangement for the leading which have not undergone the arranging operation is executed together with the arranging operation of second sheet of papers, it is possible to maintain the quality of arrangement in a level equivalent to that of prior art.

If the discharging interval is further reduced, returning operation is omitted for the leading paper of job at the time of sorting operation and the return roller is rotated in the compressing operation at the time of discharging next paper to provide returning operation for the leading paper at the same time, whereby processing time can be shortened and thus an increase in productivity can promoted.

Figure 34:
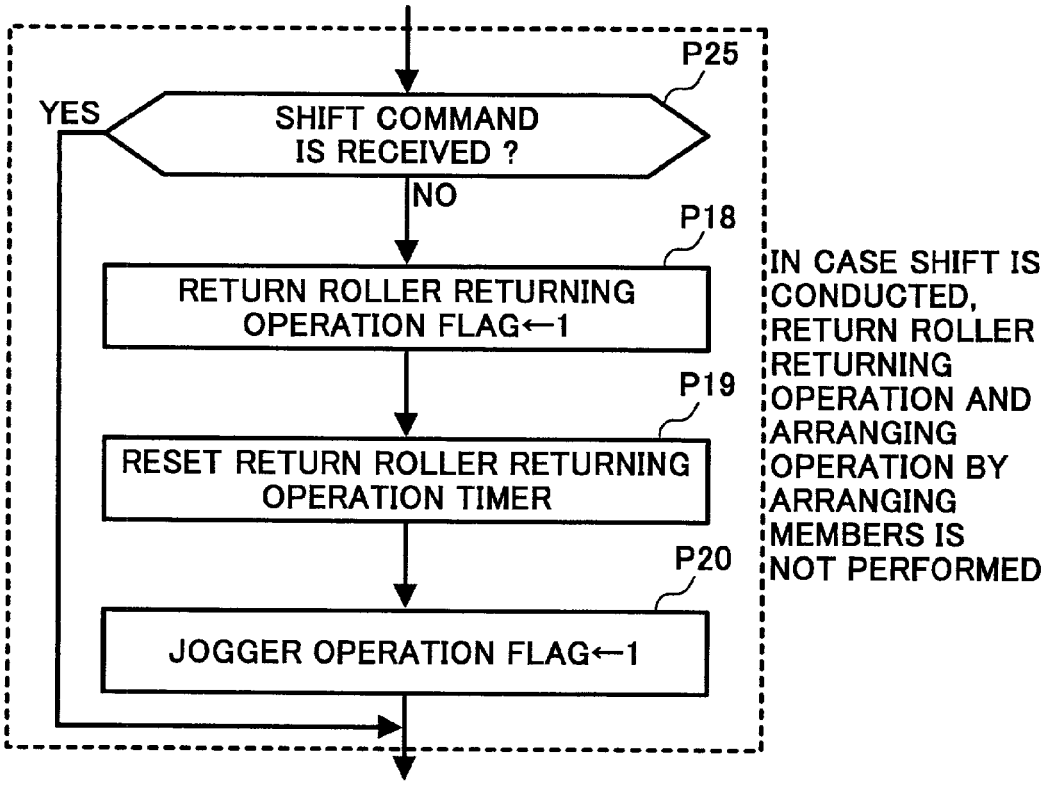
FIG. 34 is a flowchart similar to FIG. 33.

Each flow shown in FIGS. 31, 32, 35, 36, 37, 38, 39 and 40, in which the flow surrounded by a dotted line in FIG. 32 is constructed in substitution of the flow surrounded by a dotted line in FIG. 34, is used for control according to the present invention.

Figure 40:
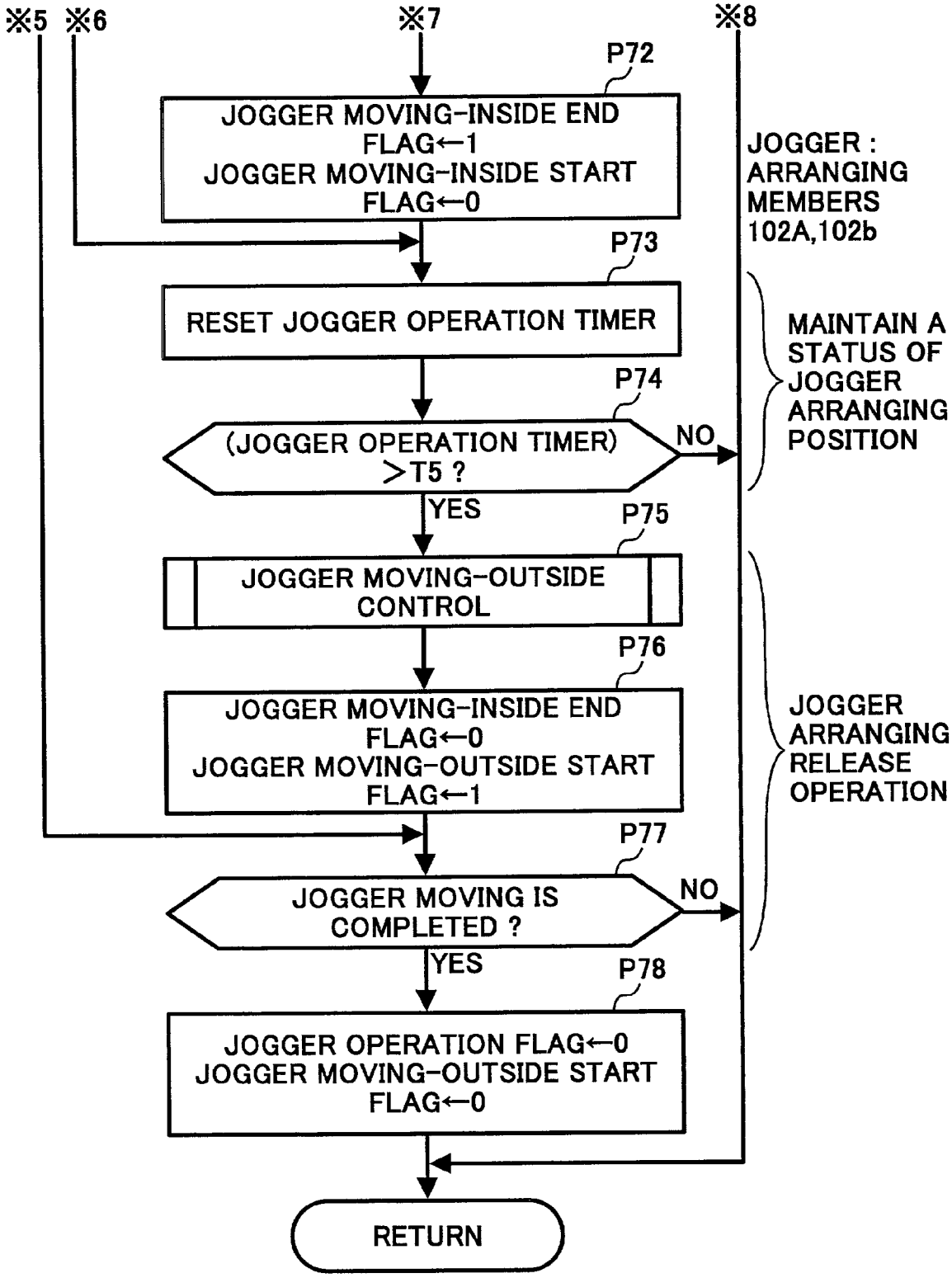
FIG. 40 is a flowchart successive to FIG. 39.

For the leading paper in the job for executing the sorting, because it proceeds to the "yes" direction in checking the "is shift command signal received" of STEP P25 of FIG. 34 and "return roller returning operation flag" of STEP P18 and "jogger operation flag" are not set, the return roller returning operation in FIG. 38 and the arranging operation by means of arranging members in FIGS. 39 and 40 are omitted.

Meanwhile, because there is no "is shift command received" in the papers other than the leading paper of job in STEP P13, shift operation flag of STEP P14 is not set, and because they become "no" in STEP P37, no sorting is executed, it proceeds to "no" in the check of "is command signal received" of STEP P25 in FIG. 34, and "return roller returning flag operation flag" of STEP 18 and "jogger operating flag" of STEP P20 are set, whereby the returning control of return roller in FIG. 38 and arranging operation by means of arranging members 102*a*, 102*b* in FIG. 39 are performed.

According to the control of ts embodiment the return roller returning operation and the arranging operation by means of arranging members are omitted for the leading paper of job at the time of sorting operation, whereby a drop in productivity can be prohibited because processing time can be shortened.

The omitted return roller returning operation is supplemented by the return roller compressing operation which also serves as returning operation. Accordingly, in the present embodiment, the return roller 121 is made to be rotationally driven in the return direction at the time of compressing operation. Also, the arranging operation for the leading paper of job by means of arranging members 102*a*, 102*b* is simultaneous with the second sheet of papers, the equivalent accuracy can be obtained.

Other examples of control are as follows.

Figure 29:
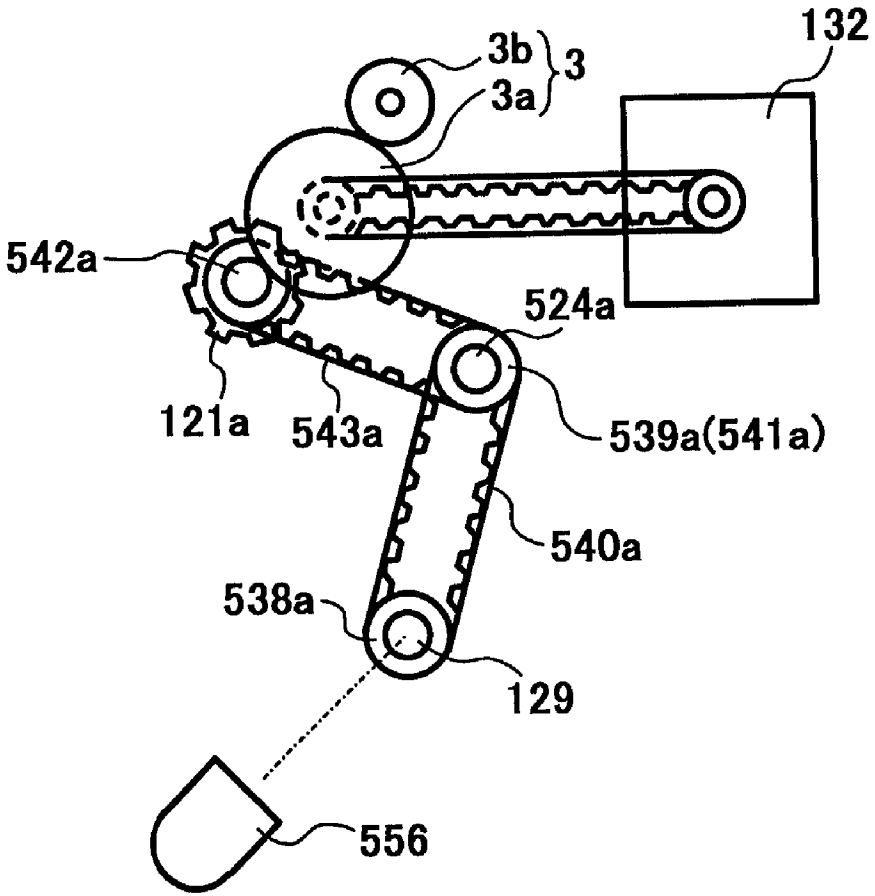
FIG. 29 is a front view illustrating the driving systems of the return roller and the paper-discharging roller.

Because the return roller 121 has a construction to be driven or stopped by a driving source separated from the paper-discharging roller 3 as illustrated in FIG. 29, it is possible to execute the compressing function by stopping the rotation at the time of compressing operation, and it is also possible to execute the returning operation at the time of functioning the compression by continuing the rotation as needed.

Although each example illustrated in FIGS. 31 to 40 is explained in connection with the return roller 121, it is correspondingly applicable to the return roller 121 of FIG. 23.

(Example Applied to Image Forming Apparatus)

Figure 43:
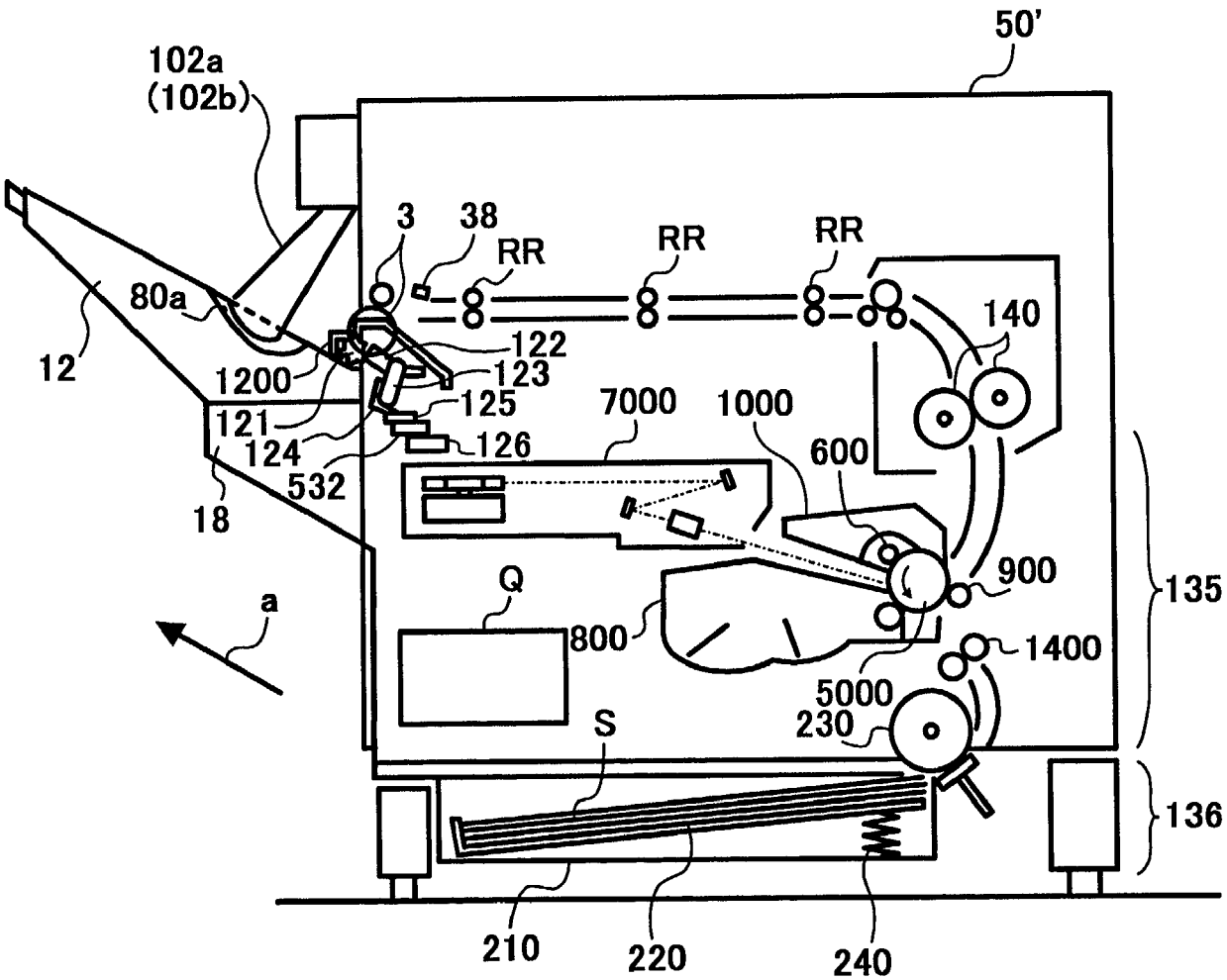
FIG. 43 schematically illustrates structure of an image forming apparatus to which the present invention is adapted.

This embodiment relates to an image forming apparatus provided with an imager forming means for forming image on a paper and a conveyance means for conveying an image-formed paper, wherein the image forming apparatus 50 shown in FIG. 43 comprises an image forming means which is common to the image forming apparatus 50 of FIG. 3. This image forming apparatus 50 comprises arranging members 102*a*, 102*b* and means for driving them, a return roller 121, and means for displacing it.

Also, the image forming apparatus 50 has members common to constituent elements of sheet-shaped medium after-treatment apparatus 51 shown in FIG. 3, and those members awe indicated by referential numerals same with those used in FIG. 8 and description will be omitted Referring to FIG. 43, an image forming part 135 is located substantially in the center portion of main body of apparatus and a paper feeding part 136 is located just below the image for part 135. The paper feeding part 136 includes a paper-feeding cassette 210.

It is possible to provide a manuscript reading apparatus (not shown) in the upper part of the image forming apparatus 50 as required. The upper part of image forming part 135 is provided with a roller RR, a guide plate, and the like as means for conveying an image-formed sheet.

The image forming part 135 is provided with an electric equipment unit Q for electrically driving or controlling the apparatus. Furthermore, a drum-shaped photo conductor 5000 is located therein, in the circumference of this photo conductor 5000, there are provided with an electrifying device 600 for electrifying the surface of photo conductor 5000, an exposure device 7000 for illuminating the surface of photo conductor with laser light, a development device 800 for visualizing an electrostatic latent image illuminated and formed on the surface of photo conductor 5000, a transfer device 900 for transferring the visualized toner image vitalized on the photo conductor 5000, a cleaning device 1000 for removing and recovering toner remained on the surface of photo conductor after transferring, and the like, respectively.

The photo conductor 5000, electrifying device 600, exposure device 7000, development device 800, transferring device 900, cleaning device 1000 and the like forms main parts of the image forming means. A fixing device 140 is located approximately upper side of the photo conductor 5000 and downstream of the photo conductor 5000 in the paper conveyance passage.

If the image forming apparatus functions as a printer, an image signal is inputted when forming an image. The photo conductor 5000 is uniformly electrified by the electrifying device 600 in the dark. Exposure light is illuminated on the uniformly electrified photo conductor 5000 by the light-emission of a laser diode LD (not shown) of exposure device 7000 and arrives at the photo conductor via a well-known polygonal mirror on the basis of the image signal, whereby an electrostatic latent image is formed on the surface of photo conductor 5000.

This electrostatic latent image is moved with the rotation of photo conductor 5000, turned to a visualized image by the development device 800, and then additionally moved and directed toward the transfer device 900.

Meanwhile, unused sheets are received in the sheet-feeding cassette 210 of sheet-feeding part 136 and a bottom plate 220 pivotally supported is adapted to be urged by a spring 240 so that the paper S placed on the bottom plate 220 is compressed against a sheet-feeding roller 230.

When a paper is fed for transfer, the sheet-feeding roller 230 rotates, thereby the paper S is fed out from the sheet-feeding cassette 210 and conveyed to a pair of resist rollers 1400.

The conveyance of paper sent to the resist rollers 1400 is temporally stopped here. The resist rollers 1400 start conveyance of sheets after timing is performed so that the positional relation between the toner image on the surface of photo conductor 5000 and the leading end of paper S is set to be suitable for image transfer in the transfer position on which the transfer device 900 is installed.

The image-transferred paper is fixed with a toner image while it passes through the fixing device 140. The paper that passed through the fixing device 140 is conveyed by the roller RR, which is a conveyance means, passed by the discharging sensor 38, and then discharged from the discharging roller 3 to the tray 12.

Because the constructions and functions for collating the sheets by means of displacement means such as the return roller 121, the driven lever 122, the driving lever 123 and the like hereinafter are same with those explained in the aforementioned examples, description will be omitted.

Also in the image forming apparatus of this example, collation by the return roller 121, the arranging members 102*a*, 102*b* and the like and sorting by the sorting means are also performed to the sheets S piled on the tray, whereby it is possible to arrange sheet-shaped mediums in a high accuracy.

<Second Embodiment>

In this embodiment, the sheet-shaped treatment apparatus (1) may be constructed as a sole apparatus, or (2) may be used in the integrated or connectedly combined form with the other apparatus having a sheet-shaped medium discharging means, for example, an image forming apparatus which does not have arranging function, a sheet-shaped medium after-treatment apparatus which does not have arranging function and sorting function, and the like, whereby it can arrange sheet-shaped mediums in order on a tray by means of the arranging function, returning function, and compressing function.

Furthermore, it is possible to perform sorting by means of sorting function as needed.

Firstly, referring to the displacement of return roller 121, the return roller which is normally placed in the home position (I), is displaced to said compressing/returning position (II) to retain the previously piled papers in the regular position by compressing operation before a paper which is in the course of being discharged is brought into contact with the top surface of the previously piled papers, then returned to the home position (I), and after the paper which is in the course of being discharged drops on the tray 12, the return roller 121 is displaced to the compressing/returning position (II) again to cause the dropped paper to be collided against and collated with the end fence 131 by means of returning operation, and then the arranging members 102*a*, 102*b* arrange the papers in order by means of arranging operation.

This displacement is executed in such a manner that the return roller 121 follows a mountain-shaped tracing according to a cam shape, in which the return roller 121 is lowered from the upper side onto the rear side of papers and contacts with the top surface of papers, stays at the position for an optional time, and either compresses the previously piled papers or returns them to the end fence 131 by a rotational force. At the time of compressing operation, it is possible to stop the rotation of return roller 121.

a. Outline of Control

In following examples of controls, although description is made with reference to the return roller 121 of FIGS. 24 to 29, the control to said return roller 121 also applies correspondingly to the return roller 121 of FIG. 23.

As shown in FIG. 3, the examples of controls are the examples of arranging, returning and sorting controls of papers executed under the entire construction in which a sheet-shaped medium after-treatment apparatus 51 is connected to an image forming apparatus 50, and the sheet-shaped medium after-treatment apparatus 51 is provided with sheet-shaped medium treatment apparatus according to the present invention. The arranging operation will be explained based on the case of both side-movement mode aforementioned in reference to FIG. 18*b*.

b. Control Circuit

Referring to FIG. 30 showing a control cit of control means, CPU 700 exchanges information with ROM 710 in which a control program is stored, and implements the control indicated in each of flowcharts to be explained below by inputting a clock signal from a clock 720.

The stepping motor control driver 740 controls various stepping motors used in the sheet-shaped medium after-treatment apparatus 51 and sheet-shaped medium treating apparatus according to the present invention, and in particular various stepping motors appeared in the flowchart to be explained below correspond to them. In FIG. 30, they are illustrated by a symbol M.

The motor driver 750 controls various DC motors used in the sheet-shaped medium after-treatment apparatus 51 and sheet-shaped medium treatment apparatus according to the present invention, and in particular various motors appeared in the flowchart to be explained below correspond to them. In FIG. 30, they are illustrated by a symbol M. CPU 700 is adapted to exchange information with the control means (CPU) 50PU of image forming apparatus 50.

The driver 760 controls various solenoids used in the sheet-shaped medium after-treatment apparatus 51 and sheet-shaped medium treatment apparatus according to the present invention, and in particular various solenoids appeared in the flowchart to be explained below correspond to them. In FIG. 30, they are illustrated by a symbol SOL. CPU 700 in FIG. 30 is a main part for performing the flow to be explained below and forms the core of control means in the present invention.

<Examples of control>

(1) Premise

Referring to FIG. 3, a paper conveyed from a discharging roller 560 of the image forming apparatus 50 to a sheet-shaped medium after-treatment apparatus 51 is received by a pair of inlet rollers 1, passed through a pair of conveyance rollers 2*a* and a pair of conveyance rollers 2*b*, and discharged to a tray 12 by a discharging roller 3 which is final conveyance means. At that time, branch claws 8*a*, 8*b* continuously maintain a default position and sheets are sequentially passed one by one through a same conveyance passage and discharged onto the tray 12.

Figure 31:
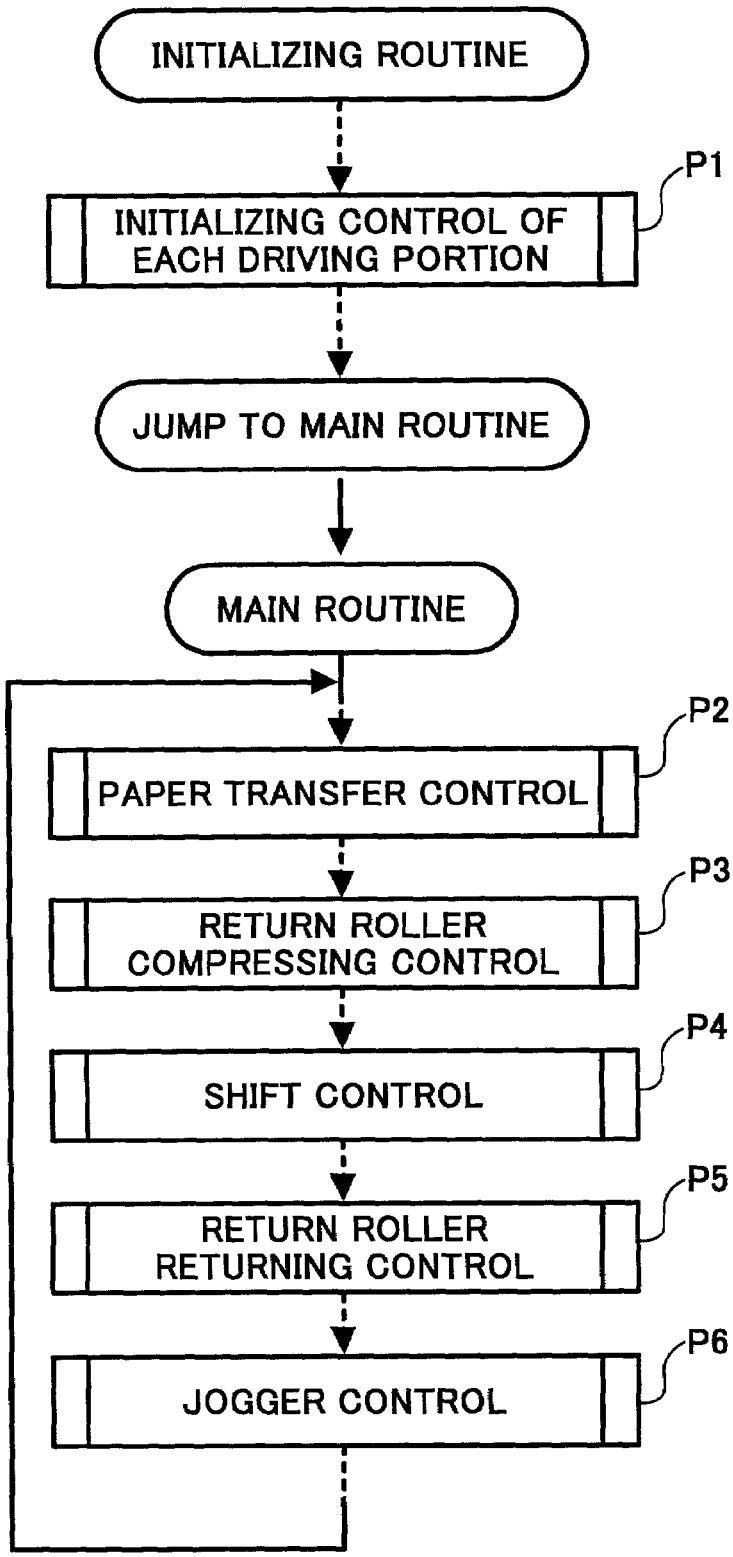
FIG. 31 is a flowchart illustrating a routine according to the first embodiment of the present invention.

Following flowcharts show only the parts related to the present invention in the sheet-shaped medium after-treatment apparatus. If the main switch, which generally controls the image forming apparatus 50 and sheet-shaped medium after-treatment apparatus 51 of FIG. 3 is turned to ON and thus the sorting mode is selected, the initial routine and main routine thereafter shown in FIG. 31 are executed. In the initial routine, "initial control of each driving part" is executed in STEP P1, the arranging members 102*a*, 102*b* move to the home position shown in FIG. 9, and each flag is reset to 0. In addition, "jogger" on the flowcharts to be explained below means the arranging members 102*a*, 102*b*.

If STEP P1 is terminated, it jumps to the main routine. In the main routine, "paper conveyance control" of STEP P2 (See FIG. 32 for details), "return roller compressing control" of STEP P3 (See FIGS. 35 and 36 for details), "return roller returning control" of STEP P4 (See FIG. 38), "jogger control" of STEP P5 (See FIGS. 39 and 40) are sequentially executed and returned to the main routine.

(2) Paper Conveyance Control

The paper conveyance control will be described with reference to FIG. 32.

As paper-discharging sensor ON flag is 0 in STEP P7 (STEP P1), it proceeds to STEP P8, and if paper discharging sensor 38 detects the leading end of paper S1 (FIG. 41(A)), the paper-discharging sensor ON flag is set to 1 (STEP P9) and acceleration control of the stepping motor 132 which is the paper-discharging roller for driving the paper-discharging roller 3 is executed in order to reduce the time (STEP P10), and the return roller compressing operation flag is set in STEP P11 and at the same time, the return roller compressing operation timer is reset in STP P12.

In the sequence to this point, the return roller compressing operation timer starts to count time T1 simultaneously at the time when the paper-discharging sensor 38 detects the leading end of paper. Time T1 to be taken for counting is used in STEP P33 in the flowchart shown in FIG. 35.

With waiting for the rear end of paper S1 being passed through the paper-discharging sensor 38, if the rear end of paper have passed through the paper-discharging sensor 38 (STEP P15, FIG. 41(B)), it executes deceleration control of stepping motor 132, which is the paper-discharging motor, after setting the paper-discharging sensor ON flag to 0, in order to stabilize a landing position on the tray 12 (STEP P17).

The return roller returning operation flag is set in STEP P18, t he return roller returning operation timer is reset (SEP P19), and jogger operation flag is set (STEP P20).

In the sequence to this point, the return roller returning operation timer starts to count the time T3 at the time when the paper-discharging sensor 38 detects the rear end of paper. Time T3 to be taken for counting is used in STEP P54 in the flowchart shown in FIG. 38. Furthermore, by setting the jogger operation flag, arrange operation in the flowchart shown in FIGS. 39 and 40 is executed.

(3) Return Roller Compressing Control

The return roller compressing control will be explained with reference to FIGS. 35 and 36. In STEP P29, the return roller compressing operation flag proceeds to STEP P30, as its setting has already been completed in STEP P11. Because each flag is maintained in the reset condition in STEP P30, STEP P31, and STEP 32, the lapse of time T1 by means of return roller compressing operation timer is monitored in STEP P33, and at a point of time t2 after the lapse of time T1, standby for compressing is started for compressing papers already piled on the tray 12 with the return roller 121. At this point of time after lapse of T1, the leading end of discharged paper S1, which is still the leading paper of operation, is not in the state that it is in contact with the top surface of already piled papers.

On preparing press by return roller 121, the return roller 121 starts to move by return roller-on control (step P34) in which the return roller 121 is displaced from home position (I) toward press/return position (II). Also, by setting return roller on movement initiation flag (step P35), and actuating the stepping motor 126 shown in FIG. 25, the sensor 127 is turned off (step P36), moved a certain amount, and the return roller 121 is moved to the press/return position (II) and the stepping motor 1216 is stopped (step P37). At the time when the preparation is completed and the return roller 121 has arrived at the press/return position (II), a leading end of a sheet being discharged is not yet in contact with top surface of sheets already piled (FIG. 41(C)).

After a time T1 passed after sheet discharge sensor 38 detected a leading end of a sheet, and after the return roller 121 moved from the home position (I) to press/return position (II), the leading end of a sheet S1 comes in contact with top surface of the piled sheets. In this manner, the return roller 121 executes press function. Since the moving distance of the return roller 121 from the home position (I) to the press/return position (II) is always the same, the required time is predictable and the return roller 121 can be moved to the press/return position (II) before the leading end of the sheet comes in contact with the piled sheets. The time T1 is set based on calculation of preparation time required for the return roller to move as above (FIG. 41(D)).

On completion of preparing the press function, by resetting We return roller-on movement initiation flag with the return roller 121 being at press/return position (II), setting a return roller-on movement end flag (step P38), and resetting return roller press operation timer (step P39), a time T2 begins to be counted by the return roller press operation timer. For the time T2 elapses, discharge sheet S1 is discharged from discharging roller 3.

When the time T2 has elapsed, the sheet S1 almost lost its operation of extruding the piled sheets. Upon passing of the time T2, press by the return roller 121 is released, and after the time T2 elapsed (step 40), the return roller 121 starts to move from the press/return position (II) to the home position (I) (step P41, FIG. 41(E)), return roller-on movement end flag is reset, return roller-off movement initiation flag is set (step P42), arrival of the return roller 121 at the home position is checked by detection of sensor 127 (step P43), thereafter, stepping motor 126 is stopped (step P44), and return roller press operation flag and return roller-off movement initiation flag are reset (step P45).

(4) Return Roller Returning Control

Return control by return roller where a sheet S1 discharged onto tray 12 is returned by the return roller 121 until it collides against end fence 131 is executed. In FIG. 38, at step P53, since the return roller return operation flag is already set to 1 via step P18, it proceeds to step P54, and counted time of return roller return operation timer is checked whether it exceeds a time T3 at the time of step P19 in which rear end of the sheet S1 passes the discharge sensor 38.

Figure 41F:
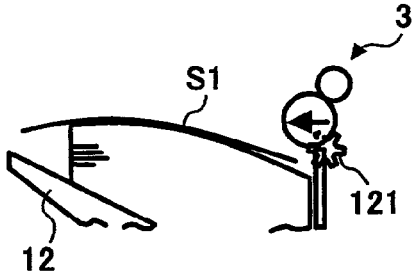
FIG. 41(F) illustrates a state that paper is dropped.
Figure 41G:
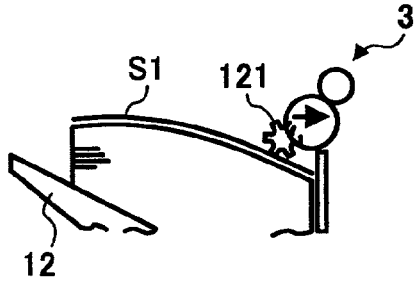
FIG. 41(G) illustrates a state that paper is being returned by the return roller.

Before the time T3 elapses, the sheet S1 falls onto the tray 12 FIG. 41(F)).

In FIG. 38, at step P54, upon passing of the time T3, the return roller 121 is rotated in the direction of returning the sheet, while the return roller 121 is moved from the home position (I) to the press/return position (II) as a return preparing operation (steps P55, P56 and P57).

Specifically, at step P55, the return roller return operation flag is reset, at step P56, return roller 121 begins to be moved by actuating the stepping motor 126, and if detection by sensor 127 takes place at stop P57, the stepping motor 126 is stopped through step P74 (step P58). At this time, the return roller 121 already arrived at press/return position (II) (FIG. 41(G)), and it starts returning operation for the sheet S1 to be returned toward the end fence 131.

At step P57, upon detection by the sensor 127, the return roller return operation timer is reset, and a time T4 is counted (step P59), and when the time T4 elapsed (step P60), the return roller 121 is moved from press/return position (II) to home position (I) so that the returning function is removed (steps P61, P62 and P63). The time T4 is set as a sufficient time for the rear end of the sheet to be collated with the end fence 131 by the return roller 121. In this manner, the return roller 121 is returned to home position (I), and thereafter, a jogger control is started.

(5) Jogger Control

Now, a jogger control will be explained referring to FIGS. 39 and 40. At step P64, since jogger operation flag is already set to 1 via step P20, the process goes on to step P65. Since each flag remains in the same condition as reset state in step P1 at steps P65, P66 and P67, the process goes to step P67, and under the condition that the return roller return operation is completed, inward movement control is executed where the jogger, i.e., arranging members 102*a*, 102*b*, is moved inwardly through step P69. This operation corresponds to, for example, the operation of FIG. 18*b*.

After jogger inward movement initiation flag is set via step P70, jogger movement end (set position shown in FIG. 11) is checked in step P71, and if "yes", jogger inward movement initiation flag is reset, and jogger inward movement end flag is set at step P72, and thereafter, a time T5 is counted by jogger operation timer reset at step P73. The time T5 is a time for retaining the arranging members 102*a*, 102*b* in arranged position, and is for arranging the sheet stably.

At step P74, when the time T5 elapsed, the arranging members 102*a*, 102*b* are opened by outward movement at step P75, jogger inward movement end flag is reset and jogger outward movement initiation flag is set at step P76, and thereafter, if the arranging members 102*a*, 102*b* are confirmed to arrive at the receiving position shown in FIG. 10 at step P77, jogger operation flag and jogger outward movement initiation flag are reset together at step P78.

In accordance with the present invention, for example, if a transverse arrangement, which is an alignment in the shift direction d by the arranging members 102*a* and 102*b*, is executed after the longitudinal arrangement, which is an alignment in the conveying direction a by the return roller 121, is completed, although the longitudinal arrangement by return roller 121 was completed, the longitudinal arrangement may be disarrayed by the transverse arranging operation by the arranging members 102*a*, 102*b*. The extent of disarray of longitudinal arrangement due to transverse arranging operation by arranging members is proportional to offset of sheet discharge position from center position, because moving distance of sheets by arranging operation of the arranging members is directly proportional to the offset.

On continuous discharge, since press operation is executed by the return roller to prevent the next sheet from extending the piled sheet after the transverse arranging operation by arranging members 102*a*, 102*b*, such a pressing operation re-arranges the aforesaid disarray of longitudinal arrangement caused by the arranging members. However, for the last sheet, the pressing operation is omitted since there remains no subsequent sheet. Thus, for the last sheet, there is a possibility that the longitudinal arrangement will be disarrayed by the transverse arranging operation by arranging members 102*a*, 102*b*.

Thus, according to the present invention, more preferable arrangement is attained by an additional longitudinal arrangement by return roller 121 after transverse arrangement for the last sheet. In the control embodiments of the present invention, the initial routine of FIG. 46 may be substituted for the initial routine of FIG. 31.

Figure 46:
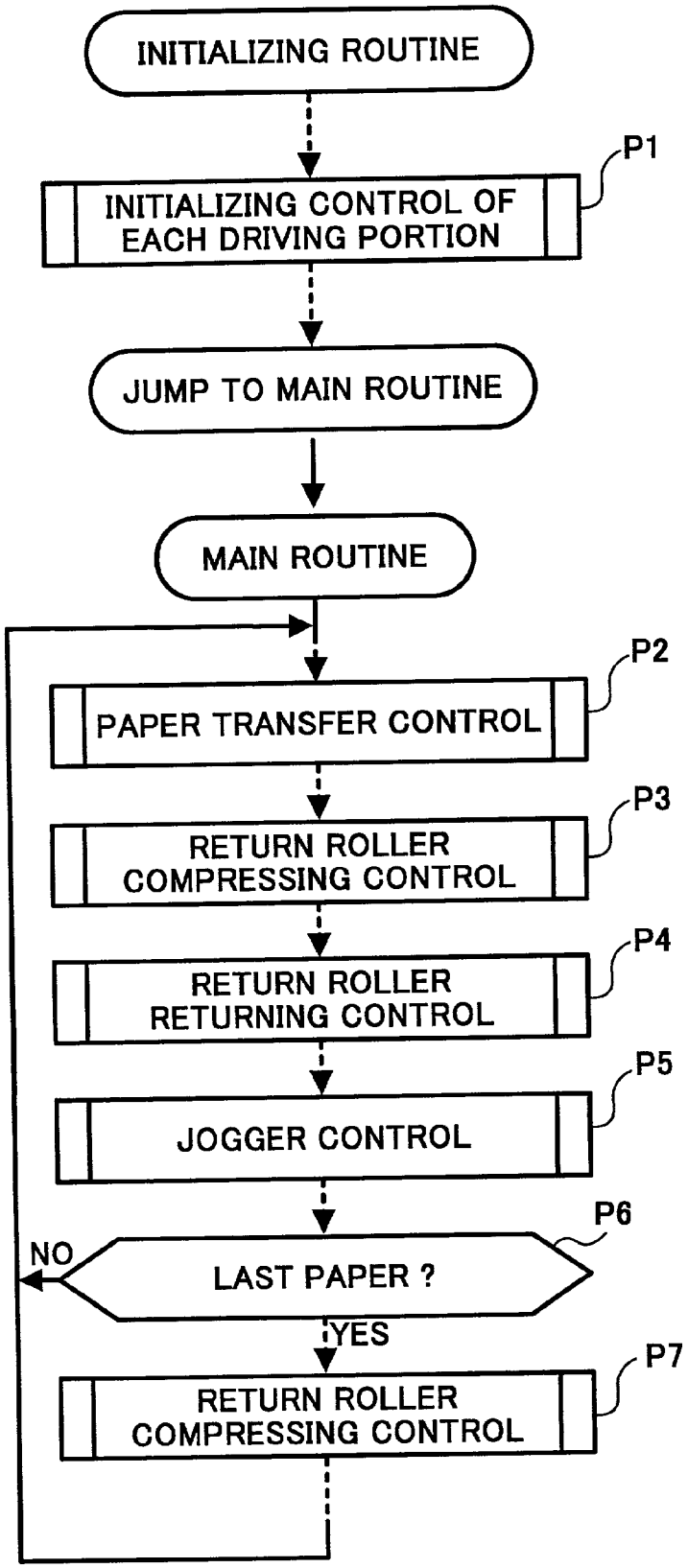
FIG. 46 is a flowchart illustrating a routine in a second embodiment of the present invention.

The characteristic of the flowchart shown in FIG. 46 is that steps P6 and P7 are added after the step P5. That is, only if the sheet for which arranging operation by arranging members 102*a*, 102*b* is done is the last sheet, ream roller return control illustrated in FIGS. 35 and 36 is executed again at step P7 so that the last sheet is returned until it collides against end fence 131. Thereby, longitudinal and transverse arrangements are performed for all the sheets discharged onto the tray 12, attaining a good arrangement.

Figure 35:
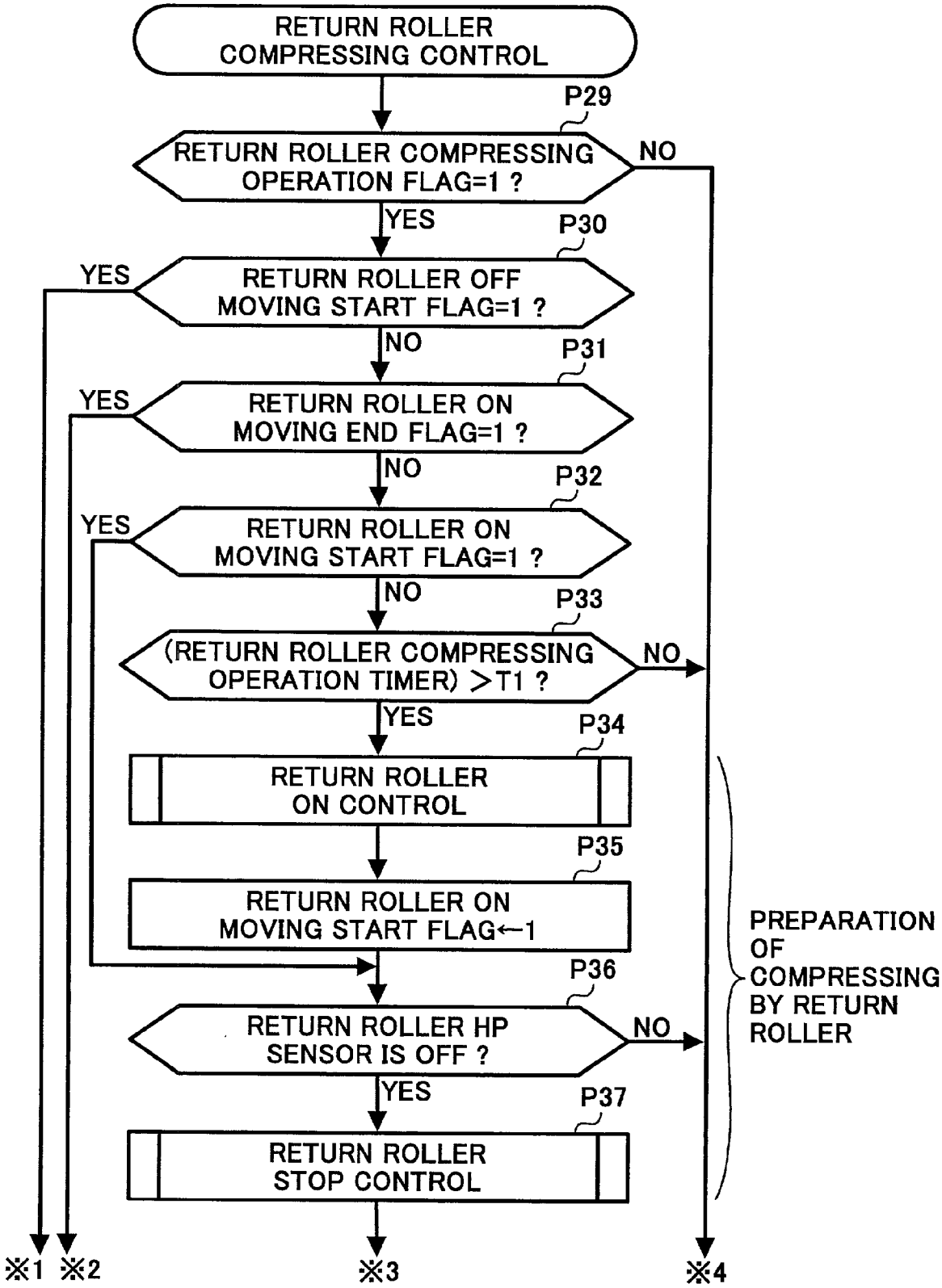
FIG. 35 is a flowchart relating to pressing control of the return roller according to the first embodiment of the present invention.
Figure 36:
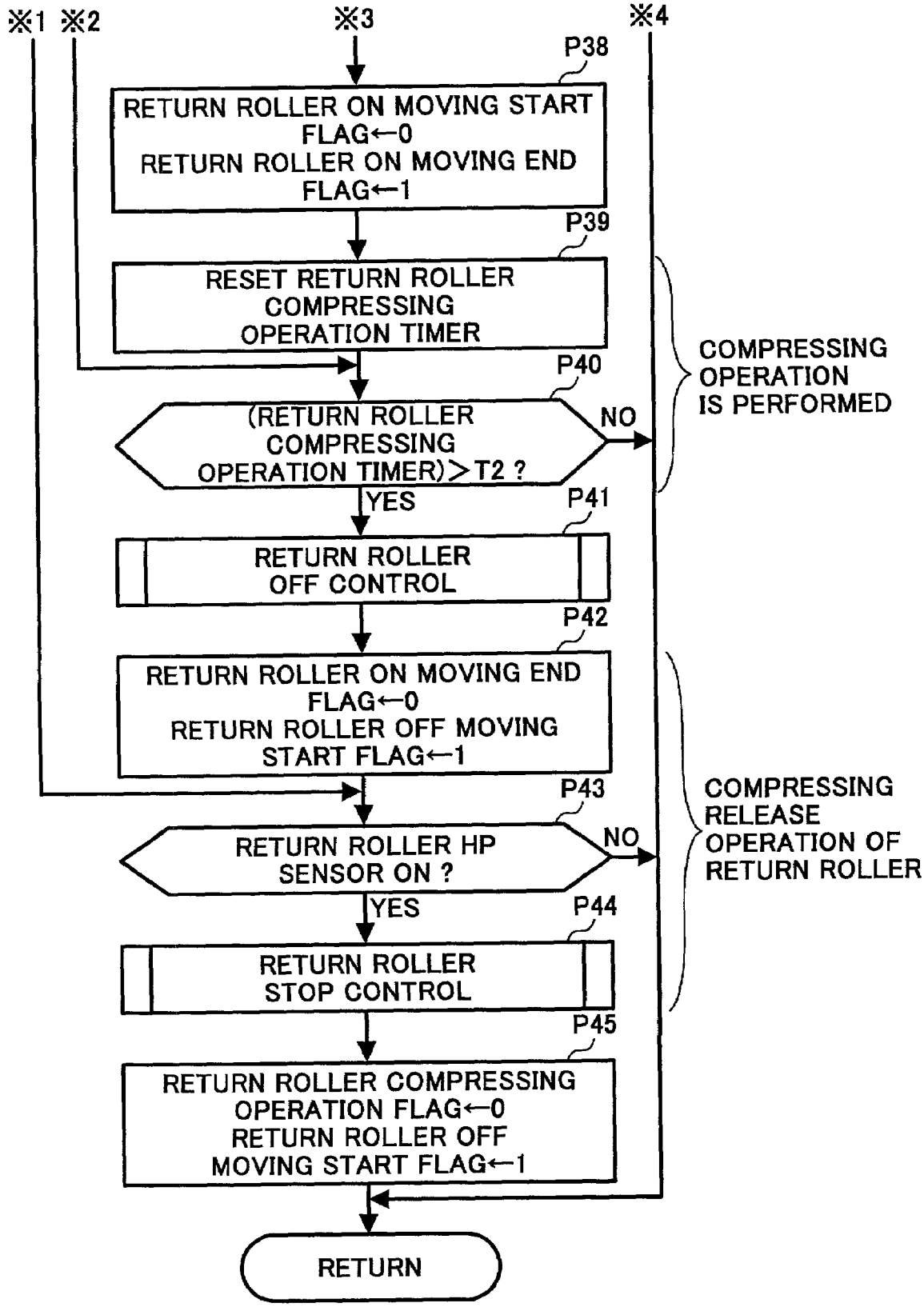
FIG. 36 is a flowchart successive to FIG. 35.

For an example of control according to the present invention, if the return roller 121 keeps rotating without stopping during return roller return control in FIGS. 35 and 36, pressing operation by the return roller 121 does correct disarray in longitudinal arrangement caused by arranging operation by arranging members 102*a*, 102*b*. However, such a pressing operation by the return roller may cause the sheet arranged by the arranging members 102*a*, 102*b* to be somewhat disarrayed in the transverse direction (shift direction d) this time.

Therefore, the adverse effect of disarrays in the arrangement due to the arranging members 102*a*, 102*b* and the return roller 121 is removed by overlapping the timing for transverse arrangement by arranging members 102*a*, 102*b* with the timing for pressing by return roller 121 for a certain amount of time. In this manner, a good arrangement according to the present invention is realized.

Figure 47:
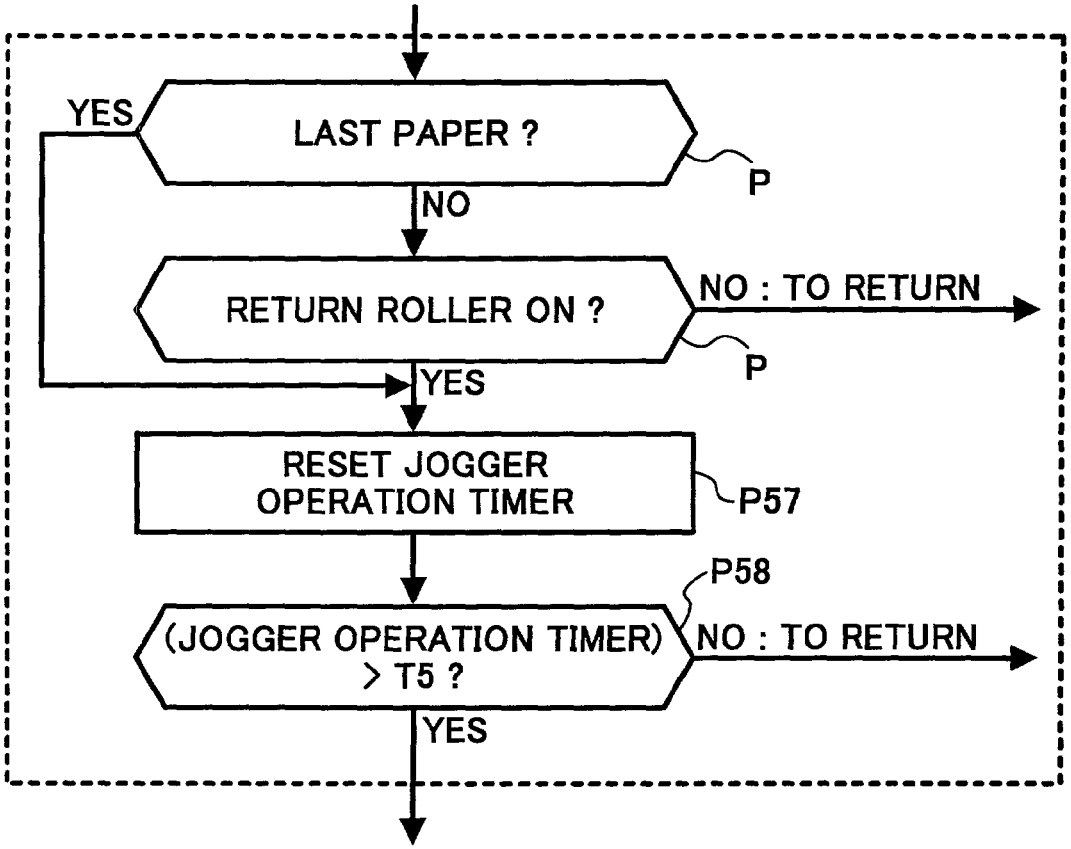
FIG. 47 is a flowchart relating to the return roller according to the second embodiment of the present invention.

In the flowchart illustrated in FIGS. 39 and 40, a control relating to the present invention is executed by substituting the broken lined portion with a broken lined portion in FIG. 47. Hereinafter, the substituting contents will be explained.

For any sheet other than the last sheet, in FIGS. 39 and 40, since the arranging members 102*a*, 102*b* execute alignment by their inward movement at step P69 and stay as they are to be "no" at step P80 of FIG. 47, the process goes on to step P81. At step P81, since the return roller 121 is at home position (I), "no" is selected to do return, and the leading end of the next sheet is detected by discharge sensor 38 at step P8 in sheet convey control of FIG. 32. When the time T1 elapses (step P33), the return roller is moved to press/return position (II), thereby the process goes to step P73 at step 81 of FIG. 47 to reset a counting timer for a time T5 through jogger operation timer reset. At step P74, by elapse of the time T5, the process goes on to step P75 to open the arranging members 102*a*, 102*b*.

As such, since the arranging members 102*a*, 102*b* already support arranging position (see, FIG. 11) through their inward movement when the return roller 121 goes to press, piled sheets are never disarrayed in the transverse direction even though the return roller 121 contacts with the piled sheets by pressing operation.

For the last sheet, since no more sheet is discharged onto the tray 12, the process goes to step P73 in which jogger operation timer is reset and the time T5 begins to be counted without undergoing step P81 of FIG. 47, and upon passing of the time T5 in step P74, arranging members 102*a*, 102*b* are opened in step P75.

Here, by setting the relation between the time T5 for which the return roller presses piled sheets (step P40) and the time T5 for which the arranging members stay inside such that T5<T2, jogger or return roller can have time in which it solely acts on the sheets.

In a control according to the present invention, for example, there is a need for jogger control for the first sheet (see, FIGS. 39 and 40) and return roller press control for the second sheet (see, FIG. 35) to be executed simultaneously.

Therefore, for the execution of each operation in parallel, its subroutine is omitted once during waiting time of the timer and so on, and when the subroutine is executed again, as indications for the execution at the same position, "return roller-on movement initiation flag", "return roller-on movement end flag", and "return roller-off movement initiation flag" in FIGS. 35 and 36, or "jogger inward movement initiation flag", "jogger inward movement end flag", and "jogger outward movement initiation flag" in FIGS. 39 and 40 are established.

As a control example of the present invention, since discharge roller 3 is driven or stopped by a separate driving source as described referring to FIG. 29, the return roller 121 can carry out press function by stopping its rotation during press operation, and also can carry out return function by keeping its rotation during press function as necessary.

Each example of control illustrated in FIGS. 30 through 40, 46 and 47 is described for return roller 121, however, the description can also be applicable to return roller 121 of FIG. 23.

<Examples Applied to an Image Forming Apparatus>

The present embodiment relates to an image forming apparatus comprising image forming means for forming an image on a sheet and conveyance means for conveying the sheet on which an image has been formed, wherein the image forming apparatus 50' shown in FIG. 43 has a common image forming means with image forming apparatus 50 in FIG. 3. The image forming apparatus 50' has arranging members 102*a*, 102*b* and means for driving the same, and further, has return roller 121 and means for moving it. In addition, the image forming apparatus 50, has the same elements as those of sheet-shaped medium after-treatment apparatus 51 shown in FIG. 3, and they are represented by similar reference numerals as in FIG. 3 and descriptions about them will be omitted.

In FIG. 43, image forming segment 135 is disposed at substantial center portion of main body of the apparatus, and sheet feed segment 136 is positioned beneath the image forming segment 135. The sheet feed segment 136 has sheet feed cassette 210.

<Third Embodiment>

A bundle of stapled sheets require to be arranged accurately because a piled bundle, which is aligned well, is easy to handle.

As described in FIG. 3, overall configuration of a sheet-shaped medium after-treatment apparatus 51 relating to the present embodiment is shown. In an image forming apparatus 50, image-formed sheet arrives at the sheet-shaped medium after-treatment apparatus 51. It can be selected whether to execute an after-treatment, and after-treated sheet or non after-treated sheet is arranged on tray 12.

Discharge roller 3 has upper roller 3*a* and lower roller 8*b*, wherein the lower roller 3*b* is rotatably supported on the free end of support member 66 which is upwardly/downwardly pivotably mounted with its upstream side in the sheet discharge direction a being supported. The lower roller 3*b* abuts against the upper roller 3*a* due to it own weight or energized force, and a sheet is discharged interposed between both the rollers.

Once the stapled bundle of sheet-shaped media, i.e., a bundle of papers are discharged, the support member 66 is pivoted upwardly, and returned at a predetermined timing. This timing is determined based on detection signal of discharge sensor 38. The discharge sensor 38 is disposed adjacent to upstream side of the discharge roller 3.

A paper guided into original staple route G is sent through a pair of conveyance rollers 4, detected by staple inlet sensor 37, and piled onto staple tray (not shown) by means of a pair of discharge rollers 68. In this case, longitudinal (sheet conveyance direction) alignment for every paper is performed by return roller 5, and transverse (a sheet width direction perpendicular to discharge direction a) alignment is performed by a pair of joggers 9 arranged opposed in the paper width direction. Between jobs, i.e., between the last paper bundle and the next paper bundle, filing processing is executed by driving a stapler 11 in response to staple signal from control means (not shown).

Return roller 5 does the swing motion of the pendulum about point 5*a* by solenoid (not shown), acts upon the sheet transported onto said staple tray intermittently to let the sheet collide with end fence. Although not shown, said pair of discharge rollers 68 has brush roller, thereby, the reverse flow of the rear end of the sheet is prevented. In addition, return roller 5 rotates counterclockwise. Heretofore, a general explanation for configuration and operation of sheet-shaped medium after-treatment apparatus is described.

In FIG. 4, a sheet-shaped medium after-treatment apparatus 51 comprises a discharge roller 3, a tray 12 on which sheets S discharged from discharge roller 3 are piled, a tray lifting means 95 for lifting the tray 12, positioning means 96 for controlling a position of lifting/lowering direction of tray 12, tray moving means as a sorting means for reciprocating the tray 12 in the shift direction d (piercing direction of paper plane of FIG. 3) perpendicular to the discharge direction a in FIG. 4, a return roller 121 as a returning means for arranging piled sheets on the tray 12 by colliding action with end fence 131, moving means for moving the return roller 121 in the discharge direction a, arranging members 102*a*, 102*b* as setting means, and driving means therefore.

In this manner, papers S on which image forming have been done are subsequently discharged and piled onto tray 12, and as a result, the top surface of the piled papers S gets higher. In the proximity of the return roller 121*a*, 121*b*, one end of paper surface lever 1200, which is pivotally supported out axis 73*a* shown in FIGS. 4(*a*) and (*b*), contacts with the top surface of the piled papers by its own weight, and the other end of the paper surface lever 1200 is detected by paper surface sensor 130*a* or 130*b* as a photo interrupter.

(Returning Means)

a. Configuration of Returning Means (1) THE FIRST EXAMPLE

Examples of return roller 121 as returning means and moving means for moving the return roller 121 in the discharge direction will be described.

In FIG. 23, return roller 121 is made from elastic material shaped as a sponge having convexo concave surface in order to exert a frictional force to return papers, and is supported on a shaft by moving body 500. Moving body 500 has L-shaped, shown in the front side, and upper part thereof is slidingly fitted to an elongated guide member 501 in the direction of movement. Return roller 121 is axially supported on moving body 500, and a pulley 502 is integrally disposed in a shaft integral with the return roller 121. Additionally, a motor 503 is fixed to the moving body 500, and a pulley 504 is fixed to the shaft of the body 500.

For the moving means in the embodiment, since the movement is performed using the engaging relation between rack and pinion, movement trajectory of return roller 121 is linear, and the return roller can be displaced between the first position (I) apart from tray 12 or top surface of piled sheets on tray 12 and the second position (II) which is located in the downstream from the first position (I) in the discharge direction a, which is in contact with the tray 12 or top surface of piled sheets on the tray 12, and which is a position where a sheet can be returned to end fence 131.

The return roller 121 includes the same or similar material as the return roller 121 described in the above example. Moving means for return roller 121*a* and moving means for return roller 121*b* have completely the same structure in their common portions. Then, for clarity of explanation, as to the common portions, symbol "a" is used for elements relating to the return roller 121*a* for which explanation will be described, and symbol "b" is used for elements relating to the return roller 121*b* for which explanation will be omitted.

On a shaft 528 supporting an eccentric cam 125, axial center portion of screen plate 531 notched semi-circularly is secured, and axial center portion of gear 532 is secured. A gear 533 is in engagement with the gear 532, and is adapted to be rotated by stepping motor 126 secured to supporting plate 527. Also, in a position where cut-out portion of screen plate 531 passes by, a sensor 127 is secured, and rotation amount of eccentric cam 125 is detected by detection information of screen plate 531 by the sensor 127, and stop control for stepping motor 126 is made possible.

Combination of sensor 127 and screen plate 531 constitutes an encoder, and the eccentric cam 125 is controlled by said encoder using the stepping motor 126 as a driving source. In this matter, by employing the combination structure of stepping motor and encoder, position of return roller 121*a* is controlled appropriately. For example, position of return roller 121*a* can be determined to be in the first position (I) and the second position (II), as shown in FIG. 28.

The first position (I) is in a waiting position of return roller 121 located upwardly from tray 12 or top surface of sheets piled on the tray 12, and can be set as a home position. The second position (II) is located in the downstream from the first position (I) in the discharge direction a, and can be a position where the return roller can be in contact with the tray 12 or the piled sheets on the tray 12.

b. Returning Operation

Now, a returning operation for moving the return roller 121 from the first position (I) to the second position (II) by a moving means configured as in FIGS. 24 to 26 will be described. The control for return roller 121 by moving means in FIG. 23 will not be described because it corresponds to the following description, and it is performed by rotation of motor 510.

FIG. 28, return roller 121 in the first position (I) is located adjacent to lower part of discharge roller 3, and is disposed opposed to center portion of the shift direction d (paper width direction) perpendicular to the discharge direction a.

As illustrated in FIGS. 27 and 28, return roller 121 moves from the first position (I) (home position) to the second position (II) (return position) indicated by alternate two-dot chain line, comes in contact with rear end of the sheet dropped onto tray 12, and, by means of the rotating force, performs collation of the rear end by returning the sheet to end fence 131.

Figure 48:
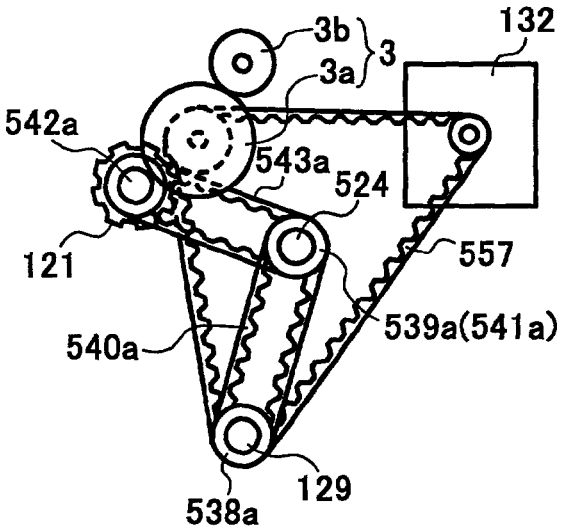
FIG. 48 is a front view illustrating a driving system when the driving sources of the return roller and the paper-discharging roller according to the third embodiment of the present invention are common.

Referring to FIG. 48, an exemplary configuration of rotating operation of return roller 121 will be explained As shown in FIG. 25, a pulley 542*a* is integrally formed in the return roller 121*a*, and a pulley 541*a* on axial portion 524 and belt 543*a* connects the pulley. Also, a pulley 539*a* coil and integral with the pulley 541*a* is connected to a pulley 538*a* on driving side via belt 540*a*.

As a result of rotation of belt 540*a* by pulley 538*a* integrally rotating with a shaft 129 connected to a driving source, pulleys 539*a*, 541*a* are rotated, thereby, pulley 542*a* is rotated via belt 543*a*, and the return roller 121*a* is rotated. The same is true of pulley 542*b*.

Here, belt 543*a* (543*b*) is received in a driven lever 122*a* (122*b*), and belt 540*a* (540*b*) is received in a driving lever 123*a* (123*b*). Such a configuration is the same as described referring to FIG. 25.

In the present embodiment, shaft 129 is adapted to rotate via belt 557 by stepping motor 132 that rotates lower roller 3*a* of driving side. Namely, stepping motor 132 that rotates discharge roller 3 also rotates the return roller 121.

Alternatively, rather than the dual use of the stepping motor 132 as described above, as shown in FIG. 29, a dedicated stepping motor 556, which rotates shaft 129, can also be employed.

In FIG. 48, since the stepping motor 132 is used dully, it is enough to use only one motor, whereas there is a defect that discharge roller 3 drive control and return roller 8 drive control can't be executed separately, however, if driving motors are installed separately as in FIG. 29, discharge roller 3 drive and return roller 3 drive can be controlled separately.

In either case, return roller 121 stays at the first position (I) until a sheet falls down onto tray 12 through discharge roller 3, and it moves to the second position (II) at a predetermined timing so that returning function is carried out.

Now, a configuration, in which an angle between driving lever 123 and driven lever 122 (engagement angle) is changed at the first position (I) and the second position (II), will be explained.

Engagement angle of the driven lever 122 and driving lever 123 as moving means for supporting and moving the return roller 121 is changed at the first stop position (I) and the second stop position (II) so that the moving distance of the return roller 121 can be enlarged.

Figure 49:
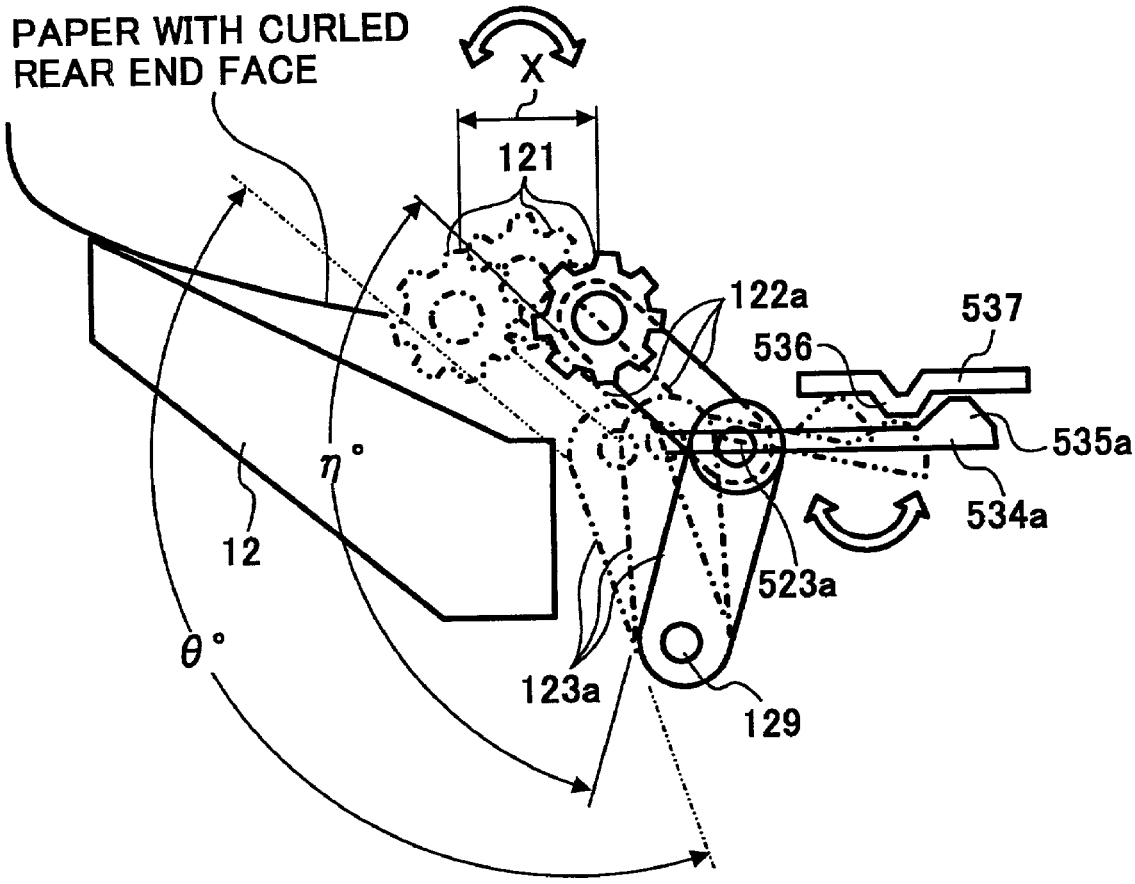
FIG. 49 is a front view illustrating an operating range of the return roller according to the third embodiment of the present invention.
Figure 50:
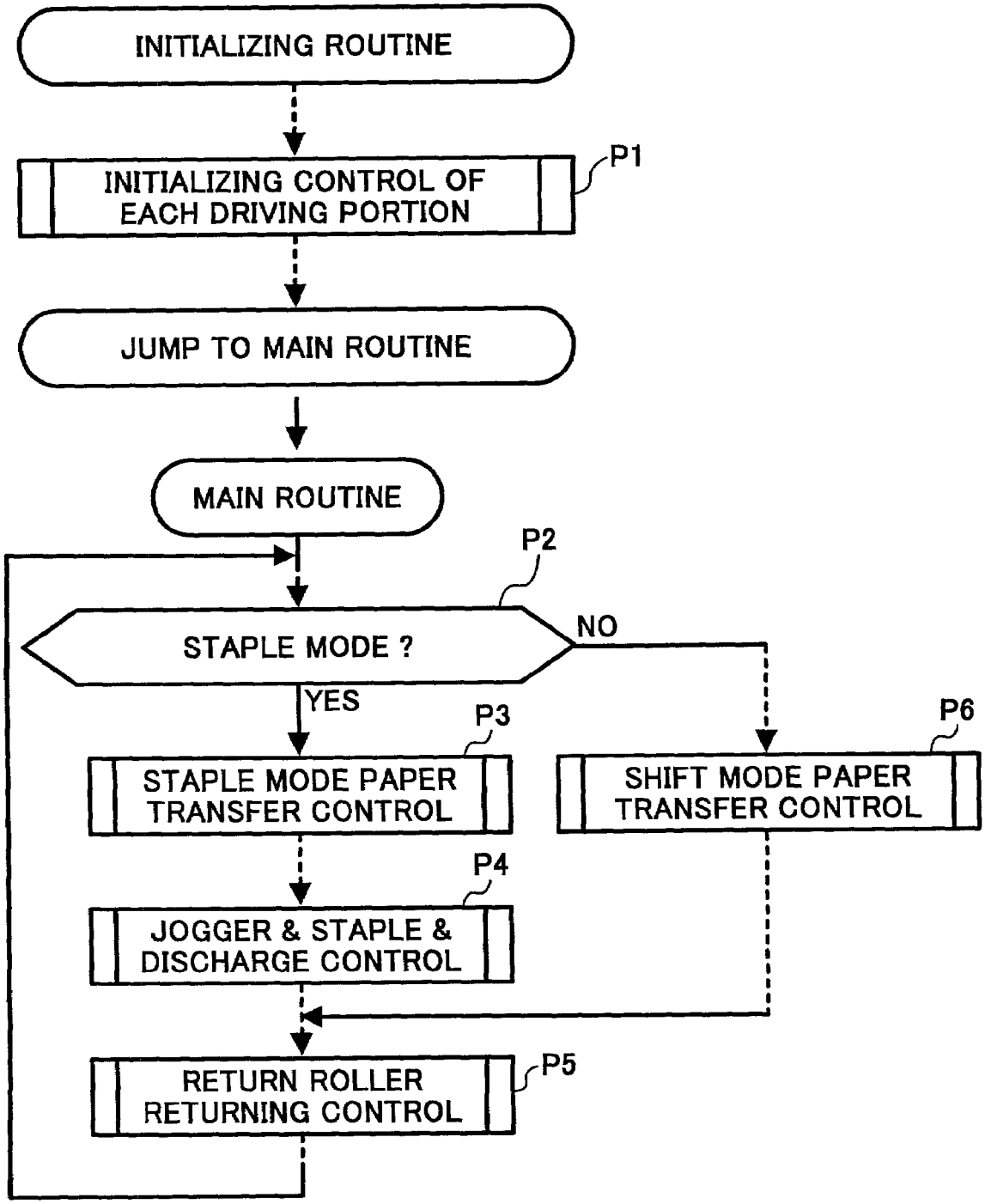
FIG. 50 is a flowchart illustrating a routine according to the third embodiment of the present invention.

As shown in FIG. 49, since engagement angle θ° of driving lever 123 and driven lever 122 at the second position (II) of the return roller 121 is bigger than engagement angle η° at the first position (I), if rotation angle about shaft 129 is the same, the moving distance X of the return roller 121 can be lengthened, compared to the case of install of the return roller 121 directly on driving lever 123.

By lengthening the moving distance X, especially in return function, it is assured that rear end of fallen paper on tray 12 comes in contact with the return roller 121, therefore, arrangement precision is improved. For example, even if the paper falls down on a remote position from the return roller 121 for any reason, the longer the moving distance becomes, the surer the contact with the rear end of the paper will be.

Here, swing amount of the driven lever 122 is determined by the characteristic of plate cam 537. Rotating amount of the driven lever 122 is controlled according to the extent of downward movement of protrusion 535*a* by protrusion 536 of plate cam 537 when the protrusion 535*a* slides along the plate cam 537. The protrusion 535*a* is formed on free end side 534*a* outside the second pivot point 523*a* which is center of swing of the driven lever 122. Thus, movement trajectory of return roller 121 is consequentially determined by contact trajectory with plate cam 537 and protrusion 536.

Return roller 121 contacts with paper in the proximity of sheet surface lever 73 that detects the level of the rear end of paper. Since the rear end of paper is always controlled to be at a constant level, when return roller 121 has moved to the second position (II) by contact of protrusion 535*a* with protrusion 536, the return roller 121 contacts with rear end of paper, and return portion (sponge portion) of the return roller 121 is slightly deformed to do returning function.

In this manner, driving lever 123 is adapted to rotate about its one end, and driven lever 122 is pivotally secured to the other end thereof, in addition, return roller 121 is installed on the one end from the pivoted point of the driven lever 122, and cam means for controlling the swing amount is installed on the other side.

By making the engagement angle between driving lever 123 and driven lever 122 at the first position (I) greater than the engagement angle at the second position (II), the return roller 121 can move longer distance with the same amount of rotation, compared to the case where a single swing support element supports the return roller 121.

In addition, since the engagement angle between driving lever 123 and driven lever 122 is variable by cam means, the return roller can be moved to the most optimal position considering the relation with tray 12. Therefore, a return roller that can swing between the first position (I) and the second position (II) in a narrow space is achievable, and therefore, arrangement precision in the discharge direction is improved.

The trajectory of return roller 121 during its movement will be described in reference to FIG. 49.

If the rear end of paper is face curled (upwardly curled), arrangement precision may be deteriorated because return roller 121 may extrude the upwardly curled rear end of paper when the return roller 121 presses at the first position (I) which is a waiting position or moves to the second position (II) for returning operation.

As a countermeasure for this, a protrusion 535*a* is formed on leading end of the free end side 534*a* of driven lever 122, and the protrusion 535*a* is adapted to slidingly contact with a protrusion 536 formed in a part of plate cam 537. Thereby, considering the swinging of driven lever 122*a*, free end portion 534*a* of the driven lever 122 is moved upward before the convex portions of both protrusions 535 and 536 come in contact with each other, and subsequently, the return roller 121 opposed to center of rotation is moved upward, and when the both convex portions contact each other, the return roller 121 is moved downward.

Until the return roller 121 pass the rear end of paper, the return roller 121 is lifted by said cam, and the return roller 121 is lowered upon passing. That is, the return roller 121 has mountain-shape trajectory by means of said cam. Thereby, risk that the paper whose rear end is face curled may be extruded is alleviated, and the arrangement precision is not deteriorated.

Now, timing of movement of return roller 121 is described.

Generally, the return roller 121 is located a the first position (I), and is moved to the second position (II) immediately after paper is discharged from discharge roller 3 and the rear end thereof is fallen onto tray 12 along outer periphery of lower roller 3*a*. After the return roller 121 moved in mountain-shape trajectory along the shape of plate cam 537, it contacts rear end of paper by being lowered, stays in the position for a predetermined time, and returns the paper to end fence 131 by its rotating force, thereafter, the roller 121 gets back to the first position (I) by rotating eccentric cam 125 again.

By such an operation, as shown in FIG. 3 by a symbol "s", the projected paper is surely returned so that the arrangement precision in the discharge direction a is improved.

Example of Control by Control Means> a. Control Circuit

In the sheet-shaped medium after-treatment apparatus according to the present embodiment, an image forming apparatus 50 is connected to the sheet-shaped medium after-treatment apparatus 51 as shown in FIG. 3, and the apparatus 50 performs an overall control for after-treatment, speed of discharge roller 3 and returning operation of paper and a bundle of papers by moving return roller 121.

For the sheet-shaped medium after-treatment apparatus 51, if a staple mode is selected in which papers are stapled to become a bundle of papers in predetermined number of papers, papers conveyed from discharge roller 560 of image forming apparatus 50 are received by a pair of inlet rollers 1, and they go through a pair of conveyance rollers 2*a* and a pair of conveyance rollers 2*c*, and if the predetermined number of papers are piled on staple tray, the papers are stapled by stapler 11 and discharged to tray 12 by discharge roller S which is the last conveyance means.

b. Example of Control (1) Initial Routine (FIG. 30)

The flowchart described below shows a part related to the present invention on sheet-shaped medium after-treatment apparatus 51. By turning on main switch associated with the image forming apparatus 50 and sheet-shaped medium after-treatment apparatus 51 shown in FIG. 3, initial routine shown in FIG. 30 and main routine thereafter are executed.

In the initial routine, "return roller initial control" is performed at step P1, and the return roller 121 is moved to the first position (I), and each flag is reset to 0.

On completion of step P1, the process jumps to main routine. In this main routine, if staple mode is selected, at step P2, the process goes to "staple mode paper conveyance control" of step P3 (see, FIG. 51), "logger & staple & discharge control" of step P4 (see, FIGS. 52 and 53), and "return roller return control" of step P5 (see, FIG. 58), if staple mode is not selected, at step P2, the process goes to "return roller return control" of step P5 (see, FIG. 58) via "shift mode paper conveyance control" of step P6. Hereinafter, control example of the present embodiment will be described assuming that the staple mode is selected.

Figure 51A:
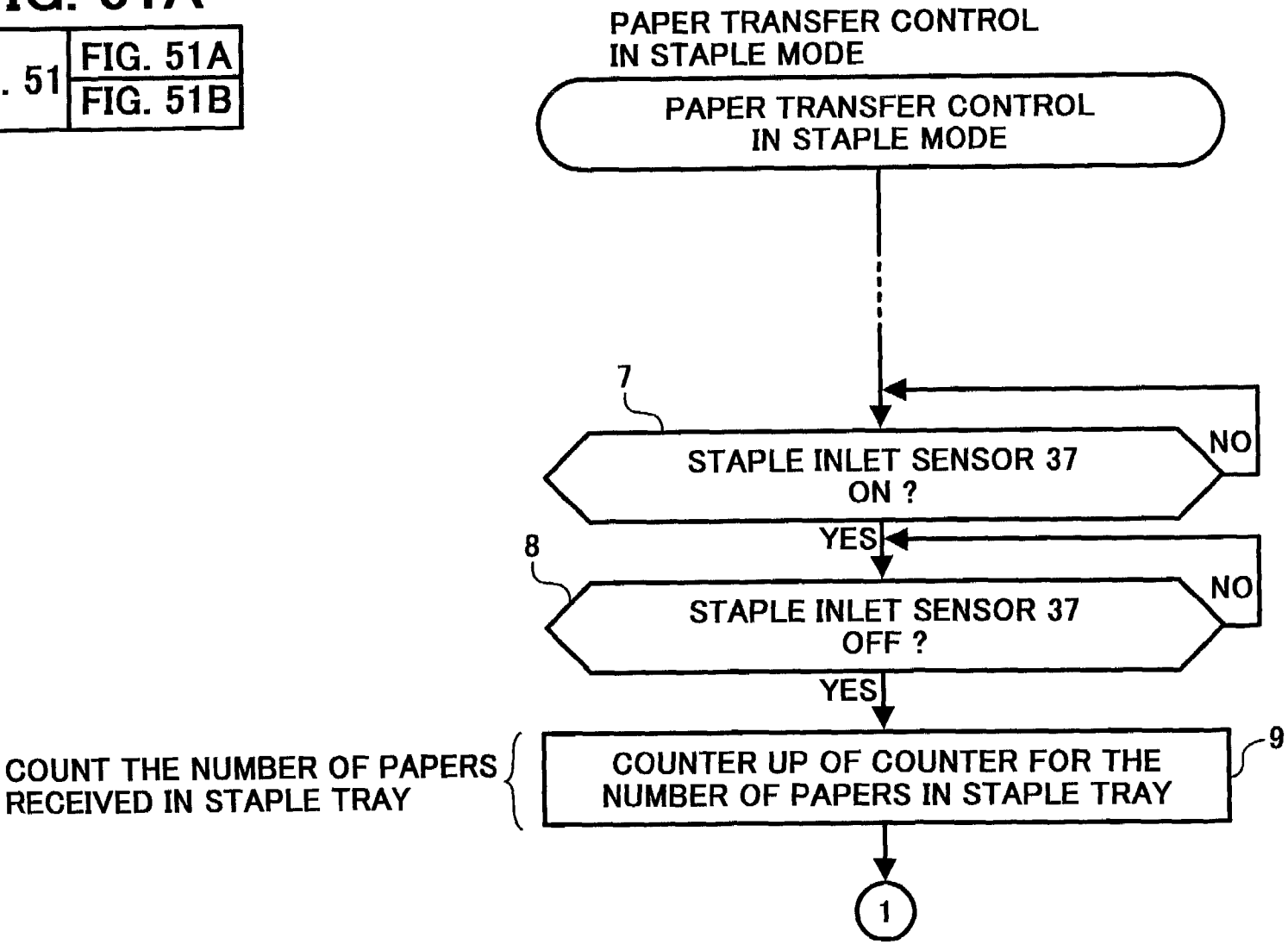
FIG. 51 is a flowchart illustrating paper conveyance control according to the third embodiment of the present invention.
Figure 51B:
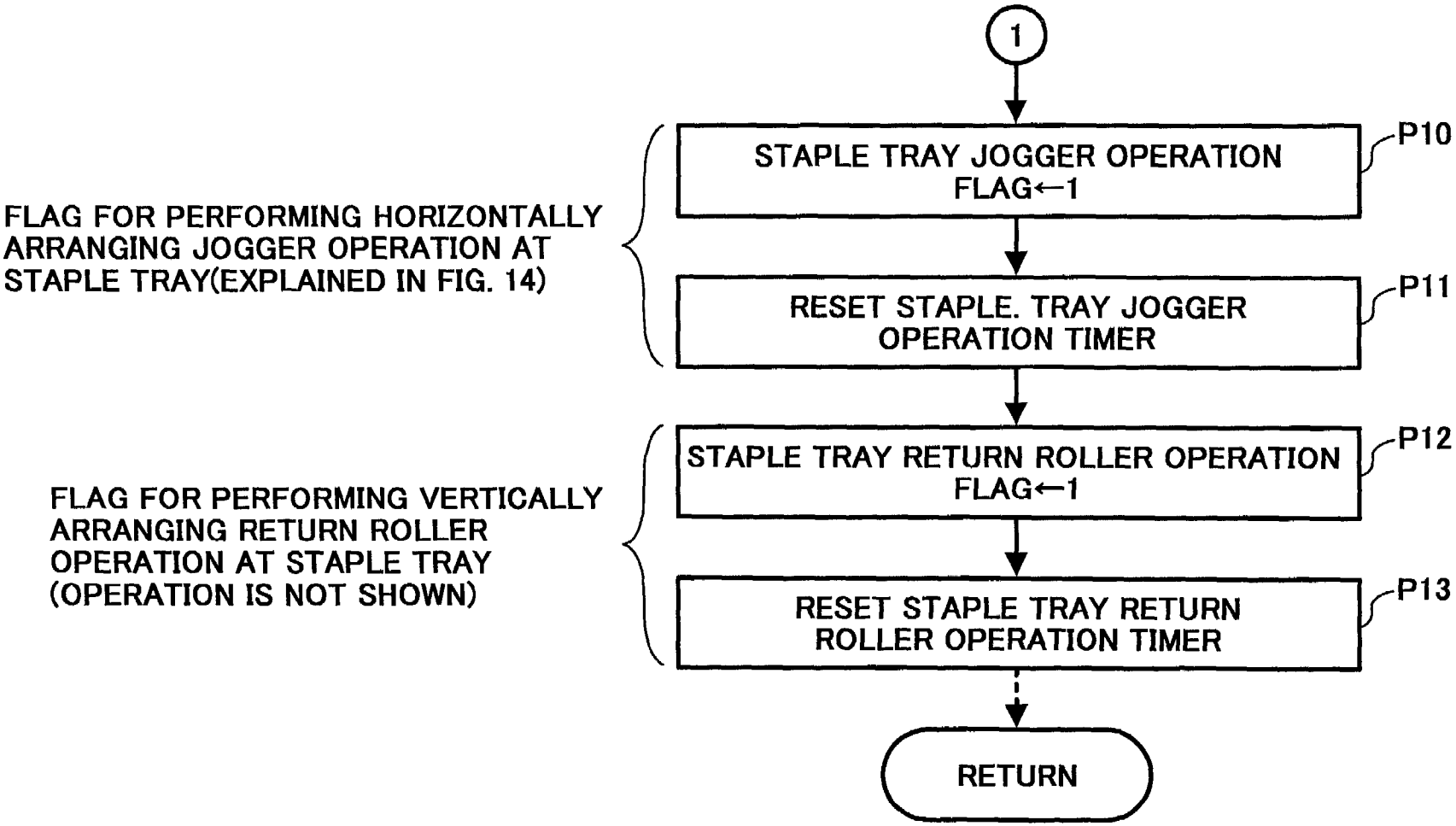

(2) Staple Mode Paper Conveyance Control (FIG. 51)

Referring to FIG. 51, "staple mode paper conveyance control" is described below.

When it is confirmed that paper passed through staple inlet sensor 37 by detecting leading end of paper at step P7 and rear end of paper at step P8, the number of papers received by staple tray is counted through "staple tray number counter" at step P0 (step P9).

Staple tray jogger operation flag is set at step P10. Thereby, determination at step P14 of FIG. 52 is made "yes" so that transverse-arranging operation by jogger in the staple tray is executed.

By resetting "staple tray jogger operation timer" at step P11, time counting is started for comparison with time T1 used at step P15 of FIG. 52 which is described below.

"Staple tray return operation flag" is set at step P12, and "staple tray return roller operation timer" is reset at step P13, and operation time for retain roller for longitudinal arrangement of papers in staple tray is controlled. Staple tray return roller and the operation thereof is not shown.

Figure 52:
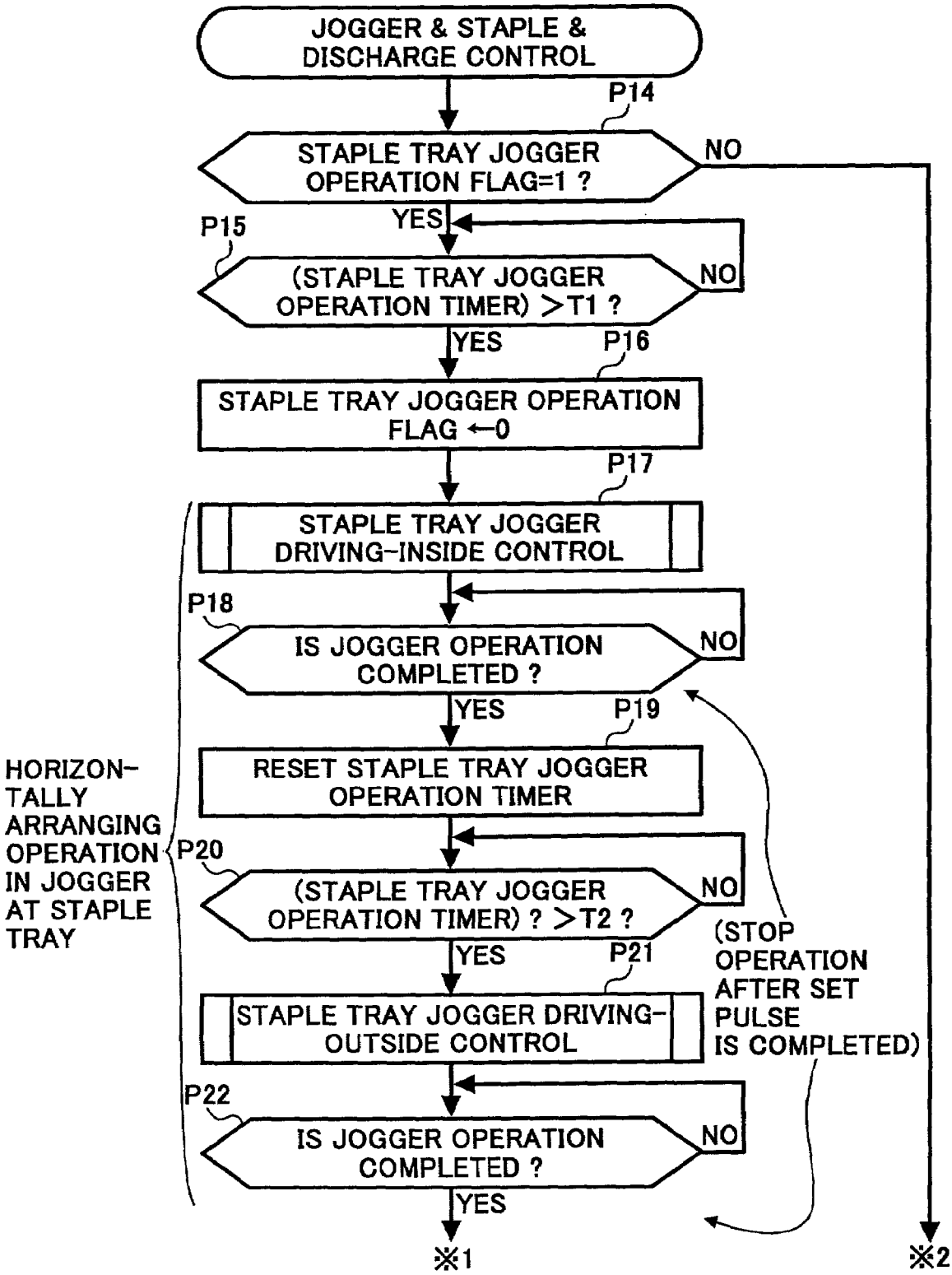
FIG. 52 is a flowchart illustrating jogger control and the like according to the third embodiment of the present invention.
Figure 53A:
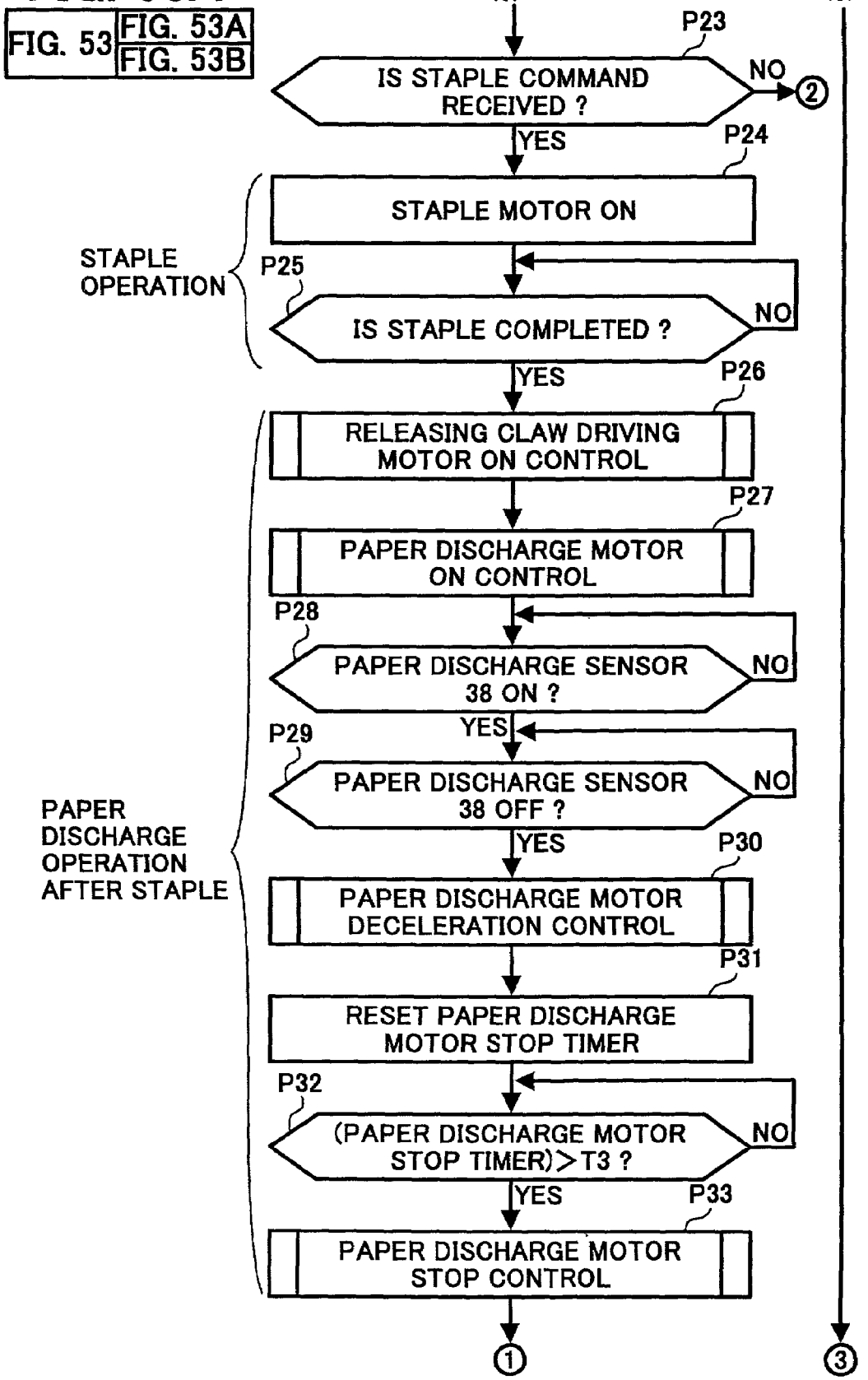
FIG. 53 is a flowchart successive to FIG. 52.
Figure 53B:
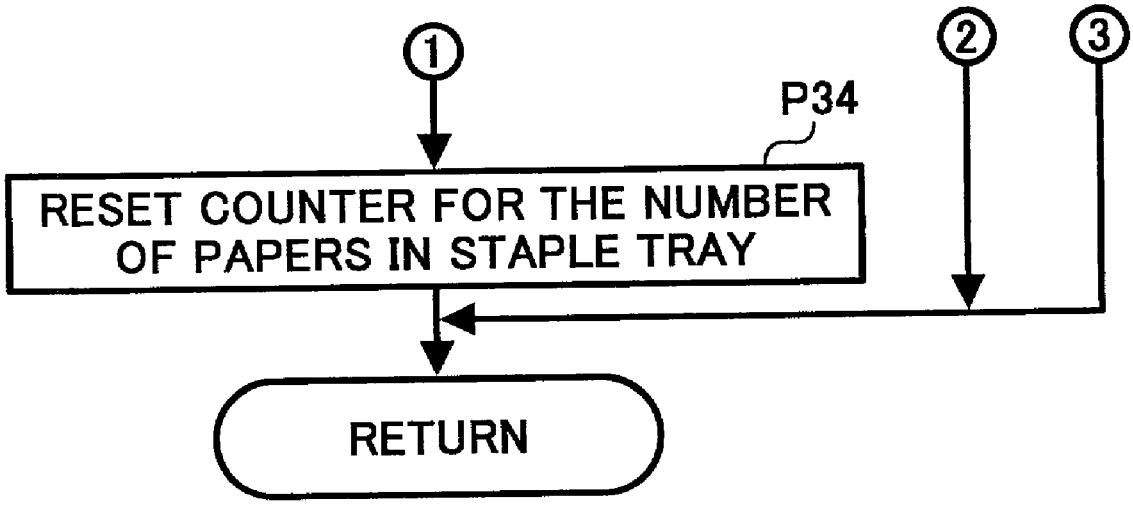

(3) Jogger & Staple & Discharge Control (FIGS. 52 and 53)

At step P14, since "staple tray jogger operation flag" is already set at step P10, the process goes to step P15 and wait until the time T1 elapses. The time T1 is set as a time elapsed while rear end of paper passes through staple inlet sensor 37 and the paper enters staple tray. Upon passing of the time T1, transverse-arranging operation is executed in staple tray by jogger 9.

This transverse-arranging operation is arranging operation in which papers in staple tray is arranged by moving a pair of joggers (arranging members) opposed in paper width direction, and the transverse-arranging operation is executed by each operation of steps P16 to P22. In addition, although not shown in flowchart, longitudinal arrangement is performed by return roller 5.

At step P23, if staple command is received from forming apparatus 50, stapling is performed. The staple command is sent to sheet-shaped medium after-treatment apparatus 51 at the time when the last paper of the bundle is discharged from image forming apparatus, and then the sheet-shaped medium after-treatment apparatus 51 performs stapling by the command. Whether the paper is the last paper is determined based on count-up information at step P9.

The execution of staple is performed by staple motor at step P24, end of staple is checked at step P25. After staple, an ejecting claw 10*a* is driven by driving ejecting claw drive motor (step P26), discharge roller 3 is driven by driving discharge motor (stepping motor 132), and stapled paper bundle is sent toward discharge roller 3.

If staple paper bundle passes through discharge sensor 38 (steps P28 and P29), the discharge motor is controlled to decelerate (step P30), counting is started by resetting discharge motor stop timer (step P31), and if enough time T3 for the staple paper bundle to fall onto tray 12 is passed (step P32), discharge motor is stopped (step P33) and counted number of "staple tray number counter" at step P9 is reset.

Figure 54:
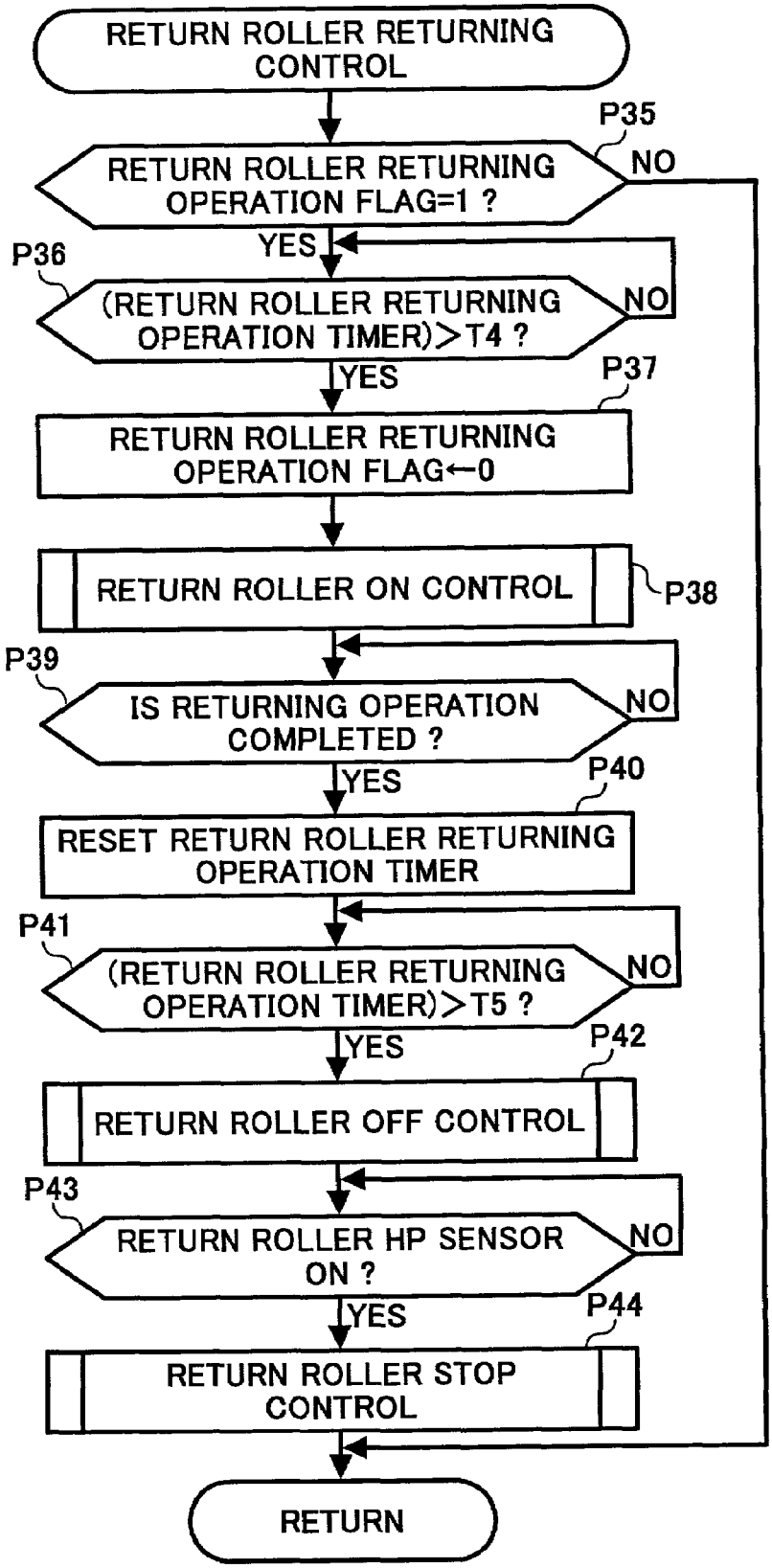
FIG. 54 is a flowchart relating to return control of the return roller according to the third embodiment of the present invention.

(4) Return Roller Return Control (FIG. 54)

In FIG. 54, at step P35, since "return roller return operation flag" remains reset at sad step P1, return is done. Here, since the return roller 121 is situated at the first position (I) at said step P5, the return roller 121 stays apart from staple paper bundle during staple mode.

Figure 62A:
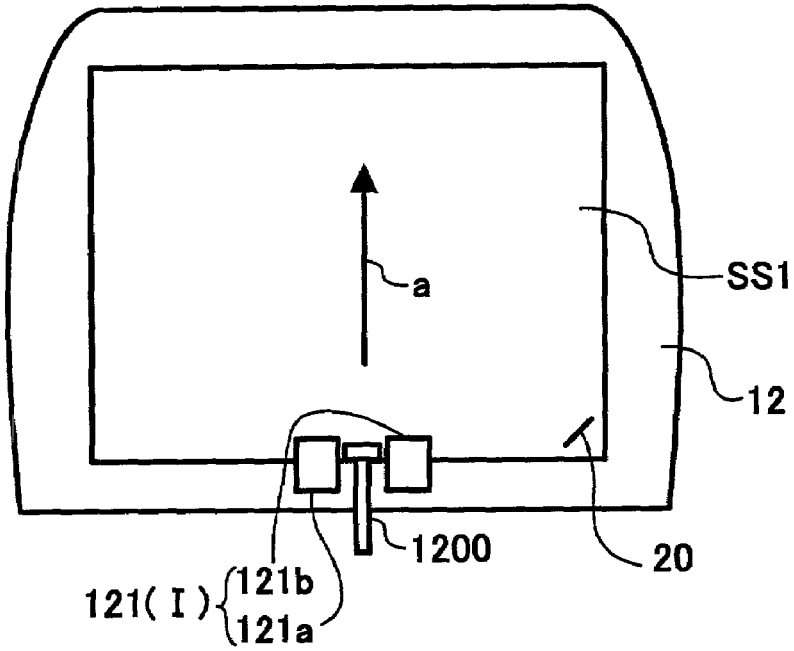
FIG. 62(A) illustrates the return roller placed at the first position to which the stapling place should return a part of paper bundle and FIG. 62(B) illustrates a state that wrinkles take place at the stapling position when returning to the second position.
Figure 62B:
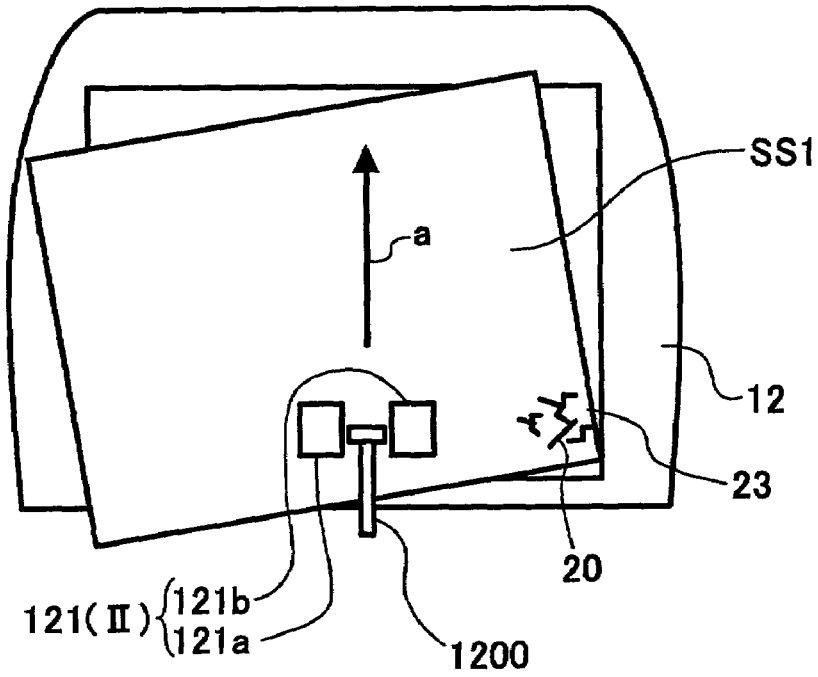

Therefore, as shown in FIG. 62(A), return roller 121 acts upon staple paper bundle piled on tray 12 (one point is filed obliquely inward), so it contacts with top surface of staple paper bundle, therefore only top paper, which is in contact wither return roller, is returned. As a result, wrinkles or folding occurred near staple blade 20, as shown in FIG. 62(B), is avoided.

Figure 55:
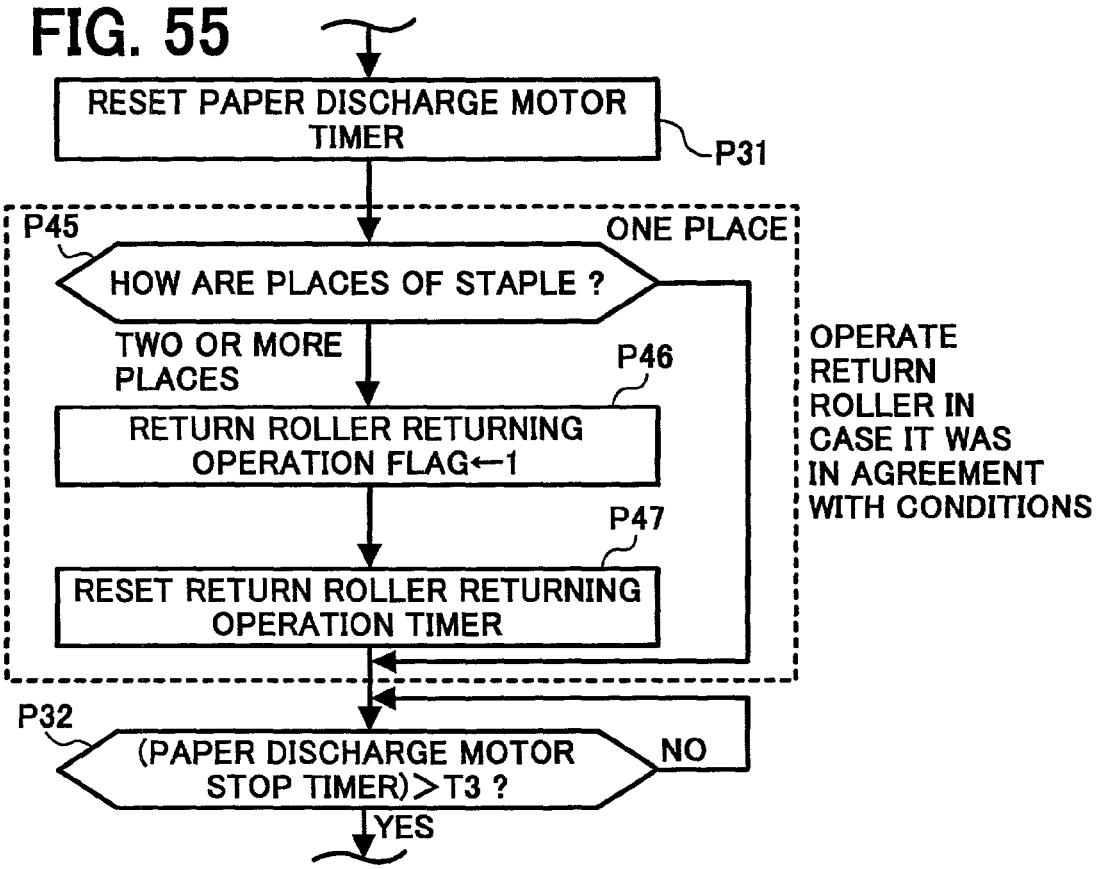
FIG. 55 is a flowchart relating to a stapling place in the present invention.

The present embodiment is executed such that the flow of FIG. 55 indicated as broken line is inserted between step P31 and step P32 in FIGS. 52 and 53 illustrating "jogger & staple & discharge control".

In FIG. 55, the number of filing spots by stapler 11 for papers is determined in step P45. Information about the number of filing spot instructed by operator is provided for CPU 700 in advance.

If filing one spot, the process goes to step P32 without steps P46 and P47. This is the same as in FIG. 53 in which process goes from step P31 to stop P32, wherein, "return roller return operation flag" remains reset.

Therefore, in FIG. 54, it goes to return at step P35. Since return roller 121 is located at the first position (I) at said step P5, if the number of staple spot is one in staple mode, the return roller 121 is retained apart from staple paper bundle. Thus, when filing one spot, wrinkles or folding occurred near staple blade 20, as shown in FIG. 62(B), is avoided.

In FIG. 55, the number of modes assigned to filing spots is checked at step P45, if it is determined that stapling spot by stapler 11 is two spot mode or more, "return roller return operation flag" is set at step P46, and also "return roller return operation timer" is reset at step P47, and compared time starts to be counted at step P36.

Figure 58A:
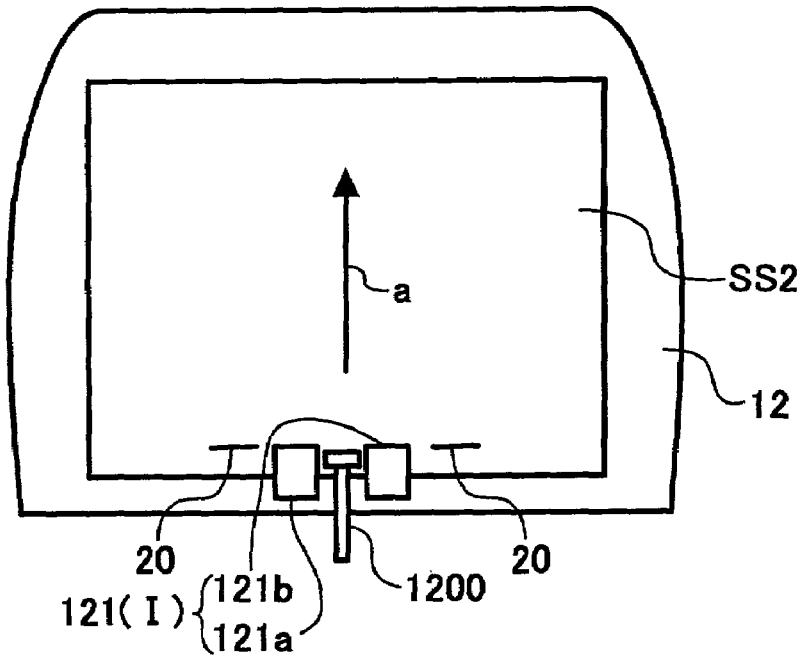
FIG. 58(A) illustrates the return roller at a first position.
Figure 58B:
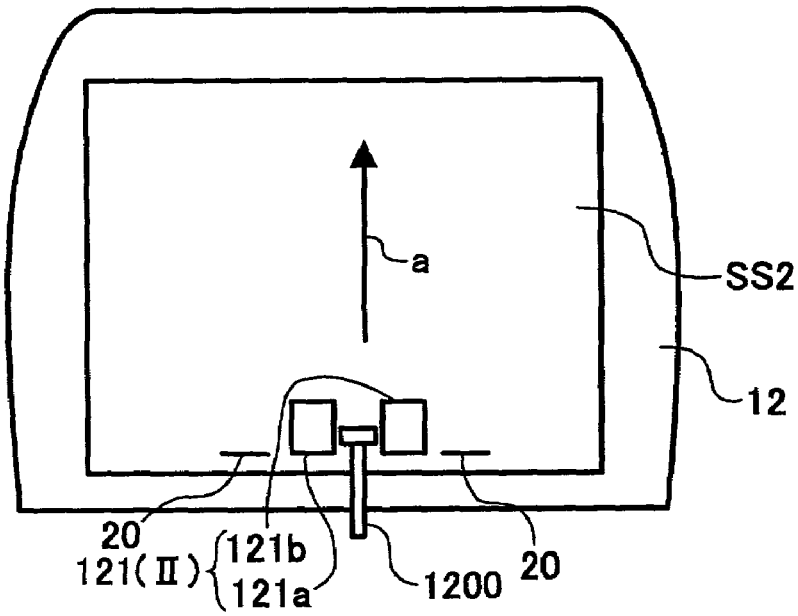
FIG. 58(B) illustrates the return roller at a second position.

In this manner, the process goes from step P35 to step P36 in FIG. 54, set time T4 set as an elapsed time, for which stapled paper bundle, for example, filed at two spots are completely fallen down on tray 12 so that operation of return roller 121 can be well executed, is compared with actually counted time, and if the time is passed, "return roller return operation flag" is reset at step P37, and then, return roller 121 is moved from the first position (I) shown in FIG. 58(A) to the second position (II) shown in FIG. 58(B) (steps P38 and P39).

At the second position (II), if enough time T5 elapses before staple paper bundle SS2 collides against end fence 131 sufficiently (steps P40 and P41), return roller 121 is moved from the second position (II) to the first position (I).

To prevent staple paper bundle SS1 from being damaged in proximity of staple blade, return arrangement by return roller 121 is not executed for the bundle SS1, however, if such a damage does not happen, it is preferable to return and arrange the stapled paper bundle considering arrangement quality.

In this embodiment, after staple paper bundle SS2 is filed at two spots (or more spots), arrangement is executed by contacting return roller 121 with rear end of paper bundle and by returning operation. Thereby, the papers filed at two spots are piled uniformly on discharge tray.

Further, if papers are Bled at two spots, when the staple paper bundle SS2 is returned by means of contact of return roller 121 with rear end thereof, since staple blades 20 are embedded in both side of the contact portion, whole staple paper bundle is pulled. Thus, the problem that damage occurs near the staple blade 20 as in case of one spot filing is not happening.

As shown in FIG. 62(A), although staple paper bundle having one filed spot is piled, if the number of papers filed is small, a state illustrated in FIG. 62(B) will not happen when the staple paper bundle is returned by operation of return roller 121, finally the whole staple paper bundle can be returned due to small amount of return resistance. Thus, if the number of filed papers is below a certain amount, it is preferable for arrangement quality to execute arrangement by driving swinging return roller 121.

Figure 56:
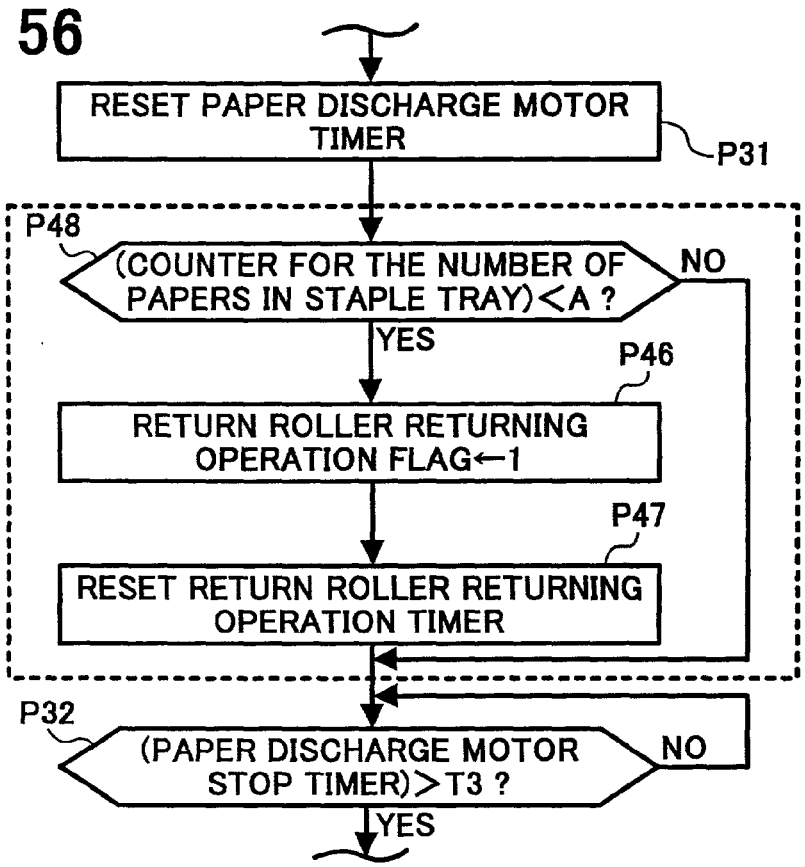
FIG. 56 is a flowchart relating to a stapling number of papers in the present invention.

Under such a knowledge, the present embodiment is operated such that the flow of FIG. 56 indicated as broken line is inserted between step P31 and step P32 in FIG. 53 illustrating "logger & staple & discharge control". Here, the flow of FIG. 56 indicated as broken line is composed of the flow of FIG. 55 indicated as broken line replacing the step P45, how many staple spot existing with the step P48, "(staple tray number counter)<A?".

In FIG. 56, after stapling, upon detecting "off" of discharge sensor 38 when staple paper bundle is discharged, the number of papers is checked by checking "staple tray number counter" at step P48, and if the number of the present staple papers is less than a predetermined value A which is obtained experimentally and by which returning can be executed without causing the state shown in FIG. 62(B), "return roller return operation flag" is set at step P46 and "return roller return operation timer" is reset at step P47, and return roller 121 is actuated as flow in FIG. 54.

In the present embodiment, although the stapled spot is only one, if the number of filed papers is less than a predetermined number, return roller 121 gets contacted with rear end of staple paper bundle and is driven to perform returning operation. If the number of filed papers is less than the predetermined value, arrangement can be completed without damaging staple blade portion even in case of one spot filing.

As shown in FIG. 62(A), although staple paper bundle having one filed spot is piled, if the paper size is small, since distance from contact point with return roller 121 to staple blade 20 is short, and therefore, the moment applied to staple blade when contact between rear end of paper and return roller 121 occurs, no damage is caused at the staple blade. Therefore, even if one spot is filed, if paper size is small, arrangement can be performed well since return roller 121 can be actuated.

Figure 59A:
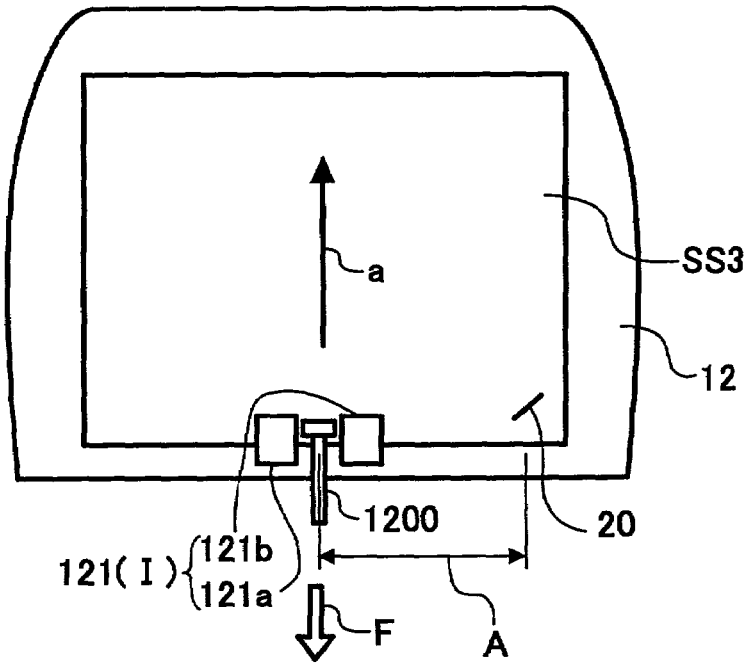
FIG. 59(A) illustrates moment with respect to a large size paper by the return roller and FIG. 59(B) illustrates moment with respect to a small size paper by the return roller.
Figure 59B:
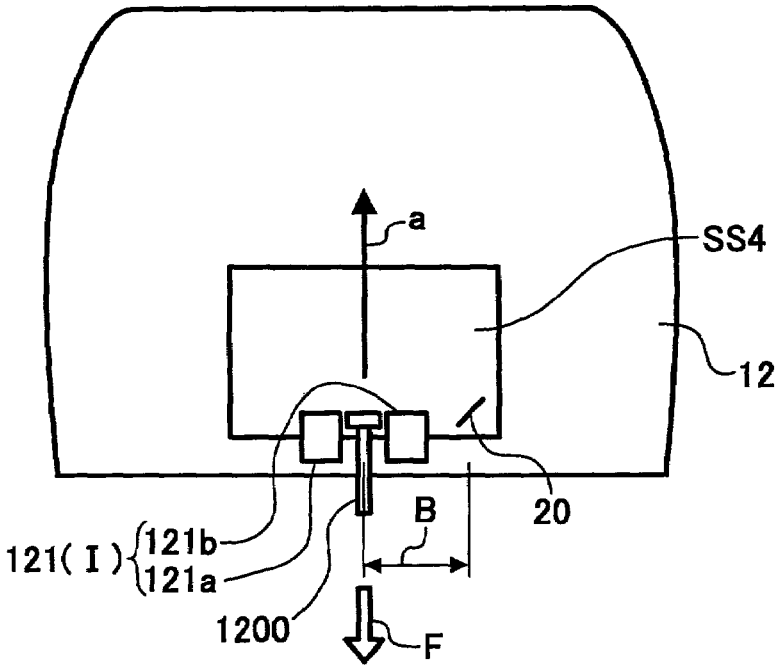
Figure 60:
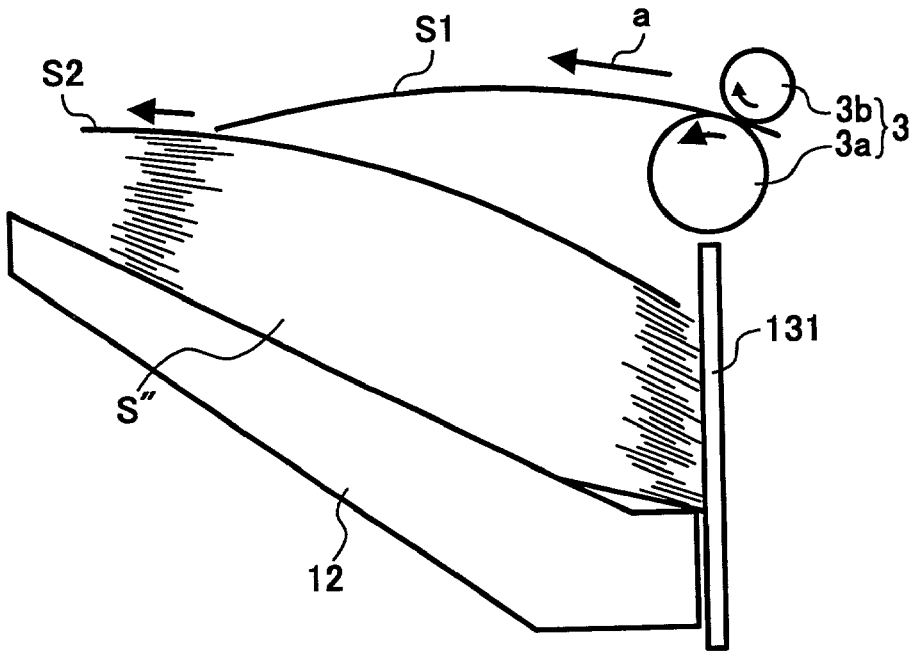
FIG. 60 illustrates a paper-arranged state when the return means is not provided.
Figure 61:
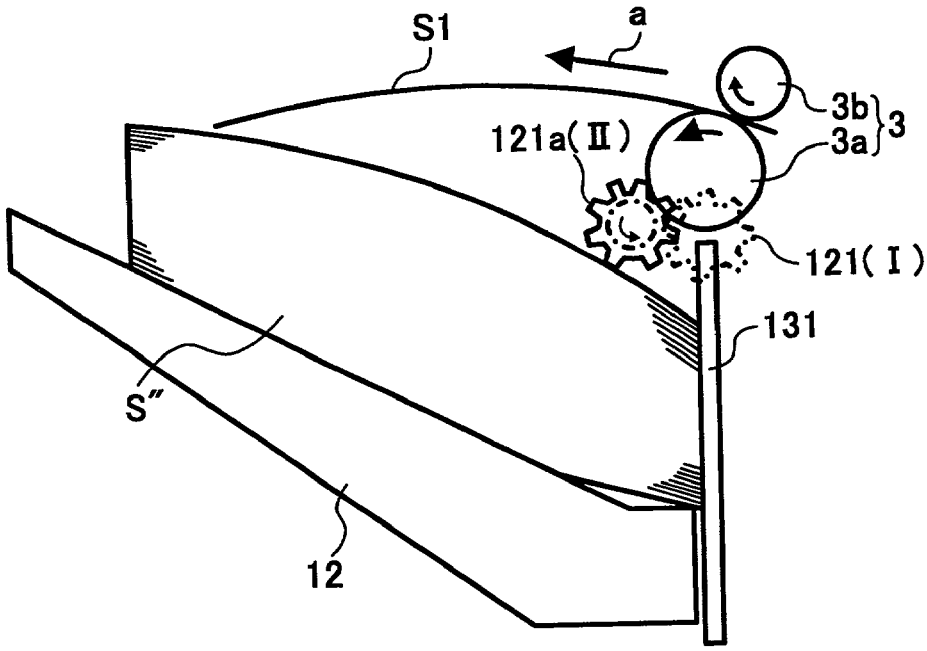
FIG. 61 illustrates a paper-arranged state when the return means is provided.

As a detailed example for this, although staple paper bundle having one filed spot as shown in FIG. 59(B) is piled, if the size of staple paper bundle is small, when the staple paper bundle SS4 is returned by actuating return roller 121, the whole paper bundle SS4 can be returned without causing problem shown in FIG. 62(B) due to little resistance.

The specific reason why wrinkles or folding is not caused at staple blade portion is that small sized paper bundle in FIG. 59(B) is lighter than big sized paper bundle in FIG. 59(A), and that distance from return roller 121 to staple blade 20 in FIG. 59(A) is shorter (B<A), as a result, moment applied to the staple blade, which equals to the distance (A or B) multiplying returning force F by return roller 121, is smaller (BF<Af).

Figure 57:
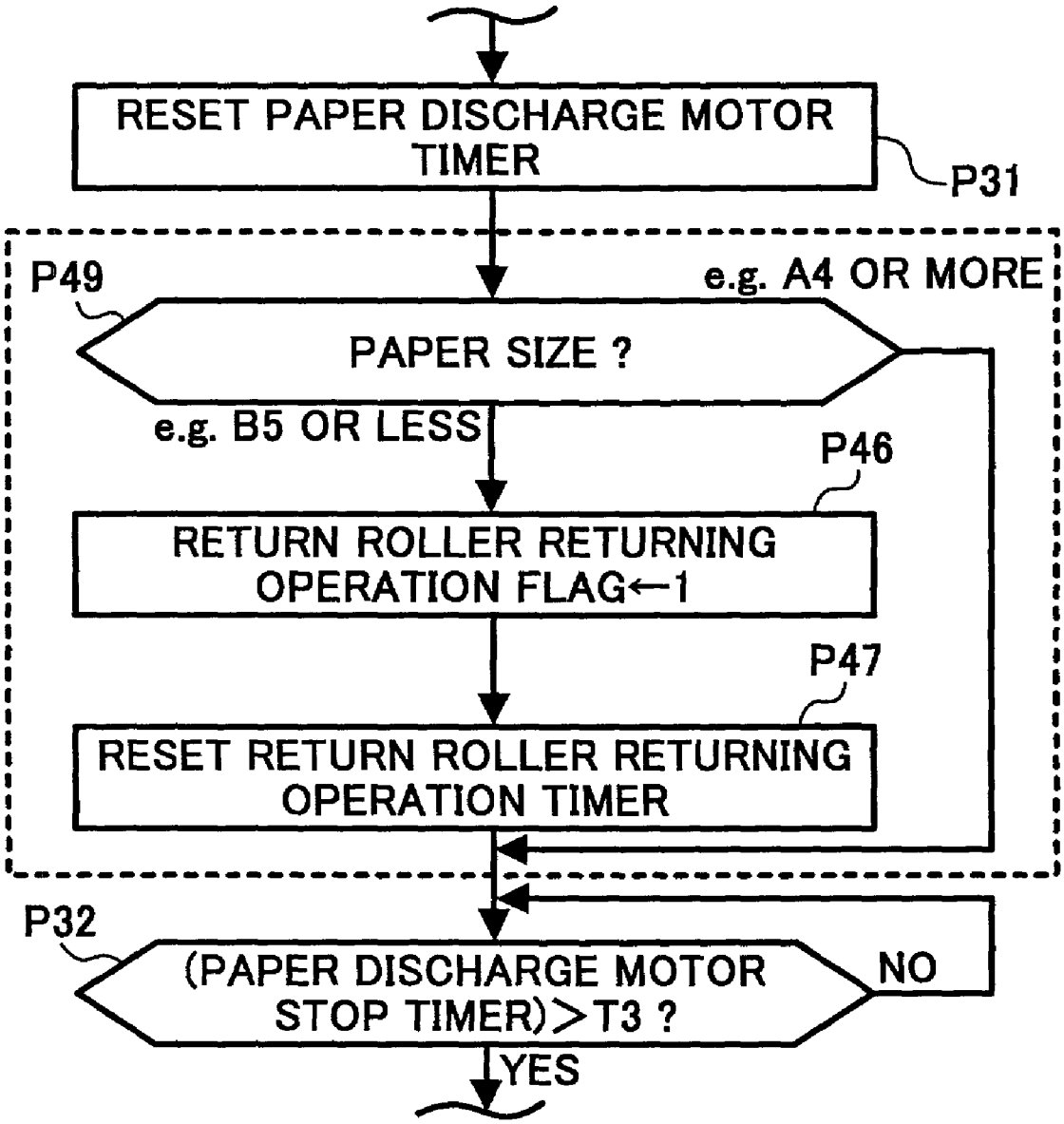
FIG. 57 is a flowchart relating to a paper size in the present invention.

Under this information, the present embodiment is operated such that the flow of FIG. 57 indicated as broken line is inserted between step P31 and step P32 in FIG. 53 illustrating "jogger & staple & discharge control". Here, the flow of FIG. 57 indicated as broken line is composed of the flow of FIG. 55 indicated as broken line replacing the step P45, "how many staple spots exist?" with the step P49, "paper size?".

In FIG. 57, after stapling, upon detecting "off" of discharge sensor 38 when staple paper bundle is discharged, the papers size is checked by checking paper size of staple paper bundle at step P49, and, for example, if the size is bigger than A4 size, return roller 121 is not actuated, and if it is B5 size, then, "return roller return operation flag" is set at step P46 and "return roller return operation timer" is reset a step P47, and return roller 121 is actuated as the flow in FIG. 54.

In the present embodiment, although the stapled spot is only one, if paper size is less than a predetermined value, return roller 121 gets contacted with rear end of staple paper bundle and is driven to perform returning operation. If the paper size is small, arrangement can be completed by actuating the return roller 121 without damaging staple blade portion.

As described above, in accordance with the present invention, the following effects can be achieved.

When sheet-shaped medium is discharged the already piled sheet-shaped medium is pressed by returning means so that it is not protruded, and after sheet-shaped medium falls down on piling means, the discharged sheet-shaped medium is returned by the returning means until it collides with vertical wall, then it is arranged by arranging means, and therefore, a good arrangement can be attained and sorting operation can be executed regardless of curled state or piled state.

Since arranging operation is omitted during sorting operation for previous sheet-shaped medium, the time for the operation is shortened and work efficiency is enhanced.

If the interval between discharges of sheet-shaped medium gets shorter, since returning operation for previous sheet-shape medium during sorting operation is removed, and returning operation for previous sheet-shaped medium concurs with pressing operation for the next paper, the time for the operation is shortened and work efficiency is further enhanced.

Since rotation stop control for returning means can be performed separately from discharging means, discharging operation by discharging means is not disturbed by stopping the rotation of return means and performing press operation.

An image forming apparatus can be arranged well and sorting operation can be performed regardless of curled state or piled state of sheet-shaped medium.

A sheet-shaped medium after-treatment apparatus can be arranged well and sorting operation can be performed regardless of curled state or piled state of sheet-shaped medium.

When sheet-shaped medium is discharged, the already piled sheet-shaped medium is pressed by returning means so that it is not protruded, and after sheet-shaped medium falls down on piling means, the discharged sheet-shaped medium is returned by the returning means until it collides with vertical wall, then it is arranged by arranging means, and therefore, a good arrangement can be obtained and preferable arrangement can be obtained for all sheet-shaped media discharged onto piling means.

Since collation between arranging means and retaining means. resolve the problem of disarray, a more precise arrangement can be realized.

Since rotation stop control for returning means can be performed separately from discharging means, discharging operation by discharging means is not disturbed by stopping the rotation of return means and performing press operation.

An image forming apparatus can be arranged well regardless of curled state or piled state of sheet-shaped medium.

A sheet-shaped medium after-treatment apparatus can be arranged well regardless of curled state or piled state of sheet-shaped medium.

Wrinkles or damage by returning means on stapled sheet-shaped medium bundle can be avoided.

Wrinkles or damage by returning means on stapled sheet-shaped medium bundle for which stapling is performed at one spot can be avoided.

Sheet-shaped medium bundle whose sheet number is less than a predetermined number can be properly arranged by return operation of returning means.

Sheet-shaped medium bundle whose size is less than a predetermined size can be arranged by return operation of returning means.

Sheet-shaped medium bundle having two or more stapled spots can be arranged by return operation of returning means.

Sheet-shaped medium can be well arranged by surly contacting returning means with rear end portion of sheet-shaped medium by moving the returning means.

What is claimed is:

1. A sheet-shaped medium treatment apparatus comprising:

a discharging means for discharging a sheet-shaped medium conveyed thereinto;

a piling means for piling the sheet-shaped medium discharged by the discharging means;

an arranging means for performing an arranging action by interposing a first end and a second end of the sheet-shaped medium piled onto the piling means, said first end and said second end of the sheet-shaped medium are in parallel with a discharge direction of the sheet-shaped medium by said discharging means; and a returning means for performing a returning action to return the sheet-shaped medium until it collides against a vertical wall disposed on an upstream end of said piling means in the discharge direction by being rotated with being in contact with the sheet-shaped medium, said returning means comprising a rotating body which can move closely to or remotely from the sheet-shaped medium, wherein said returning means is adapted to be moved in said discharge direction from a home position to a press/return position in which said returning means can grab a rear end portion of said discharged sheet-shaped medium in said discharge direction, and wherein said returning means is adapted to perform a pressing action for pressing itself onto the sheet-shaped medium on said piling means while a subsequently discharged sheet-shaped medium is discharged from said discharging means and before said subsequently discharged sheet-shaped medium falls on said piling means.

2. A sheet-shaped medium treatment apparatus comprising:

a discharging means for discharging a sheet-shaped medium conveyed thereinto;

a piling means for piling the sheet-shaped medium discharged by the discharging means;

an arranging means for performing an arranging action by interposing a first end and a second end of the sheet-shaped medium piled onto the piling means, said first end and said second end of the sheet-shaped medium are in parallel with a discharge direction of the sheet-shaped medium by said discharging means; and a returning means for performing a returning action to return the sheet-shaped medium until it collides against a vertical wall disposed on an upstream end of said piling means in the discharge direction by being rotated with being in contact with the sheet-shaped medium, said returning means comprising a rotating body which can move closely to or remotely from the sheet-shaped medium, wherein said returning means is adapted to be moved in said discharge direction from a home position to a press/return position in which said returning means can grab a rear end portion of said discharged sheet-shaped medium in said discharge direction, and wherein said returning means is adapted to perform a pressing action for pressing itself onto the sheet-shaped medium on said piling means before a subsequently discharged sheet-shaped medium discharged from said discharging means falls on said piling means, and wherein when a leading end of the subsequently discharged sheet-shaped medium contacts a top surface of the sheet-shaped medium already piled on said piling means, said returning means is situated at said press/return position and acts upon said already piled sheet-shaped medium to retain it in a proper position, and after said subsequently discharged sheet-shaped medium falls on said piling means, said fallen subsequently discharged sheet-shaped medium is aligned by being collided against said vertical wall by said returning action of said returning means, thereafter, said subsequently discharged sheet-shaped medium is arranged by said arranging action of said arranging means.

3. The sheet-shaped medium treatment apparatus as claimed in claim 2, wherein a last sheet-shaped medium is aligned with said vertical wall by being collided against the wall by said returning action of said returning means after said arranging action is performed on said last sheet-shaped medium by said arranging means.

4. The sheet-shaped medium treatment apparatus as claimed in claim 2, wherein, said returning means is situated at said press/return position and presses the sheet-shaped medium by said pressing action while said arranging means is in contact with and interposing said first end and said second end of the sheet-shaped medium, wherein the sheet-shaped medium is not a last sheet-shaped medium.

5. The sheet-shaped medium treatment apparatus as claimed in any one of claims 2 to 4, wherein a rotation stop control for said returning means is performed separately from a drive of said discharging means.

6. An image forming apparatus comprising an image forming means for forming an image on the sheet-shaped medium and a conveyance means for conveying the sheet-shaped medium on which an image is formed, the apparatus including:

the sheet-shaped medium treatment apparatus as claimed in any one of claims 2 to 4.

7. The sheet-shaped medium after-treatment apparatus comprising an after-treatment means for performing after-treatment on the sheet-shaped medium and a conveyance means for conveying the after-treated sheet-shaped medium, the apparatus including:

the sheet-shaped medium treatment apparatus as claimed in any one of claims 1 to 4.

8. A sheet-shaped medium treatment apparatus comprising:

a discharging means for discharging a sheet-shaped medium conveyed thereinto;

a piling means for piling the sheet-shaped medium discharged by the discharging means;

an arranging means for performing an arranging action by interposing a first end and a second end of the sheet-shaped medium piled onto the piling means, said first end and said second end of the sheet-shaped medium are in parallel with a discharge direction of the sheet-shaped medium by said discharging means;

a sorting means for sorting the sheet-shaped medium by displacing said piling means or said arranging means by a predetermined amount in a shift direction perpendicular to the discharge direction of the sheet-shaped medium by said discharging means; and a returning means for performing a returning action to return the sheet-shaped medium until it collides against a vertical wall disposed on an upstream end of said piling means in the discharge direction by being rotated with being in contact with the sheet-shaped medium, said returning means comprising a rotating body which can move closely to or remotely from the sheet-shaped medium, wherein said returning means is adapted to be moved in said discharge direction from a home position to a press/return position in which said returning means can grab a rear end portion of said discharged sheet-shaped medium in said discharge direction, while said returning means is adapted to perform a pressing action for pressing the sheet-shaped medium with being in contact with the sheet-shaped medium, wherein when the sheet-shaped medium is discharged from said discharging means to be sorted by said sorting means, when a leading end of said discharged sheet-shaped medium gets contact with a top surface of a previously discharged sheet-shaped medium already piled on said piling means, said returning means is situated at said press/return position and acts upon said already piled previously discharged sheet-shaped medium to retain it in proper position, thereafter, said sorting means is actuated to perform sorting before said discharged sheet-shaped medium falls on said piling means, and wherein after said discharged sheet-shaped medium falls on said piling means, said sheet-shaped medium is aligned by being collided against said vertical wall by said returning action of said returning means, thereafter, said sheet-shaped medium is arranged by said arranging action of said arranging means.

9. The sheet-shaped medium treatment apparatus as claimed in claim 8, wherein when the sheet-shaped medium is discharged to be sorted, before the sheet-shaped medium falls on said piling means, said previously discharged sheet-shaped medium already piled is retained in a proper position by said pressing action of said returning means, said previously discharged sheet-shaped medium is sorted by driving said sorting means immediately before said sheet-shaped medium falls on said piling means, and after said sheet-shaped medium falls on said piling means, said sheet-shaped medium is aligned by being collided against said vertical wall by said returning action of said returning means, said arranging action is not performed, and said returning means presses said already piled previously discharged sheet-shaped medium by said pressing action immediately after said sheet-shaped medium starts to be discharged onto said piling means, and returning action is executed by said returning means after said discharged sheet-shaped medium falls on said piling means, thereafter, arranging action by said arranging means is executed.

10. The sheet-shaped medium treatment apparatus as claimed in claim 9, wherein returning action during sorting action, which is performed right before said sheet-shaped medium falls onto said piling means, is omitted, and returning action is performed simultaneously with said pressing action for an other sheet-shaped medium.

11. The sheet-shaped medium treatment apparatus as claimed in any one of claims 8 to 10, wherein a rotation stop control for said returning means is performed separately from a drive of said discharging means.

12. An image forming apparatus comprising an image forming means for forming an image on a sheet-shaped medium and a conveyance means for conveying the sheet-shaped medium on which an image is formed, the apparatus including:

the sheet-shaped medium treatment apparatus according to any one of claims 8 to 10.

13. The sheet-shaped medium after-treatment apparatus comprising an after-treatment means for performing after-treatment on a sheet-shaped medium and a conveyance means for conveying the after-treated sheet-shaped medium, the apparatus including:

the sheet-shaped medium treatment apparatus as claimed in any one of claims 8 to 10.

14. A sheet-shaped medium after-treatment apparatus comprising:

a conveyance means for conveying a sheet-shaped medium received from an image forming apparatus;

a means for aligning and stapling a plurality of sheet-shaped media conveyed continuously by said conveyance means;

a discharging means for discharging the sheet-shaped medium conveyed by said conveyance means and a sheet-shaped medium bundle stapled by said stapling means;

a piling means for piling the sheet-shaped medium discharged by said discharging means;

a returning means for aligning the sheet-shaped medium by moving it toward a vertical wall and colliding it against said vertical wall under contact condition with the sheet-shaped medium right after its discharge, said returning means being able to move closely to or remotely from the sheet-shaped medium discharged on said piling means; and a return controlling means for controlling when said returning means is moved to contact with or remotely from the sheet-shaped medium discharged on said piling means, wherein said return controlling means controls said returning means so that said returning means is retained remotely from a top surface of said sheet-shaped medium discharged from said discharging means based on the discharged sheet-shaped medium being a sheet-shaped medium bundle having one stapled spot.

15. The sheet-shaped medium after-treatment apparatus as claimed in claim 14, wherein said return controlling means controls said returning means so that said returning means contacts with a top surface of said sheet-shaped medium discharged from said discharging means based on a number of the plurality of sheet-shaped media constituting said bundle being less than a predetermined number and one stapled spot for the sheet-shaped medium bundle being set.

16. The sheet-shaped medium after-treatment apparatus as claimed in claim 14, wherein said return controlling means controls said returning means so that said returning means contacts with a top surface of said sheet-shaped medium discharged from said discharging means based on a size of the plurality of sheet-shaped media constituting said bundle being smaller than a predetermined size and one stapled spot for the sheet-shaped medium bundle being set.

17. A sheet-shaped medium treatment apparatus comprising:

a discharging device configured to discharge a sheet-shaped medium conveyed thereinto;

a piling device configured to pile the sheet-shaped medium discharged by the discharging device;

an arranging device configured to perform an arranging action by interposing a first end and a second end of the sheet-shaped medium piled onto the piling device, said first end and said second end of the sheet-shaped medium are in parallel with a discharge direction of the sheet-shaped medium by said discharging device; and a returning device configured to perform a returning action to return the sheet-shaped medium until it collides against a vertical wall disposed on an upstream end of said piling device in the discharge direction by being rotated with being in contact with the sheet-shaped medium, said returning device comprising a rotating body which can move closely to or remotely from the sheet-shaped medium, wherein said returning device is adapted to be moved in said discharge direction from a home position to a press/return position in which said returning device can grab a rear end portion of said discharged sheet-shaped medium in said discharge direction, and wherein said returning device is adapted to perform a pressing action for pressing itself onto the sheet-shaped medium on said piling device while a subsequently discharged sheet-shaped medium is discharged from said discharging device and before said subsequently discharged sheet-shaped medium falls on said piling device.

18. An image forming apparatus comprising an image forming device configured to form an image on the sheet-shaped medium and a conveyance device configured to convey the sheet-shaped medium on which an image is formed, the apparatus including:

the sheet-shaped medium treatment apparatus as claimed in claim 17.

19. The sheet-shaped medium after-treatment apparatus comprising an after-treatment device configured to perform after-treatment on the sheet-shaped medium and a conveyance device configured to convey the after-treated sheet-shaped medium, the apparatus including:

the sheet-shaped medium treatment apparatus as claimed in claim 17.

20. A sheet-shaped medium treatment apparatus comprising:

a discharging device configured to discharge a sheet-shaped medium conveyed thereinto;

a piling device configured to pile the sheet-shaped medium discharged by the discharging device;

an arranging device configured to perform an arranging action by interposing a first end and a second end of the sheet-shaped medium piled onto the piling device, said first end and said second end of the sheet-shaped medium are in parallel with a discharge direction of the sheet-shaped medium by said discharging device; and a returning device configured to perform a returning action to return the sheet-shaped medium until it collides against a vertical wall disposed on an upstream end of said piling device in the discharge direction by being rotated with being in contact with the sheet-shaped medium, said returning device comprising a rotating body which can move closely to or remotely from the sheet-shaped medium, wherein said returning device is adapted to be moved in said discharge direction from a home position to a press/return position in which said returning device can grab a rear end portion of said discharged sheet-shaped medium in said discharge direction, wherein said returning device is adapted to perform a pressing action for pressing itself onto the sheet-shaped medium on said piling device before a subsequently discharged sheet-shaped medium discharged from said discharging device falls on said piling device, and wherein when a leading end of the subsequently discharged sheet-shaped medium contacts a top surface of the sheet-shaped medium already piled on said piling device, said returning device is situated at said press/return position and acts upon said already piled sheet-shaped medium to retain it in a proper position, and after said subsequently discharged sheet-shaped medium falls on said piling device, said fallen subsequently discharged sheet-shaped medium is aligned by being collided against said vertical wall by said returning action of said returning device, thereafter, said subsequently discharged sheet-shaped medium is arranged by said arranging action of said arranging device.

21. The sheet-shaped medium treatment apparatus as claimed in claim 20, wherein a last sheet-shaped medium is aligned with said vertical wall by being collided against the wall by said returning action of said returning device after said arranging action is performed on said last sheet-shaped medium by said arranging device.

22. The sheet-shaped medium treatment apparatus as claimed in claim 20, wherein said returning device is situated at said press/return position and presses the sheet-shaped medium by said pressing action while said arranging device is in contact with and interposing said first end and said second end of the sheet-shaped medium, wherein the sheet-shaped medium is not a last sheet-shaped medium.

23. The sheet-shaped medium treatment apparatus as claimed in claim 20, wherein a rotation stop control for said returning device is performed separately from a drive of said discharging device.

24. An image forming apparatus comprising an image forming device configured to form an image on the sheet-shaped medium and a conveyance device configured to convey the sheet-shaped medium on which an image is formed, the apparatus including:

the sheet-shaped medium treatment apparatus as claimed in claim 20.

25. The sheet-shaped medium after-treatment apparatus comprising an after-treatment device configured to perform after-treatment on the sheet-shaped medium and a conveyance device configured to convey the after-treated sheet-shaped medium, the apparatus including:

the sheet-shaped medium treatment apparatus as claimed in claim 20.

26. A sheet-shaped medium treatment apparatus comprising:

a discharging device configured to discharge the sheet-shaped medium conveyed thereinto;

a piling device configured to pile the sheet-shaped medium charged by the discharging device;

an arranging device configured to perform an arranging action by interposing a first end and a second end of the sheet-shaped medium piled onto the piling device, said first end and said second end of the sheet-shaped medium are in parallel with a discharge direction of the sheet-shaped medium by said discharge device;

a sorting device configured to sort the sheet-shaped medium by displacing said piling device or said arranging device by a predetermined amount in a shift direction perpendicular to the discharge direction of the sheet-shaped medium by said discharging device; and a returning device configured to perform a returning action to return the sheet-shaped medium until it collides against a vertical wall disposed on an upstream end of said piling device in the discharge direction by being rotated with being in contact with the sheet-shaped medium, said returning device comprising a rotating body which can move closely to or remotely from the sheet-shaped medium, wherein said returning device is adapted to be moved in said discharge direction from a home position to a press/return position in which said returning device can grab a rear end portion of said discharged sheet-shaped medium in said discharge direction, while said returning device is adapted to perform a pressing action for pressing the sheet-shaped medium with being in contact with the sheet-shaped medium, wherein when the sheet-shaped medium is discharged from said discharging device to be sorted by said sorting device, when a leading end of said discharged sheet-shaped medium contacts a top surface of a previously discharged sheet-shaped medium already piled on said piling device, said returning device is situated at said press/return position, and acts upon said already piled previously discharged sheet-shaped medium to retain it in proper position, thereafter, said sorting device is actuated to perform sorting before said discharged sheet-shaped medium falls on said piling device, and wherein after said discharged sheet-shaped medium falls on said piling device, said sheet-shaped medium is aligned by being collided against said vertical wall by said returning action of said returning device, thereafter, said sheet-shaped medium is arranged by said arranging action of said arranging device.

27. The sheet-shaped medium treatment apparatus as claimed in claim 26, wherein when the sheet-shaped medium is discharged to be sorted, before the sheet-shaped medium falls on said piling device, said previously discharged sheet-shaped medium already piled is retained in a proper position by said pressing action of said returning device, said previously discharged sheet-shaped medium is sorted by driving said sorting device immediately before said sheet-shaped medium falls on said piling device, and after said sheet-shaped medium falls on said piling device, said sheet-shaped medium is aligned by being collided against said vertical wall by aid returning action of said returning device, said arranging action is not performed, and said returning device presses said already piled previously discharged sheet-shaped medium by said pressing action immediately after said sheet-shaped medium starts to be discharged onto said piling device, and returning action is executed by said returning device after said discharged sheet-shaped medium falls on said piling device, thereafter, arranging action by said arranging device is executed.

28. The sheet-shaped medium treatment apparatus as claimed in claim 27, wherein returning action during sorting action, which is performed right before said sheet-shaped medium falls onto said piling device, is omitted, and returning action is performed simultaneously with said pressing action for an other sheet-shaped medium.

29. The sheet-shaped medium treatment apparatus as claimed in claim 26, wherein a rotation stop control for said returning device is performed separately from a drive of said discharging device.

30. An image forming apparatus comprising an image forming device configured to form an image on the sheet-shaped medium and a conveyance device configured to convey the sheet-shaped medium on which an image is formed, the apparatus including:

a sheet-shaped medium treatment apparatus according to claim 26.

31. The sheet-shaped medium after-treatment apparatus comprising an after-treatment device configured to perform after-treatment on the sheet-shaped medium and a conveyance device configured to convey the after-treated sheet-shaped medium, the apparatus including:

a sheet-shaped medium treatment apparatus as claimed in claim 26.

32. A sheet-shaped medium after-treatment apparatus comprising:

a conveyance device configured to convey the sheet-shaped medium received from an image forming apparatus;

a device configured to align and staple a plurality of sheet-shaped media conveyed continuously by said conveyance device;

a discharging device configured to discharge the sheet-shaped medium conveyed by said conveyance device and a sheet-shaped medium bundle stapled by said stapling device;

a piling device configured to pile the sheet-shaped medium discharged by said discharging device;

a returning device configured to align the sheet-shaped medium by moving it toward a vertical wall and colliding it against said vertical wall under contact condition with the sheet-shaped medium right after its discharge, said returning device configured to be able to move closely to or remotely from the sheet-shaped medium discharged on said piling device; and a return controlling device configured to control when said returning device is moved to contact with or remotely from the sheet-shaped medium discharged on said piling device, wherein said return controlling device controls said returning device so that said returning device is retained remotely from a top surface of said sheet-shaped medium discharged from said discharging device based on the discharged sheet-shaped medium being a sheet-shaped medium bundle having one stapled spot.

33. The sheet-shaped medium after-treatment apparatus as claimed in claim 32, wherein said return controlling device controls said returning device so that said returning device contacts with a top surface of said sheet-shaped medium discharged from said discharging device based on a number of the plurality of sheet-shaped media constituting said bundle being less than a predetermined number and one stapled spot for the sheet-shaped medium bundle being set.

34. The sheet-shaped medium after-treatment apparatus as claimed in claim 32, wherein said return controlling device controls said returning device so that said returning device contacts with a top surface of said sheet-shaped medium discharged from said discharging device based on a size of the plurality of sheet-shaped media constituting said bundle being smaller than a predetermined size and one stapled spot for the sheet-shaped medium bundle being set.

35. An image forming apparatus comprising the sheet-shaped medium after-treatment apparatus, said sheet-shaped medium after-treatment apparatus including:

a conveyance means for conveying a sheet-shaped medium received from an image forming apparatus;

a means for aligning and stapling a plurality of sheet-shaped media conveyed continuously by said conveyance means;

a discharging means for discharging the sheet-shaped medium conveyed by said conveyance means and a sheet-shaped medium bundle stapled by said stapling means;

a piling means for piling the sheet-shaped medium discharged by said discharging means;

a returning means for aligning the sheet-shaped medium by moving it toward a vertical wall and colliding it against said vertical wall under contact condition with the sheet-shaped medium right after its discharge, said returning means being able to move closely to or remotely from the sheet-shaped medium discharged on said piling means; and a return controlling means for controlling when said returning means is moved to contact with or remotely from the sheet-shaped medium discharged on said piling means, wherein said return controlling means controls said returning means so that said returning means is retained remotely from a top surface of said sheet-shaped medium discharged from said discharging means based on the discharged sheet-shaped medium being a sheet-shaped medium bundle having one stapled spot.

36. The image forming apparatus comprising the sheet-shaped medium after-treatment apparatus as claimed in claim 35, wherein said return controlling means controls said returning means so that said returning means contacts with a top surface of said sheet-shaped medium discharged from said discharging means based on a number of the plurality of sheet-shaped media constituting said bundle being less than a predetermined number and one stapled spot for the sheet-shaped medium bundle being set.

37. The image forming apparatus comprising the sheet-shaped medium after-treatment apparatus as claimed in claim 35, wherein said return controlling means controls said returning means so that said returning means contacts with a top surface of said sheet-shaped medium discharged from said discharging means based on a size of the plurality of sheet-shaped media constituting said bundle being smaller than a predetermined size and one stapled spot for the sheet-shaped medium bundle being set.

38. An image forming apparatus comprising the sheet-shaped medium after-treatment apparatus, said sheet-shaped medium after-treatment apparatus including:

a conveyance device configured to convey a sheet-shaped medium received from an image forming apparatus;

a device configured to align and staple a plurality of sheet-shaped media conveyed continuously by said conveyance device;

a discharging device configured to discharge the sheet-shaped medium conveyed by said conveyance device and a sheet-shaped medium bundle stapled by said stapling device;

a piling device configured to pile the sheet-shaped medium discharged by said discharging device;

a returning device configured to align the sheet-shaped medium by moving it toward a vertical wall and colliding it against said vertical wall under contact condition with the sheet-shaped medium right after its discharge, said returning device configured to be able to move closely to or remotely from the sheet-shaped medium discharged on said piling device; and a return controlling device configured to control when said returning device is moved to contact with or remotely from the sheet-shaped medium discharged on said piling device, wherein said return controlling device controls said returning device so that said returning device is retained remotely from a top surface of said sheet-shaped medium discharged from said discharging device based on the discharged sheet-shaped medium being a sheet-shaped medium bundle having one stapled spot.

39. The image forming apparatus comprising the sheet-shaped medium after-treatment apparatus as claimed in claim 38, wherein said return controlling device controls said returning device so that said returning device contacts with a top surface of said sheet-shaped medium discharged from said discharging device based on a number of the plurality of sheet-shaped media constituting said bundle being less than a predetermined number and one stapled spot for the sheet-shaped medium bundle being set.

40. The image forming apparatus comprising the sheet-shaped medium after-treatment apparatus as claimed in claim 38, wherein said return controlling device controls said returning device so that said returning device contacts with a top surface of said sheet-shaped medium discharged from said discharging device based on a size of the plurality of sheet-shaped media constituting said bundle being smaller than a predetermined size and one stapled spot for the sheet-shaped medium bundle being set.

* * * * *